US010365609B2

(12) United States Patent
Henein et al.

(10) Patent No.: US 10,365,609 B2
(45) Date of Patent: Jul. 30, 2019

(54) ISOTROPIC HARMONIC OSCILLATOR AND ASSOCIATED TIME BASE WITHOUT ESCAPEMENT OR WITH SIMPLIFIED ESCAPEMENT

(71) Applicant: ECOLE POLYTECHNIQUE FEDERALE DE LAUSANNE (EPFL), Lausanne (CH)

(72) Inventors: Simon Henein, Neuchâtel (CH); Lennart Rubbert, Bischheim (FR); Ilan Vardi, Neuchâtel (CH)

(73) Assignee: ECOLE POLYTECHNIQUE FEDERALE DE LAUSANNE (EPFL), Lausanne (CH)

( * ) Notice: Subject to any disclaimer, the term of this patent is extended or adjusted under 35 U.S.C. 154(b) by 79 days.

(21) Appl. No.: 15/109,821

(22) PCT Filed: Jan. 13, 2015

(86) PCT No.: PCT/IB2015/050242

§ 371 (c)(1),
(2) Date: Jul. 6, 2016

(87) PCT Pub. No.: WO2015/104692

PCT Pub. Date: Jul. 16, 2015

(65) Prior Publication Data

US 2016/0327910 A1 Nov. 10, 2016

(30) Foreign Application Priority Data

Jan. 13, 2014 (EP) ..... 14150939
Jun. 25, 2014 (EP) ..... 14173947
(Continued)

(51) Int. Cl.
*G04B 17/04* (2006.01)
*G04B 15/14* (2006.01)
(Continued)

(52) U.S. Cl.
CPC ..... *G04B 17/04* (2013.01); *G04B 15/14* (2013.01); *G04B 17/045* (2013.01); *G04B 21/08* (2013.01); *G04B 23/005* (2013.01)

(58) Field of Classification Search
CPC ..... G04B 17/04; G04B 15/14; G04B 17/045; G04B 21/08; G04B 23/005; G04B 17/10; G04B 11/04
(Continued)

(56) References Cited

U.S. PATENT DOCUMENTS 1,595,169 A 8/1926 Schieferstein
3,269,106 A 8/1966 Waldburger
(Continued)

FOREIGN PATENT DOCUMENTS

CH 113025 A 12/1925
CH 481411 6/1969
(Continued)

OTHER PUBLICATIONS

European Search Opinion dated May 27, 2015.
(Continued)

*Primary Examiner* — Edwin A. Leon
(74) *Attorney, Agent, or Firm* — Andre Roland S.A.; Nikolaus Schibli

(57) ABSTRACT

A mechanical isotropic harmonic oscillator including a two translational degrees of freedom linkage supporting an orbiting mass with respect to a fixed base with springs having isotropic and linear restoring force properties.

20 Claims, 52 Drawing Sheets

(30) Foreign Application Priority Data

| | | |
|---|---|---|
| Sep. 3, 2014 | (EP) | 14183385 |
| Sep. 4, 2014 | (EP) | 14183624 |
| Dec. 1, 2014 | (EP) | 14195719 |

(51) Int. Cl.
*G04B 23/00* (2006.01)
*G04B 21/08* (2006.01)

(58) Field of Classification Search
USPC ..... 368/168, 180
See application file for complete search history.

(56) References Cited

U.S. PATENT DOCUMENTS

| | | | | |
|---|---|---|---|---|
| 3,318,087 | A | 5/1967 | Favre | |
| 3,469,462 | A | 9/1969 | Steinemann et al. | |
| 3,540,208 | A | 11/1970 | Kock | |
| 3,635,013 | A * | 1/1972 | Bertsch | G04B 17/10 368/169 |
| 4,127,986 | A | 12/1978 | Nozawa | |
| 7,522,478 | B2 | 4/2009 | Moteki | |
| 7,963,693 | B2 * | 6/2011 | Genequand | G04B 17/00 368/127 |
| 2002/0191493 | A1 | 9/2002 | Hara | |
| 2005/0007888 | A1 | 1/2005 | Jolidon | |
| 2008/0008052 | A1 | 1/2008 | Moteki | |
| 2013/0279302 | A1 | 10/2013 | Vardi | |
| 2016/0223989 | A1 | 8/2016 | Winkler | |
| 2016/0327910 | A1 | 11/2016 | Henein et al. | |

FOREIGN PATENT DOCUMENTS

| | | | |
|---|---|---|---|
| CH | 911067 | A4 | 6/1969 |
| CH | 481411 | A | 12/1969 |
| CH | 512757 | A | 5/1971 |
| CN | 101105684 | A | 1/2008 |
| DE | 2354226 | A1 | 5/1975 |
| FR | 73414 | | 12/1866 |
| FR | 1457957 | A | 11/1966 |

OTHER PUBLICATIONS

Extended European Search Report dated May 27, 2015.
International Search Report of PCT/IB2015/050242 dated Nov. 25, 2015.
Partial European Search Report dated Oct. 31, 2014.
Written Opinion of the International Search Authority dated Nov. 25, 2015.
First Office Action from the Russian Federal Institute of Industrial Property dated Jun. 25, 2018 with the App. No. 2016130168/28 (046989) and English Translation.
First Office Action from the Russian Federal Institute of Industrial Property dated Jun. 28, 2018 with the App. No. 2016130167/28 (046988) and English Translation.
First Office Action from the USPTO in a related case with the U.S. Appl. No. 15/109,829 dated Feb. 16, 2018.
First Office Action of a related Chinese Patent Application with the Serial No. 201580013818.X, dated May 30, 2018 and English Translation.
Larry L. Howell, Compliant Mechanisms, John Wiley Sons, Inc., 2001, ISBN 0-471-38478-X, Abstract.
Henein, S. and Vardi, I., "Une horlogerie mécanique sans tic-tac," Pour la Science, Apr. 2017, No. 474, pp. 48-54.
International Search Report of PCT/IB2015/050243 dated Oct. 21, 2015.
Li, Y. eet al. "A compliant parallel XY micromotion stage with complete kinematic decoupling." IEEE Transactions on Automation Science and Engineering, 9(3), pp. 538-553, 2012.
Li, Y. et al., "Design of a new decoupled XY flexure parallel kinematic manipulator with actuator isolation." Intelligent Robots and Systems, 2008, IEEE/RSJ International Conference on, pp. 470-475.
Nakayama, K., "A new method of determining the primary position of the eye using Listing's law." Am J Optom Physiol Opt, 55, pp. 331-336, 1978.
Rubbert, L., Bitterli, R., Ferrier, N., Fifanski, S., Vardi, I. and Henein, S. "Isotropic springs based on parallel flexure stages." Precision Engineering, 43, pp. 132-145, 2016.
Simon Henein, "L'oscillateur IsoSpring," Dec. 2016.
Vardi, I., Rubbert, L., Bitterli, R., Ferrier, N., Kahrobaiyan, M., Nussbaumer, B. and Henein, S. "Theory and design of spherical oscillator mechanisms," Precision Engineering, 51, pp. 499-513, 2018.
Written Opinion of the International Search Authority dated Oct. 21, 2015.
Antoine Breguet, Régulateur isochrone de M. Yvon Villarceau, La Nature 1876 (premier semestre), pp. 187-190.
Chrystiaan Huygens, "The Pendulum Clock or Geometrical Demonstrations Concerning the Motionof Pendula As Applied to Clocks," Rerpint by the Iowa State Press in 1986, translated by Richard Blackwell, 1673.
Hall, R.W. and Josic, K., "Planetary motion and the duality of force laws," SIAM review, 42(1), pp. 115-124, 2000.
Henein, S. et al., "IsoSpring: vers la montre sans échappement." In Journée d'étude de la Société Suisse de Chronométrie (No. EPFL-TALK-201790), 2014.
Maxwell, J.C., "On governors," Proceedings of the Royal Society of London, 16, pp. 270-283, 1868.
Jules Haag, "Les mouvements vibratoires," Tome second, Presses Universitaires de France, 1955.
Jules Haag, "Sur le pendule conique," Comptes Rendus de l'Académie des Sciences, 1947, pp. 1234-1236.
Awtar, S., 2003. Synthesis and analysis of parallel kinematic XY flexure mechanisms (Doctoral dissertation, Massachusetts Institute of Technology).
Yvon Villarceau, "Sur les regulateurs isochrones, derives du systeme de Watt," Comptes Rendus de l'Academie des Sciences, 1872, pp. 1437-1445.

* cited by examiner (a) First architecture proposed by [1]

(b) Second architecture proposed by [2]

(c) Third architecture proposed by [8]

(b) Fourth architecture proposed by [9]

Dynamic balancing
θ1 and θ2 coupled
r1 and r2 coupled
Based on three spherical joints and two sliding connections

ISOTROPIC HARMONIC OSCILLATOR AND ASSOCIATED TIME BASE WITHOUT ESCAPEMENT OR WITH SIMPLIFIED ESCAPEMENT

CROSS REFERENCE TO RELATED APPLICATIONS

The present application is a U.S. national stage application of PCT/IB2015/050242 having an International filing date of Jan. 13, 2015, and claims foreign priority to European applications No. EP 14150939.8 filed on Jan. 13, 2014, EP 14173947.4 filed on Jun. 25, 2014, EP 14183385.5 filed on Sep. 3, 2014, EP 14183624.7 filed on Sep. 4, 2014, and EP 14195719.1 filed on Dec. 1, 2014, the contents of all five earlier filed EP applications and the PCT application being incorporated in their entirety by reference.

BACKGROUND OF THE INVENTION

1 Context

The biggest improvement in timekeeper accuracy was due to the introduction of the oscillator as a time base, first the pendulum by Christiaan Huygens in 1656, then the balance wheel-spiral spring by Huygens and Hooke in about 1675, and the tuning fork by N. Niaudet and L. C. Breguet in 1866, see references [20] [5]. Since that time, these have been the only mechanical oscillators used in mechanical clocks and in all watches. (Balance wheels with electromagnetic restoring force approximating a spiral spring are included in the category balance wheel-spiral spring.) In mechanical clocks and watches, these oscillators require an escapement and this mechanism poses numerous problems due to its inherent complexity and its relatively low efficiency which barely reaches 40% at the very best. Escapements have an inherent inefficiency since they are based on intermittent motion in which the whole movement must be stopped and restarted, leading to wasteful acceleration from rest and noise due to impacts. Escapements are well known to be the most complicated and delicate part of the watch, and there has never been a completely satisfying escapement for a wristwatch, as opposed to the detent escapement for the marine chronometer.

BRIEF DESCRIPTION OF THE BACKGROUND ART

Swiss patent No. 113025 published on Dec. 16, 1925 discloses a process to drive an oscillating mechanism. A mentioned aim of this document is to replace an intermittent regulation by a continuous regulation but it fails to clearly disclose how the principles exposed apply to a timekeeper such as a watch. In particular, the constructions are not described as isotropic harmonic oscillators and the described architectures do not result in planar motion of the oscillating mass as in the present invention.

Swiss patent application No. 9110/67 published on Jun. 27, 1967 discloses a rotational resonator for a timekeeper. The disclosed resonator comprises two masses mounted in a cantilevered manner on a central support, each mass oscillating circularly around an axis of symmetry. Each mass is attached to the central support via four springs. The springs of each mass are connected to each other to obtain a dynamic coupling of the masses. To maintain the rotational oscillation of the masses, an electromagnetic device is used that acts on ears of each mass, the ears containing a permanent magnet.

One of the springs comprises a pawl for cooperation with a ratchet wheel in order to transform the oscillating motion of the masses into a unidirectional rotational movement. The disclosed system therefore is still based on the transformation of an oscillation, that is an intermittent movement, into a rotation via the pawl which renders the system of this publication equivalent to the escapement system known in the art and cited above.

Swiss additional patent No. 512757 published on May 14, 1971 is related to a mechanical rotating resonator for a timekeeper. This patent is mainly directed to the description of springs used in such a resonator as disclosed in CH patent application No. 9110/67 discussed above. Here again, the principle of the resonator thus uses a mass oscillating around an axis.

U.S. Pat. No. 3,318,087 published on May 9, 1967 discloses a torsion oscillator that oscillates around a vertical axis. Again, this is similar to the escapement of the prior art and described above.

SUMMARY

An aim of the present invention is thus to improve the known systems and methods.

A further aim of the present invention is to provide a system that avoids the intermittent motion of the escapements known in the art.

A further aim of the present invention is to propose a mechanical isotropic harmonic oscillator.

Another aim of the present invention is to provide an oscillator that may be used in different time-related applications, such as: time base for a chronograph, timekeeper (such as a watch), accelerometer, speed governor.

The present invention solves the problem of the escapement by eliminating it completely or, alternatively, by a family of new simplified escapements which do not have the drawbacks of current watch escapements.

The result is a much simplified mechanism with increased efficiency.

In one embodiment, the invention concerns a mechanical isotropic harmonic oscillator comprising at least a two degree of freedom linkage supporting an orbiting mass with respect to a fixed base with springs having isotropic and linear restoring force properties.

In one embodiment, the oscillator may be based on an XY planar spring stage forming a two degree-of-freedom linkage resulting in purely translational motion of the orbiting mass such that the mass travels along its orbit while keeping a fixed orientation.

In one embodiment, each spring stage may comprise at least two parallel springs.

In one embodiment, each stage may be made of a compound parallel spring stage with two parallel spring stages mounted in series.

In one embodiment, the oscillator may comprise at least one compensating mass for each degree of freedom dynamically balancing the oscillator. The masses move such that the center of gravity of the complete mechanism remains stationary.

In one embodiment, the invention concerns as oscillator system comprising at least two oscillators as defined herein. In a variant, the system comprises four oscillators.

In one embodiment, each stage formed by an oscillator is rotated by an angle with respect to the stage next to it and the stages are mounted in parallel. Preferably, but not limited thereto, the angle is 45°, 90° or 180° or another value.

In one embodiment, each stage formed by an oscillator is rotated by an angle with respect to the stage next to it and the stages are mounted in series. Preferably, but not limited thereto, the angle is 45°, 90° or 180° or another value.

In one embodiment the X and Y translation of the oscillator can be replaced by generalized coordinates, wherein X and Y can be either a rotation or a translation In one embodiment, the oscillator or oscillator system may comprise a mechanism for continuous mechanical energy supply to the oscillator or oscillator system.

In one embodiment of the oscillator or oscillator system, the mechanism for energy supply applies a torque or an intermittent force to the oscillator or to the oscillator system.

In one embodiment, the mechanism may comprise a variable radius crank which rotates about a fixed frame through a pivot and a prismatic joint which allows the crank extremity to rotate with a variable radius.

In one embodiment, the mechanism may comprise a fixed frame holding a crankshaft on which a maintaining torque is applied, a crank which is attached to a crankshaft and equipped with a prismatic slot, wherein a rigid pin is fixed to the orbiting mass of the oscillator or oscillator system, wherein said pin engages in said slot.

In one embodiment, the mechanism may comprise a detent escapement for intermittent mechanical energy supply to the oscillator.

In one embodiment, the detent escapement comprises two parallel catches which are fixed to the orbiting mass, whereby one catch displaces a detent which pivots on a spring to releases an escape wheel, and whereby said escape wheel impulses on the other catch thereby restoring lost energy to the oscillator or oscillator system.

In one embodiment, the invention concerns a timekeeper such as a clock comprising an oscillator or an oscillator system as defined in the present application.

In one embodiment, the timekeeper is a wristwatch.

In one embodiment, the oscillator or oscillator system defined in the present application is used as a time base for a chronograph measuring fractions of seconds requiring only an extended speed multiplicative gear train, for example to obtain 100 Hz frequency so as to measure $1/100^{th}$ of a second.

In one embodiment, the oscillator or oscillator system defined in the present application is used as speed regulator for striking or musical clocks and watches, as well as music boxes, thus eliminating unwanted noise and decreasing energy consumption, and also improving musical or striking rhythm stability.

These embodiments and others will be described in more detail in the following description of the invention.

BRIEF DESCRIPTION OF THE SEVERAL VIEWS OF THE DRAWINGS

The present invention will be better understood from the following description and from the drawings which show

DETAILED DESCRIPTION OF THE SEVERAL EMBODIMENTS

2 Conceptual Basis of the Invention

2.1 Newton's Isochronous Solar System

As is well-known, in 1687 Isaac Newton published Principia Mathematica in which he proved Kepler's laws of planetary motion, in particular, the First Law which states that planets move in ellipses with the Sun at one focus and the Third Law which states that the square of the orbital period of a planet is proportional to the cube of the semi-major axis of its orbit, see reference [19].

Figure 1:
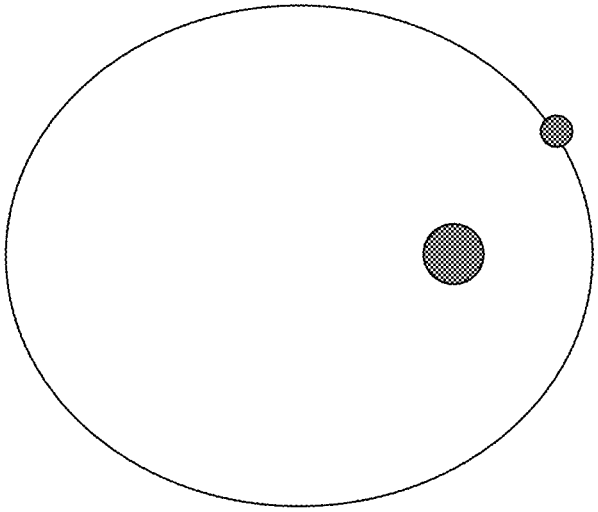
FIG.1 PRIOR ART
FIG. 1 illustrates an orbit with the inverse square law.
Figure 2:
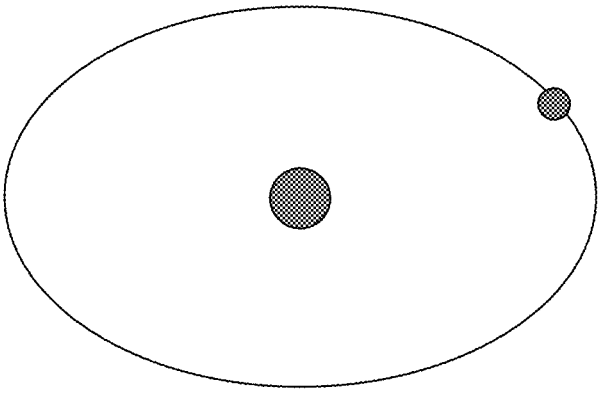
FIG.2 PRIOR ART
FIG. 2 illustrates an orbit according to Hooke's law.
Figure 3:
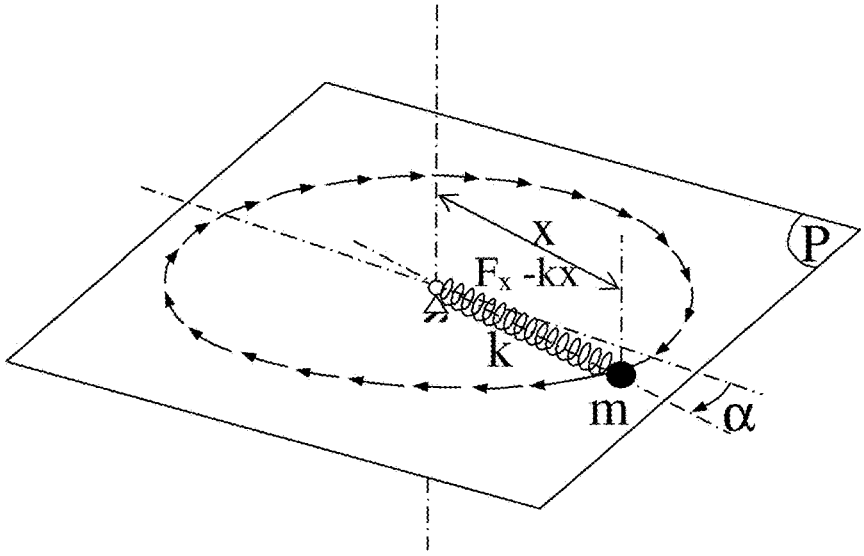
FIG.3 PRIOR ART
FIG. 3 illustrates an example of a physical realization of Hooke's law.

Less well-known is that in Book I, Proposition X, of the same work, he showed that if the inverse square law of attraction (see FIG. 1) was replaced by a linear attractive central force (since called Hooke's Law, see FIGS. 2 and 3) then the planetary motion was replaced by elliptic orbits with the Sun at the center of the ellipse and the orbital period is the same for all elliptical orbits. (The occurrence of ellipses in both laws is now understood to be due to a relatively simple mathematically equivalence, see reference [13], and it is also well-known that these two cases are the only central force laws leading to closed orbits, see reference [1].)

Newton's result for Hooke's Law is very easily verified: Consider a point mass moving in two dimensions subject to a central force $$F(r)=-kr$$

centered at the origin, where r is the position of the mass, then for an object of mass m, this has solution $$(A_1 \sin(\omega_0 t+\phi_1), A_2 \sin(\omega_0 t+\phi_2)),$$

for constants $A_1$, $A_2$, $\phi_1$, $\phi_2$ depending on initial conditions and frequency $$\omega_0 = \sqrt{\frac{k}{m}}.$$

This not only shows that orbits are elliptical, but that the period of motion depends only on the mass m and the rigidity k of the central force. This model therefore displays isochronism since the period $$T = 2\pi\sqrt{\frac{m}{k}}$$

is independent of the position and momentum of the point mass (the analogue of Kepler's Third Law proved by Newton).

2.2 Implementation as a Time Base for a Timekeeper

Isochronism means that this oscillator is a good candidate to be a time base for a timekeeper as a possible embodiment of the present invention.

This has not been previously done or mentioned in the literature and the utilization of this oscillator as a time base is an embodiment of the present invention.

This oscillator is also known as a harmonic isotropic oscillator where the term isotropic means "same in all directions."

Despite being known since 1687 and its theoretical simplicity, it would seem that the isotropic harmonic oscillator, or simply "isotropic oscillator,", has never been previously used as a time base for a watch or clock, and this requires explanation.

It would seem that the main reason is the fixation on constant speed mechanisms such as governors or speed regulators, and a limited view of the conical pendulum as a constant speed mechanism.

For example, in his description of the conical pendulum which has the potential to approximate isochronism, Leopold Defossez states its application to measuring very small intervals of time, much smaller than its period, see reference [8, p. 534].

H. Bouasse devotes a chapter of his book to the conical pendulum including its approximate isochronism, see reference [3, Chapitre VIII]. He devotes a section of this chapter on the utilization of the conical pendulum to measure fractions of seconds (he assumes a period of 2 seconds), stating that this method appears perfect. He then qualifies this by noting the difference between average precision and instantaneous precision and admits that the conical pendulum's rotation may not be constant over small intervals due to difficulties in adjusting the mechanism. Therefore, he considers variations within a period as defects of the conical pendulum which implies that he considers that it should, under perfect conditions, operate at constant speed.

Similarly, in his discussion of continuous versus intermittent motion, Rupert Gould overlooks the isotropic oscillator and his only reference to a continuous motion timekeeper is the Villarceau regulator which he states: "seems to have given good results. But it is not probable that was more accurate than an ordinary good-quality driving clock or chronograph," see reference [9, 20-21]. Gould's conclusion is validated by the Villarceau regulator data given by Breguet, see reference [4].

From the theoretical standpoint, there is the very influential paper of James Clerk Maxwell *On Governors*, which is considered one of the inspirations for modern control theory, see reference [18].

Moreover, isochronism requires a true oscillator which must preserve all speed variations. The reason is that the wave equation $$\nabla^2 \vec{X} = \frac{1}{c^2}\frac{\partial^2 \vec{X}}{\partial t^2}$$

preserves all initial conditions by propagating them. Thus, a true oscillator must keep a record of all its speed perturbation. For this reason, the invention described here allows maximum amplitude variation to the oscillator.

This is exactly the opposite of a governor which must attenuate these perturbations. In principle, one could obtain isotropic oscillators by eliminating the damping mechanisms leading to speed regulation.

The conclusion is that the isotropic oscillator has not been used as a time base because there seems to have been a conceptual block assimilating isotropic oscillators with governors, overlooking the simple remark that accurate timekeeping only requires a constant time over a single complete period and not over all smaller intervals.

We maintain that this oscillator is completely different in theory and function from the conical pendulum and governors, see hereunder in the present description.

Figure 4:
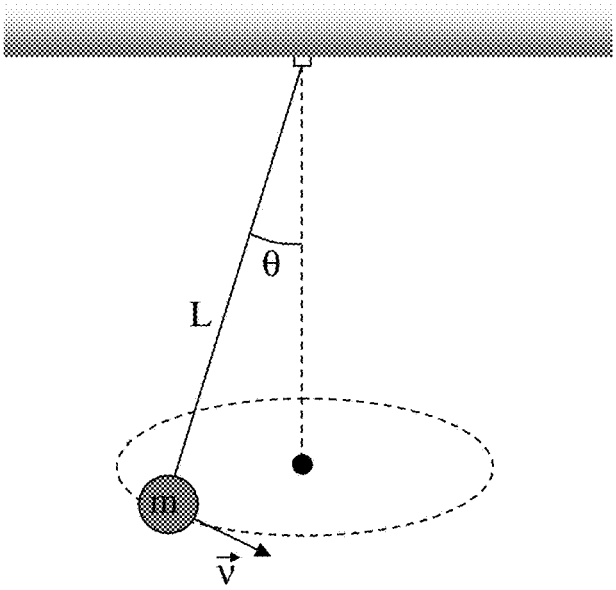
FIG.4 PRIOR ART
FIG. 4 illustrates the conical pendulum principle.
Figure 5:
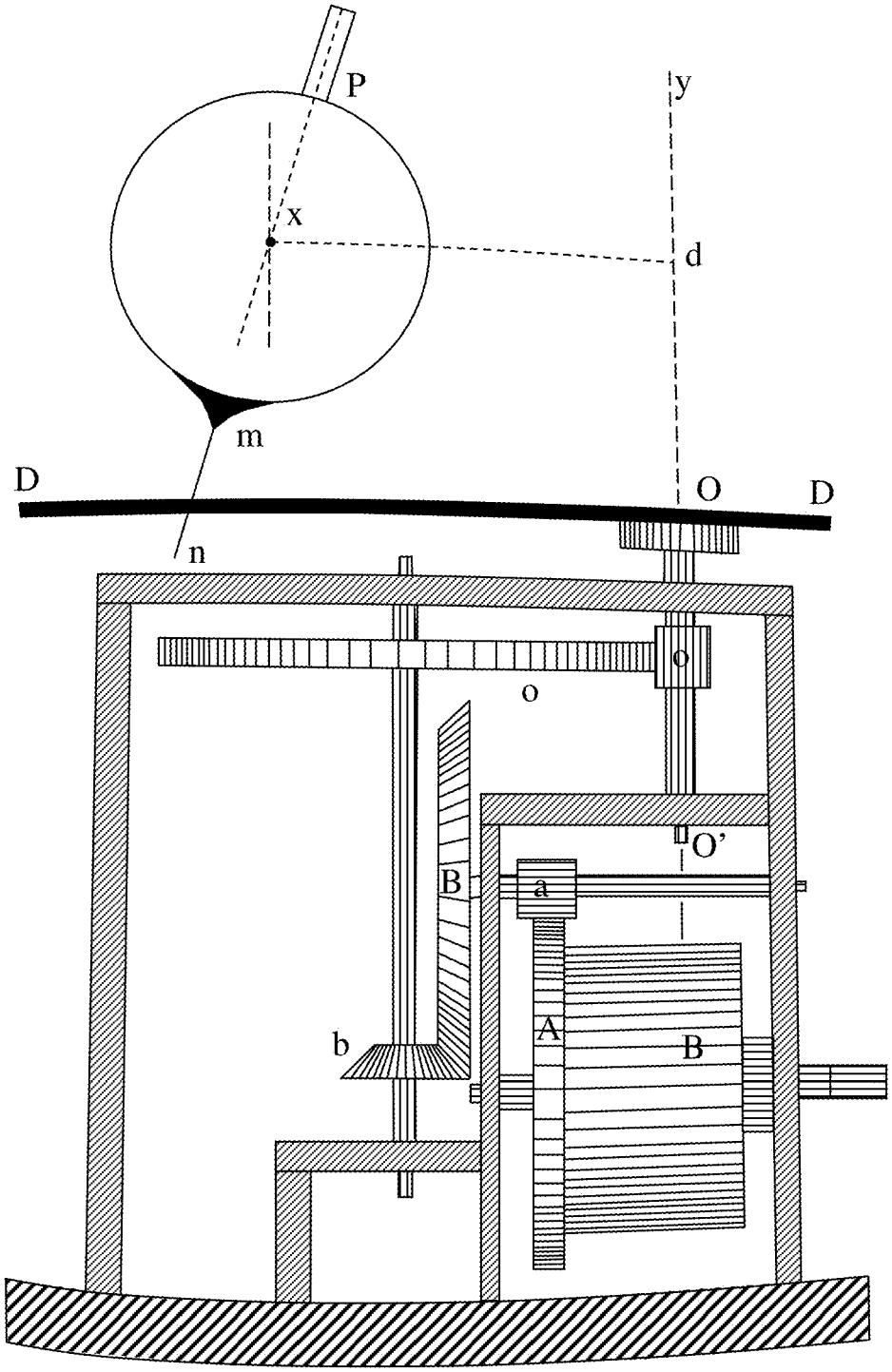
FIG.5 PRIOR ART
FIG. 5 illustrates a conical pendulum mechanism.

FIG. 4 illustrates the principle of the conical pendulum and FIG. 5 a typical conical pendulum mechanism.

Figure 6:
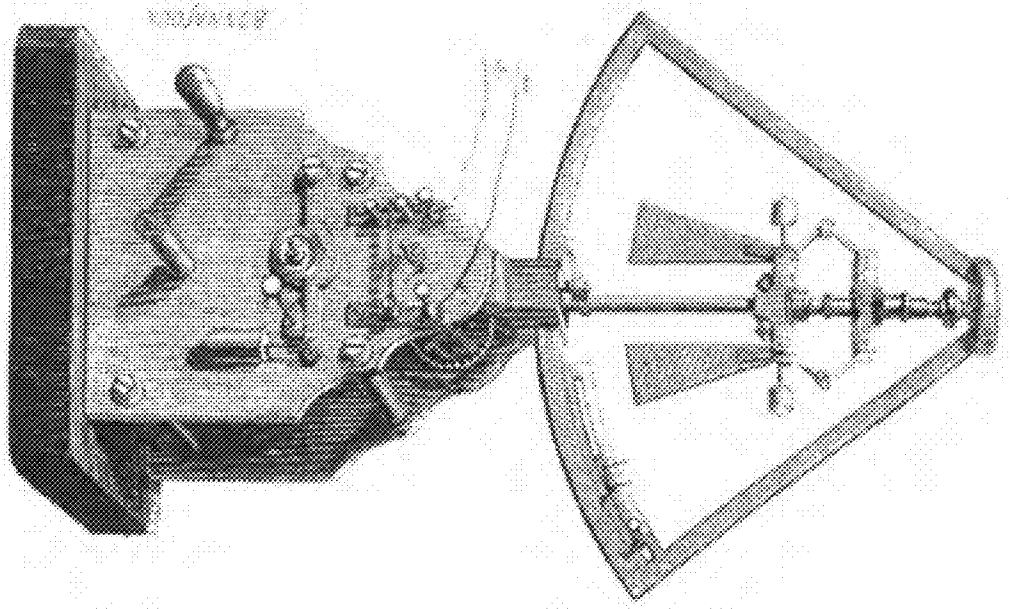
FIG.6 PRIOR ART
FIG. 6 illustrates a Villarceau governor made by Antoine Breguet.
Figure 7:
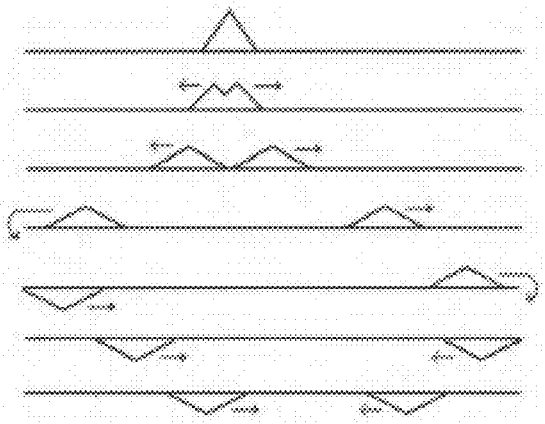
FIG.7 PRIOR ART
FIG. 7 illustrates the propagation of a singularity for a plucked string.

FIG. 6 illustrates a Villarceau governor made by Antoine Breguet in the 1870's and FIG. 7 illustrates the propagation of a singularity for a plucked string.

2.3 Rotational Versus Translational Orbiting Motion

Figure 58:
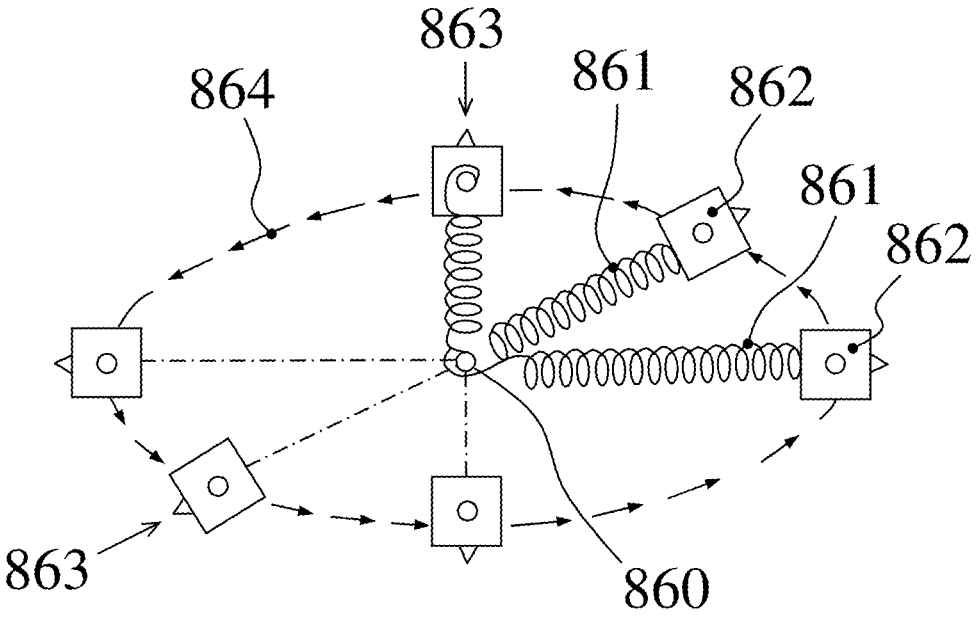
FIG. 58 illustrates a rotating spring.

Two types of isotropic harmonic oscillators having unidirectional motion are possible. One is to take a linear spring with body at its extremity, and rotate the spring and body around a fixed center. This is illustrated in FIG. 58: Rotating spring. Spring 861 with body 862 attached to its extremity is fixed to center 860 and rotates around this center so that the center of mass of the body 862 has orbit 864. The body 862 rotates around its center of mass once every full orbit, as can be seen by the rotation of the pointer 863.

Figure 59:
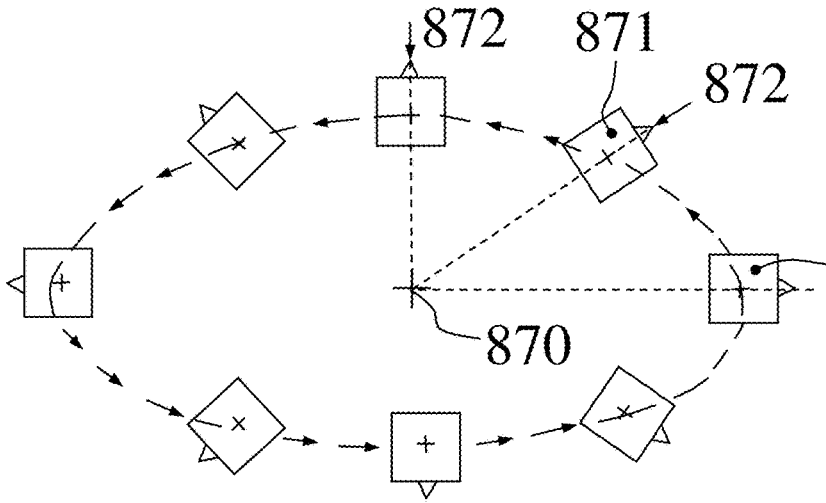
FIG. 59 illustrates a body orbiting in an elliptical orbit by rotation.

This leads to the body rotating around its center of mass with one full turn per revolution around the orbit as illustrated in FIG. 59. Example of rotational orbit. Body 871 orbits around point 870 and rotates around its axis once for every complete orbit, as can be seen by the rotation of point 872.

This type of spring will be called a rotational isotropic oscillator and will be described in Section 4.1. In this case, the moment of inertia of the body affects the dynamics, as the body is rotating around itself.

Figure 60:
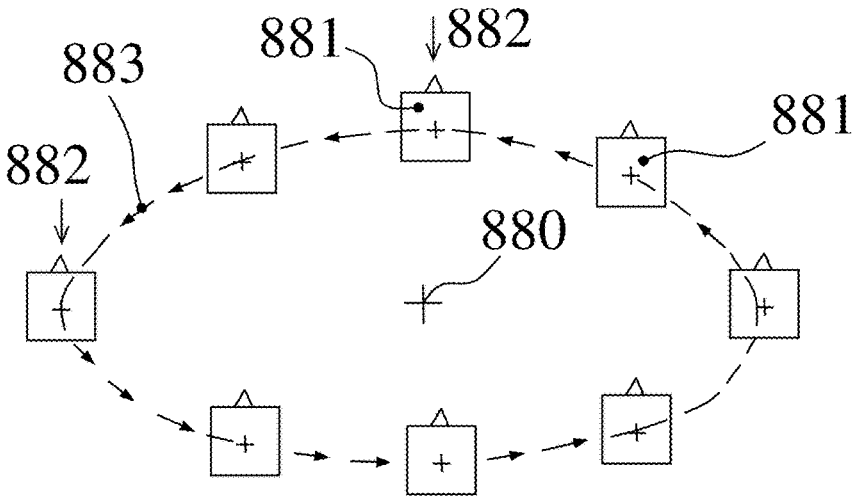
FIG. 60 illustrates a body orbiting in an elliptical orbit by translation, without rotation.

Another possible realization has the mass supported by a central isotropic spring, as described in Section 4.2. In this case, this leads to the body having no rotation around its center of mass, and we call this orbiting by translation. This is illustrated in FIG. 60: Translational orbit. Body 881 orbits around center 880, moving along orbit 883, but without rotating around its center of gravity. Its orientation remains unchanged, as seen by the constant direction of pointer 882 on the body.

In this case, the moment of inertia of the mass does not affect the dynamics.

Figure 61:
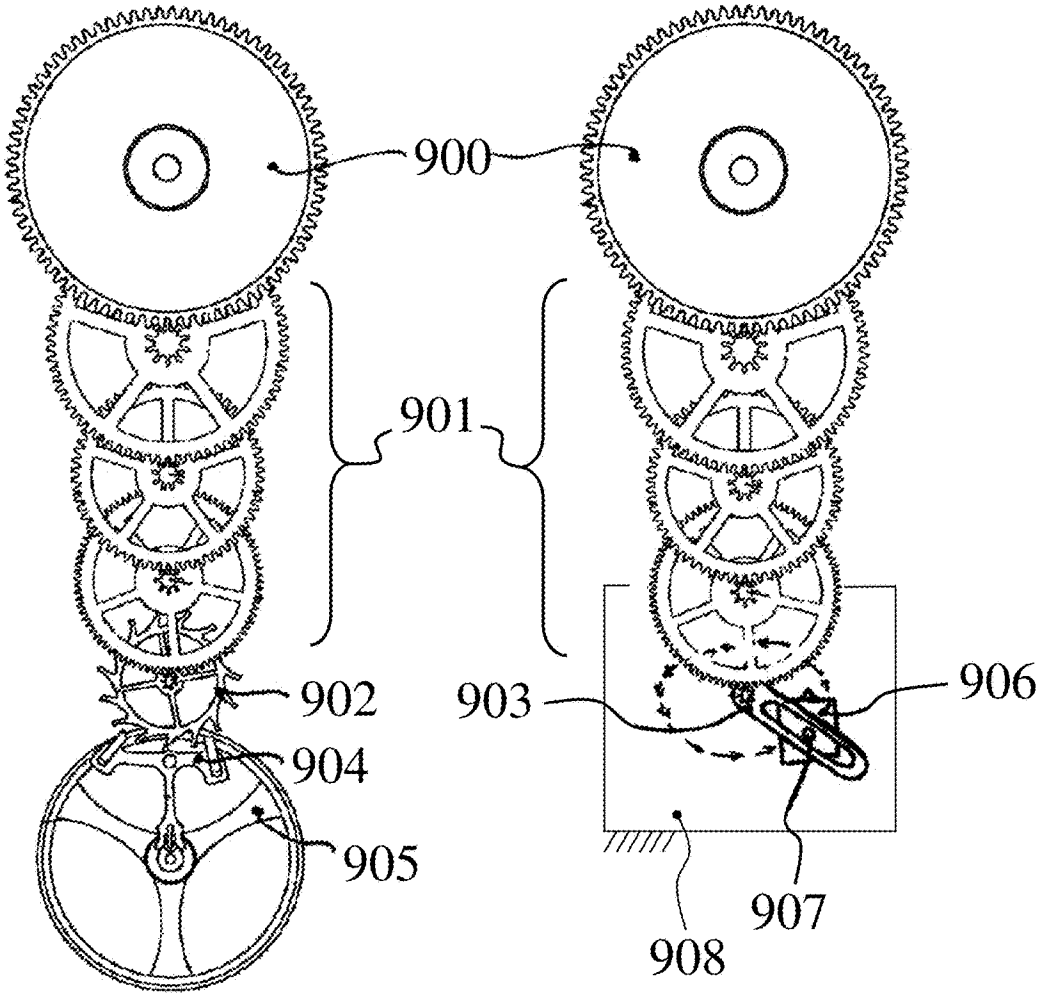
FIG. 61 illustrates how to integrate our oscillator into a standard mechanical watch or clock movement by replacing the current balance-spring and escapement with an isotropic oscillator and driving crank.

2.4 Integration of the Isotropic Harmonic Oscillator in a Standard Mechanical Movement Our time base using an isotropic oscillator will regulate a mechanical timekeeper, and this can be implemented by simply replacing the balance wheel and spiral spring oscillator with the isotropic oscillator and the escapement with a crank fixed to the last wheel of the gear train. This is illustrated in FIG. 61: On the left is the classical case. Mainspring 900 transmits energy via gear train 901 to escape wheel 902 which transmits energy intermittently to balance wheel 905 via anchor 904. On the right is our mechanism. Mainspring 900 transmits energy via gear train 901 to crank 906 which transmits energy continuously to isotropic oscillator 906 via the pin 907 travelling in a slot on this crank. The isotropic oscillator is attached to fixed frame 908, and its center of restoring force coincides with the center of the crank pinion.

3 Theoretical Requirements of the Physical Realization

In order to realize an isotropic harmonic oscillator, in accordance with the present invention, there requires a physical construction of the central restoring force. One first notes that the theory of a mass moving with respect to a central restoring force is such that the resulting motion lies in a plane. It follows that for practical reasons, the physical construction should realize planar isotropy. Therefore, the constructions and embodiments described here will mostly be of planar isotropy, but not limited to this embodiment, and there will also be an example of 3-dimensional isotropy.

In order for the physical realization to produce isochronous orbits for a time base, the theoretical model of Section 2 above must be adhered to as closely as possible. The spring stiffness k is independent of direction and is a constant, that is, independent of radial displacement (linear spring). In theory, there is a point mass, which therefore has moment of inertia J=0 when not rotating. The reduced mass m is isotropic and also independent of displacement. The resulting mechanism should be insensitive to gravity and to linear and angular shocks. The conditions are therefore Isotropic k. Spring stiffness k isotropic (independent of direction).

Radial k. Spring stiffness k independent of radial displacement (linear spring).

Zero J. Mass m with moment of inertia J=0.

Isotropic m. Reduced mass m isotropic (independent of direction).

Radial m. Reduced mass m independent of radial displacement.

Gravity. Insensitive to gravity.

Linear shock. Insensitive to linear shock.

Angular shock. Insensitive to angular shock.

4 Realization of the Isotropic Harmonic Oscillator

Planar isotropy may be realized in two ways.

4.1 Rotating Springs Leading to a Rotational Isotropic Oscillator

Figure 8:
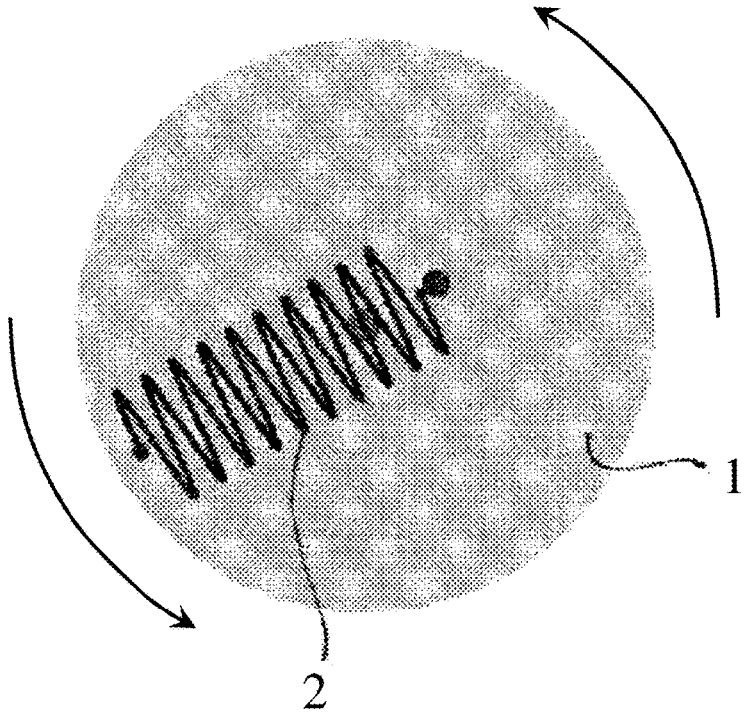
FIG.8 PRIOR ART
FIG. 8 illustrates a rotating spring on a turntable.

A.1. A rotating turntable 1 on which is fixed a spring 2 of rigidity k with the spring's neutral point at the center of rotation of the turntable, is illustrated in FIG. 8. Assuming a massless turntable 1 and spring 2, a linear central restoring force is realized by this mechanism. However, given the physical reality of the turntable and spring, this realization has the disadvantages of having significant spurious mass and moment of inertia.

Figure 9:
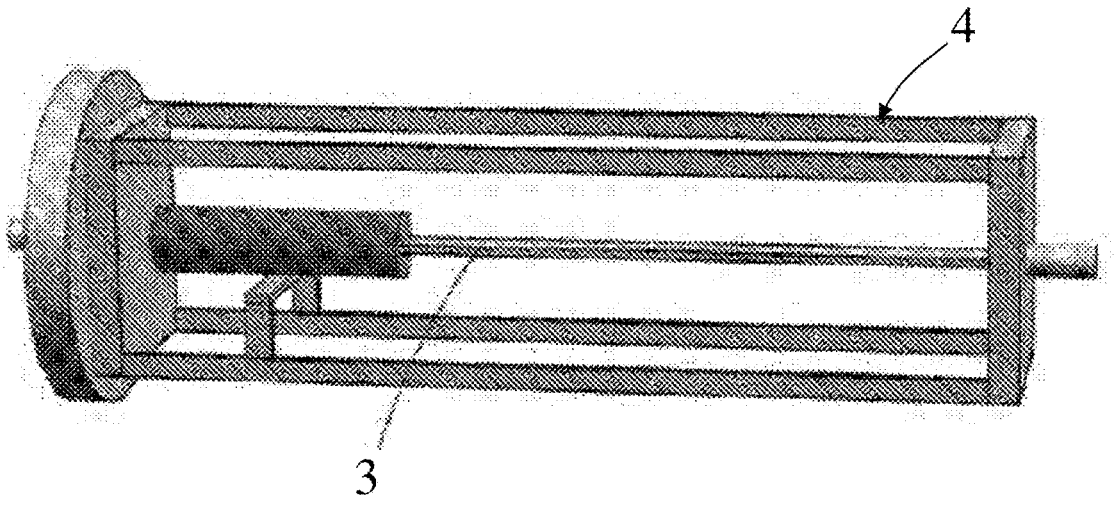
FIG.9 PRIOR ART
FIG. 9 illustrates an isotropic oscillator with axial spring and support.
Figure 10:
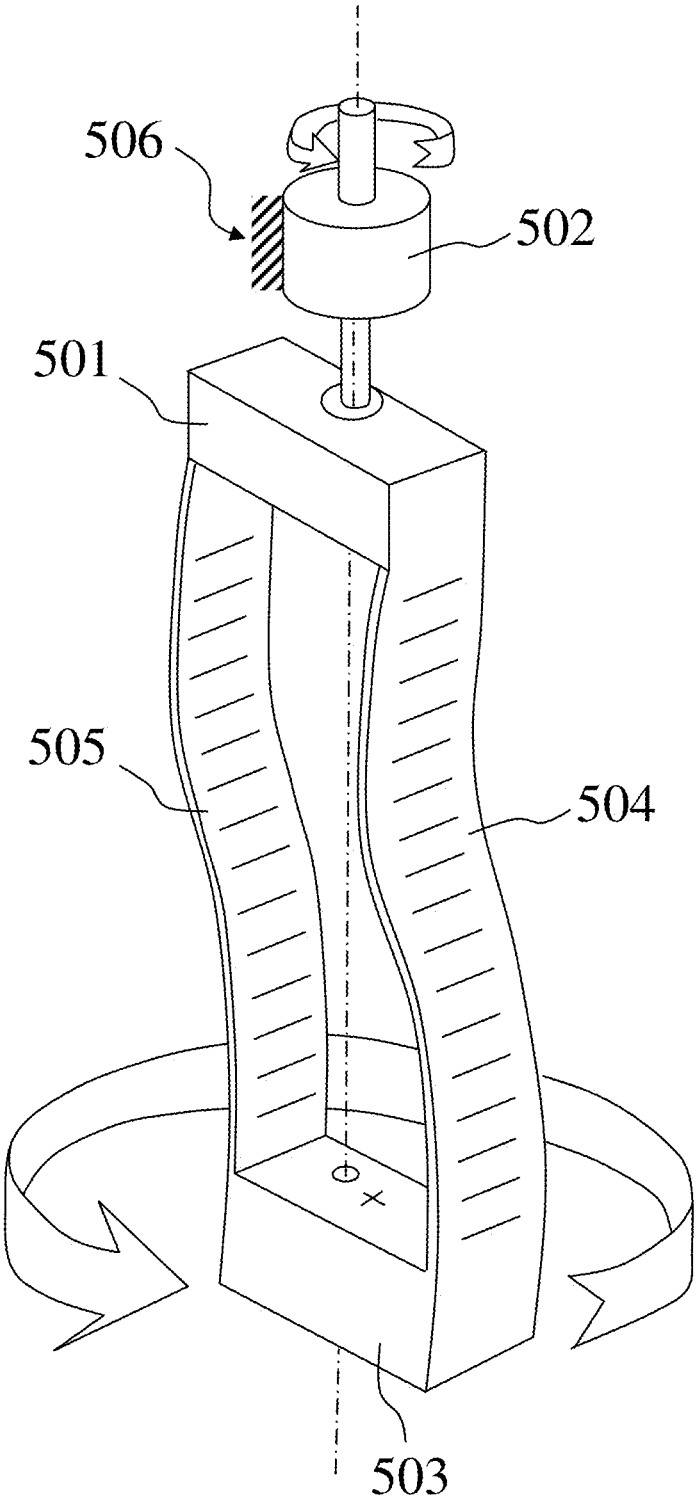
FIG. 10 illustrates an isotropic oscillator with double leaf springs.

A.2. A rotating cantilever spring 3 supported in a cage 4 turning axially is illustrated in FIG. 9. This again realizes the central linear restoring force but reduces spurious moment of inertia by having a cylindrical mass and an axial spring. Numerical simulation shows that divergence from isochronism is still significant. A physical model has been constructed, see FIG. 10 where vertical motion of the mass 503 has been minimized by attaching the mass to a double leaf spring 504, 505 producing approximately linear displacement instead of the approximately circular displacement of the single spring of FIG. 9. The rotating frame 501 is linked to the fixed base 506 by a isotropic bearing 502.

Note that gravity does not affect the spring when it is in the axial direction. However, these realizations have the disadvantage of having the spring and its support both rotating around their own axes, which introduces spurious moment of inertia terms which reduce the theoretical isochronism of the model. Indeed, considering the point mass of mass m and then including a isotropic support of moment of inertia I and constant total angular momentum L, then if friction is ignored, the equations of motion reduce to $$\ddot{r}+\left(\omega_0^2-\frac{L^2}{(I+mr^2)^2}\right)r=0.$$

This equation can be solved explicitly in terms of Jacobi elliptic functions and the period expressed in terms of elliptic integrals of the first kind, see reference [17] for definitions and similar applications to mechanics. A numerical analysis of these solutions shows that the divergence from isochronism is significant unless the moment of inertia I is minimized.

We now list which of the theoretical properties of Section 3 hold for these realizations. In particular, for the rotating cantilever spring.

| Isotropic k | Radial k | Zero J | Isotropic m | Radial m | Gravity | Linear shock | Angular shock |
|---|---|---|---|---|---|---|---|
| Yes | Yes | No | Ye | Ye | One direction | No | No |

4.2 Isotropic Springs with Orbits by Translation.

The realizations which appear to be most suitable to preserve the theoretical characteristics of the harmonic oscillator are the ones in which the central force is realized by an isotropic spring, where the term isotropic is again used to mean "same in all directions."

Figure 16:
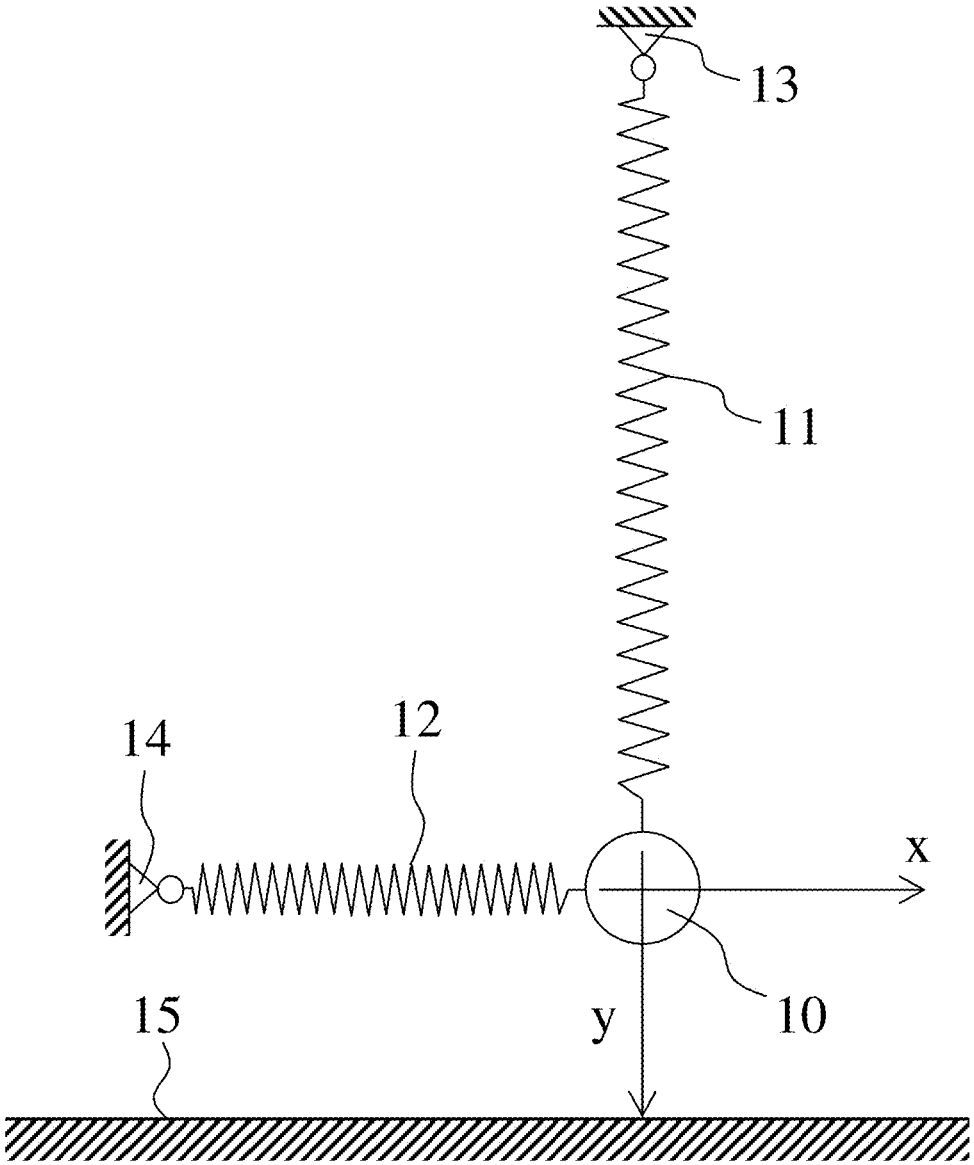
FIG. 16 illustrates a simple planar isotropic spring.

A simple example is given in FIG. 16 illustrating a simple planar isotropic spring with an orbiting mass 10, a y-coordinate spring 11, an x-coordinate spring 12, a y-spring fixation to ground 13, an x-spring fixation to ground 14, a horizontal ground 15, the y-axis being vertical so parallel to force of gravity. In this figure, the two springs Sx 12 and Sy 11 of rigidity k are placed such that spring Sx 12 acts in the horizontal x-axis and spring Sy 11 acts in the vertical y-axis. There is a mass 10 attached to both these springs 11, 12 and having mass m. The geometry is chosen such that at the point (0, 0) both springs are in their neutral positions.

Figure 17:
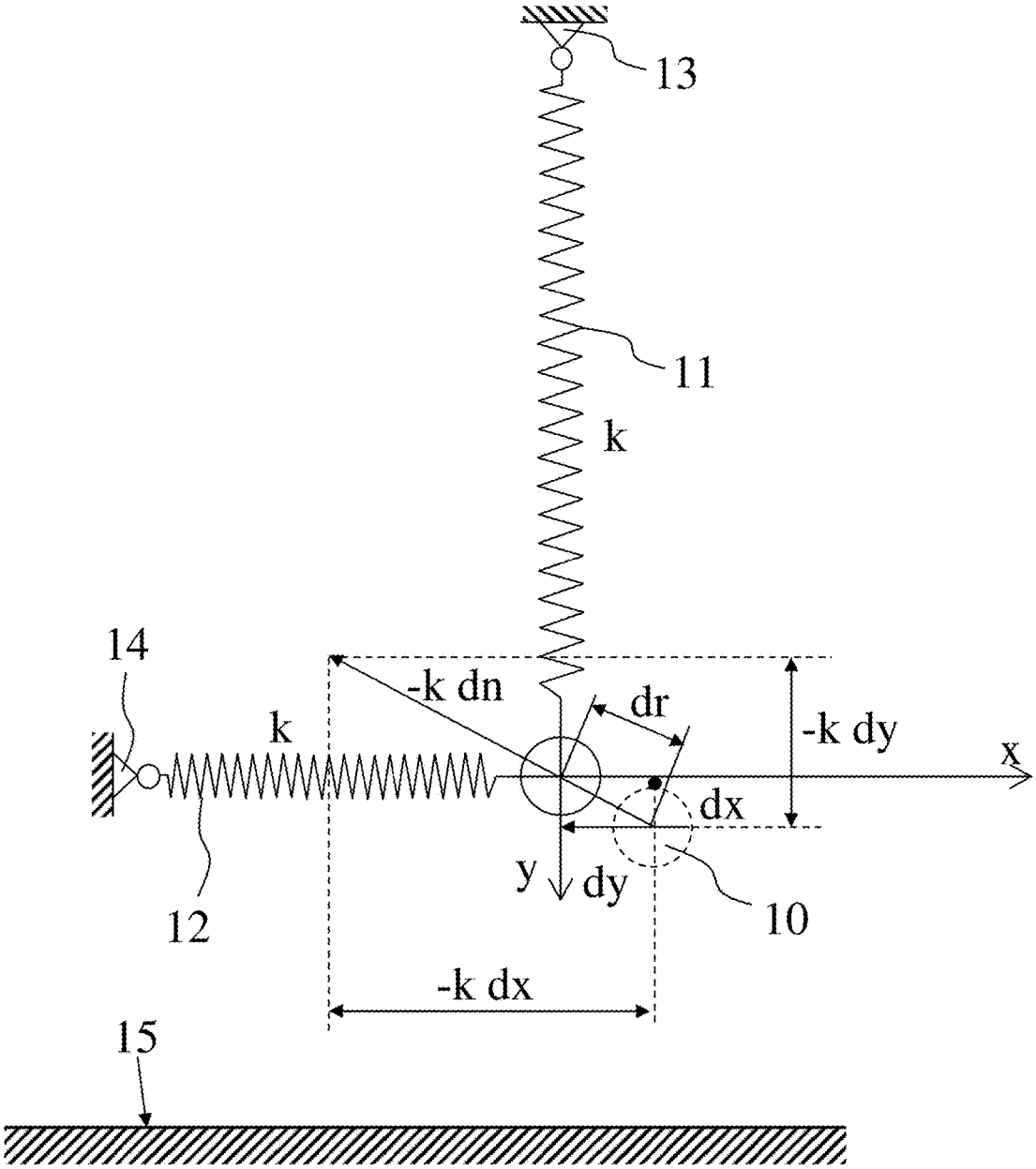
FIG. 17 illustrates a planar isotropic Hooke's law to first order.

One can now show that this mechanism exhibits isotropy to first order, as illustrated in FIG. 17. Assuming now a small displacement d r=(dx, dy), then up to first order, there is a restoring force Fx in the x direction of −k dx and a restoring force Fy in y direction of −k dy. This gives a total restoring force $$F(dr)=(-kdx,-kdy)=-kdr$$

and the central linear restoring force of Section 2 is verified. It follows that this mechanism is, up to first order, a realization of a central linear restoring force, as claimed.

In these realizations, gravity affects the springs 11, 12 in all directions as it changes the effective spring constant. However, the springs 11, 12 does not rotate around its own axis, minimizing spurious moments of inertia, and the central force is directly realized by the spring itself. We now list which of the theoretical properties of Section 3 hold for these realizations (up to first order).

| Isotropic k | Radial k | Zero J | Isotropic m | Radial m | Gravity | Linear shock | Angular shock |
|---|---|---|---|---|---|---|---|
| Yes | Yes | Yes | Yes | Yes | no | No | No |

Many planar springs have been proposed and if some may be implicitly isotropic, none has been explicitly declared to be isotropic. In the literature, Simon Henein [see reference 14, p. 166, 168] has proposed two mechanisms which exhibit planar isotropy. But these examples, as well as the one just described above, do not exhibit sufficient isotropy to produce an accurate timebase for a timekeeper, as a possible embodiment of the invention described herein.

Figure 11:
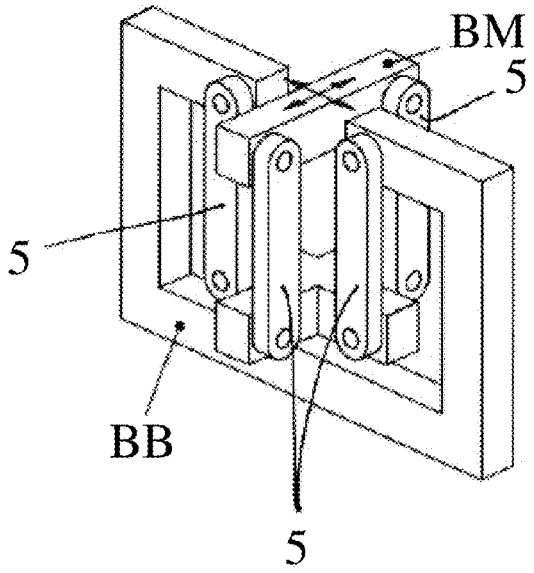
FIG. 11 illustrates an XY stage comprising two serial compliant four-bars mechanisms.
Figure 12:
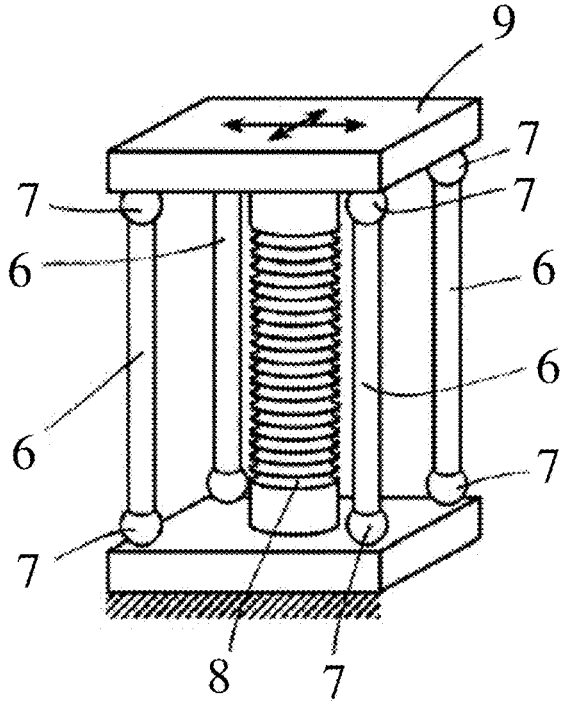
FIG. 12 illustrates an XY stage comprising four parallel arms linked with eight spherical joints and a bellow connecting the mobile platform to the ground and monolithic construction based on flexures.

An embodiment illustrated in FIG. 11, comprises two serial compliant four-bar 5 is also called parallel arms linkage, which allows, for small displacements, translations in the X and Y directions. Another embodiment, illustrated in FIG. 12, comprises four parallel arms 6 linked with eight spherical joints 7 and a central bellow 8 connecting the mobile platform 9 to the ground.

Therefore, more precise isotropic springs have been developed. In particular, the precision has been greatly improved and this is the subject of several embodiments described in the present application.

In these realizations, the spring does not rotate around its own axis, minimizing spurious moments of inertia, and the central force is directly realized by the spring itself. These have been named isotropic springs because their restoring force is the same in all directions.

Figure 18:
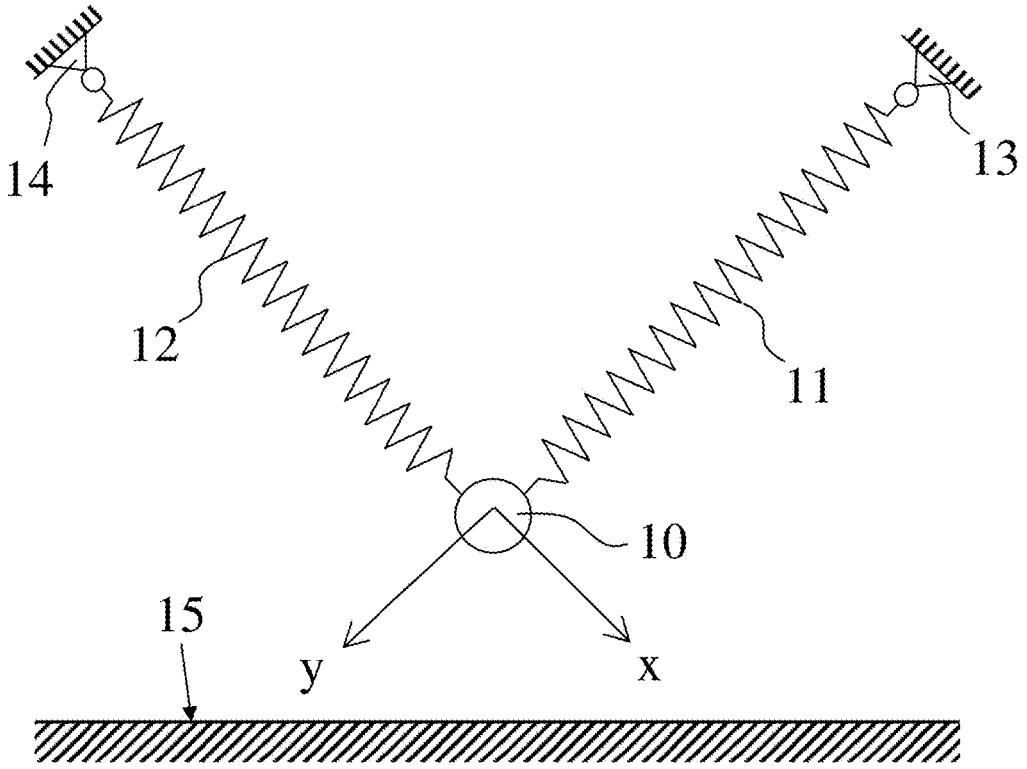
FIG. 18 illustrates a simple planar isotropic spring in an alternate construction with equal distribution of gravitational force on the two springs.
Figure 18A:
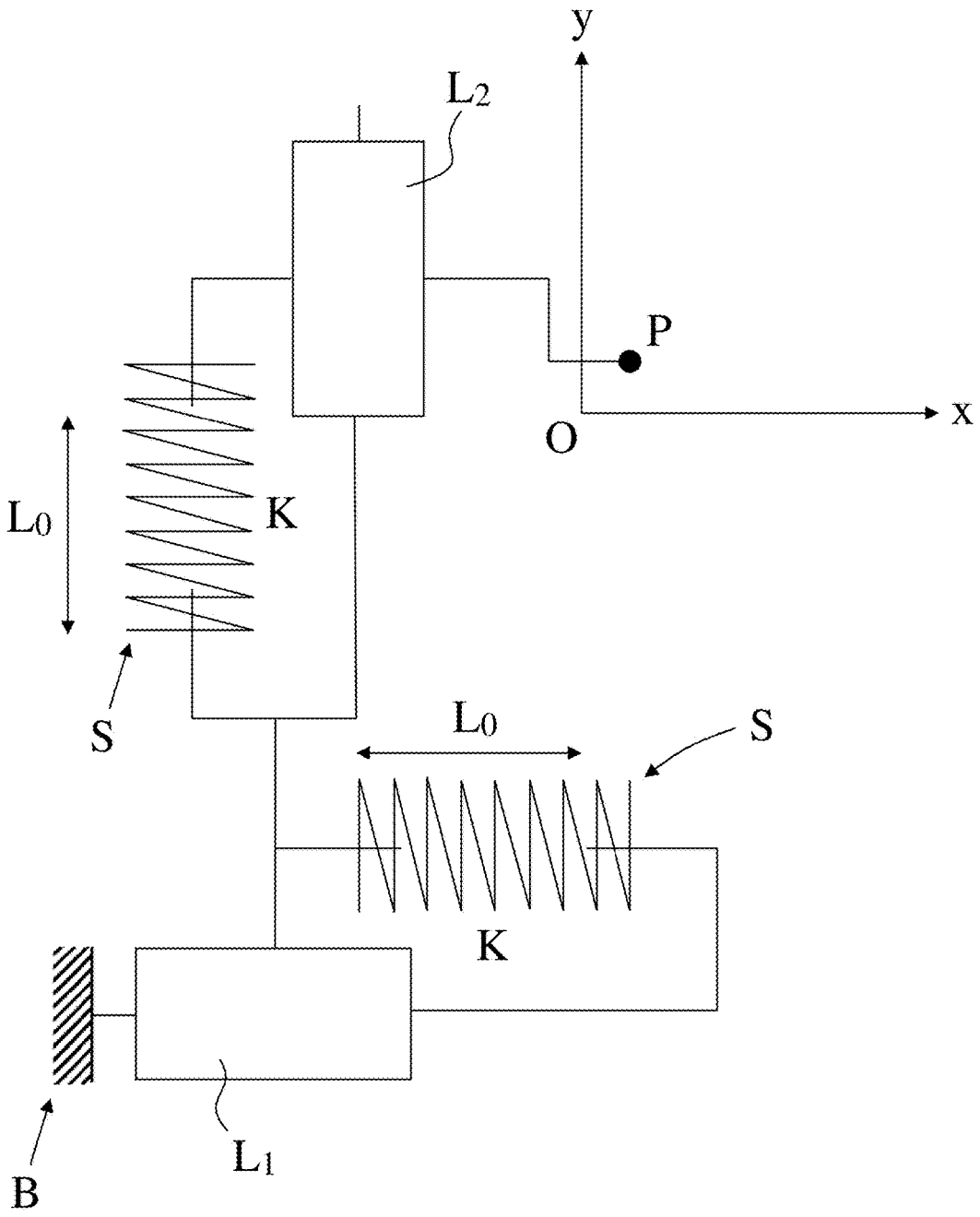
FIG. 18A illustrates a basic example of an embodiment of the oscillator made of planar isotropic springs according to the present invention.

A basic example of an embodiment of the oscillator made of planar isotropic springs according to the present invention is illustrated in FIG. 18A. Said figure illustrates a mechanical isotropic harmonic oscillator comprising at least a two degrees of freedom linkage L1/L2 made by appropriate guiding means (for example sliding means, or linkages, springs etc.), supporting an orbiting mass P with respect to a fixed base B with springs S having isotropic and linear restoring force K properties.

5 Compensation Mechanisms

In order to place the new oscillator in a portable timekeeper as an exemplary embodiment of the present invention, it is necessary to address forces that could influence the correct functioning of the oscillator. These include gravity and shocks.

5.1 Compensation for Gravity

The first method to address the force of gravity is to make a planar isotropic spring which when in horizontal position with respect to gravity does not feel its effect.

Figure 19:
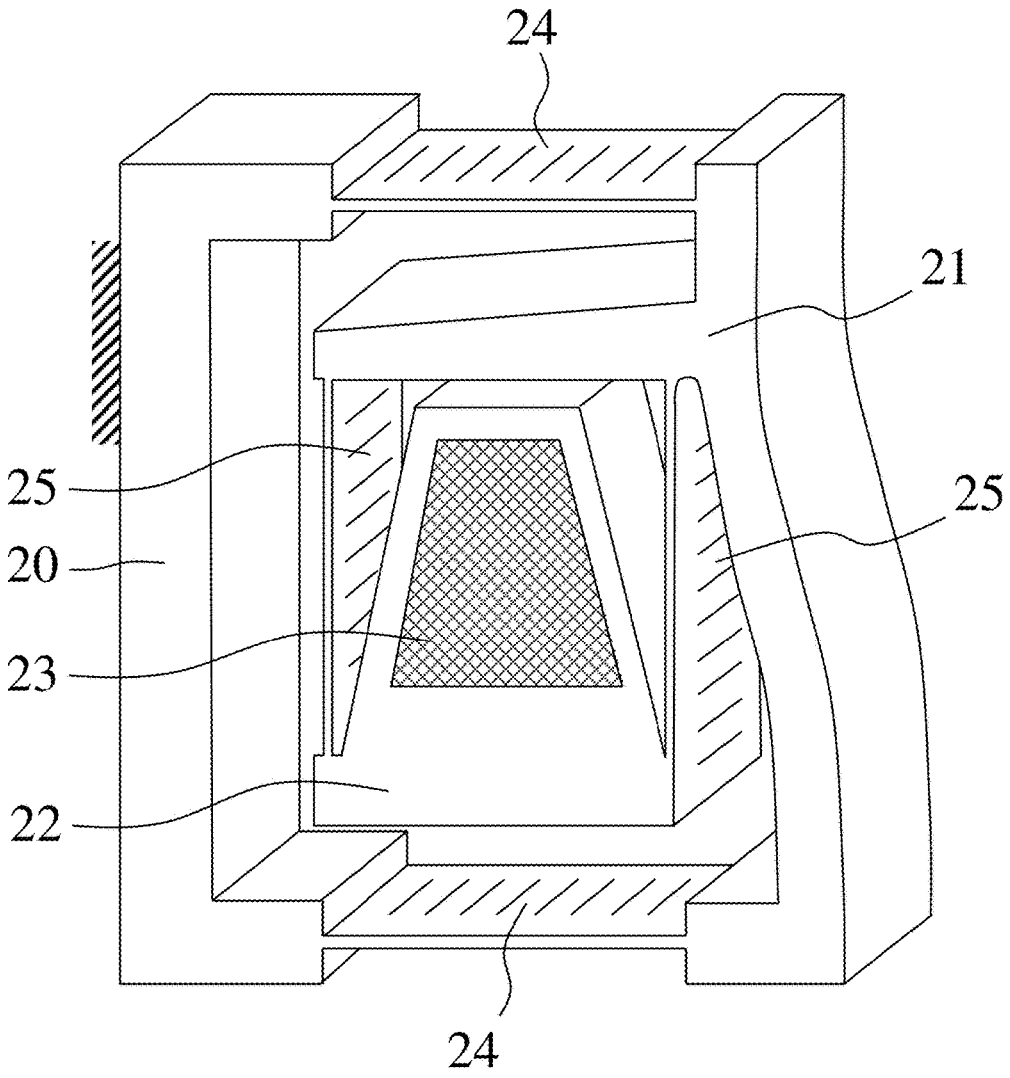
FIG. 19 illustrates a 2 degree of freedom planar isotropic spring construction.

FIG. 19 illustrates an example of such a spring arrangement as a 2 degree of freedom planar isotropic spring construction. In this design, gravity has negligible effect on the planar motion of the orbiting mass when the plane of mechanism is placed horizontally. This provides single direction minimization of gravitational effect. It comprises a fixed base 20, Intermediate block 21, a frame holding the orbiting mass 22, an orbiting mass 23, an y-axis parallel spring stage 24 and an x-axis parallel spring stage 25.

Figure 20:
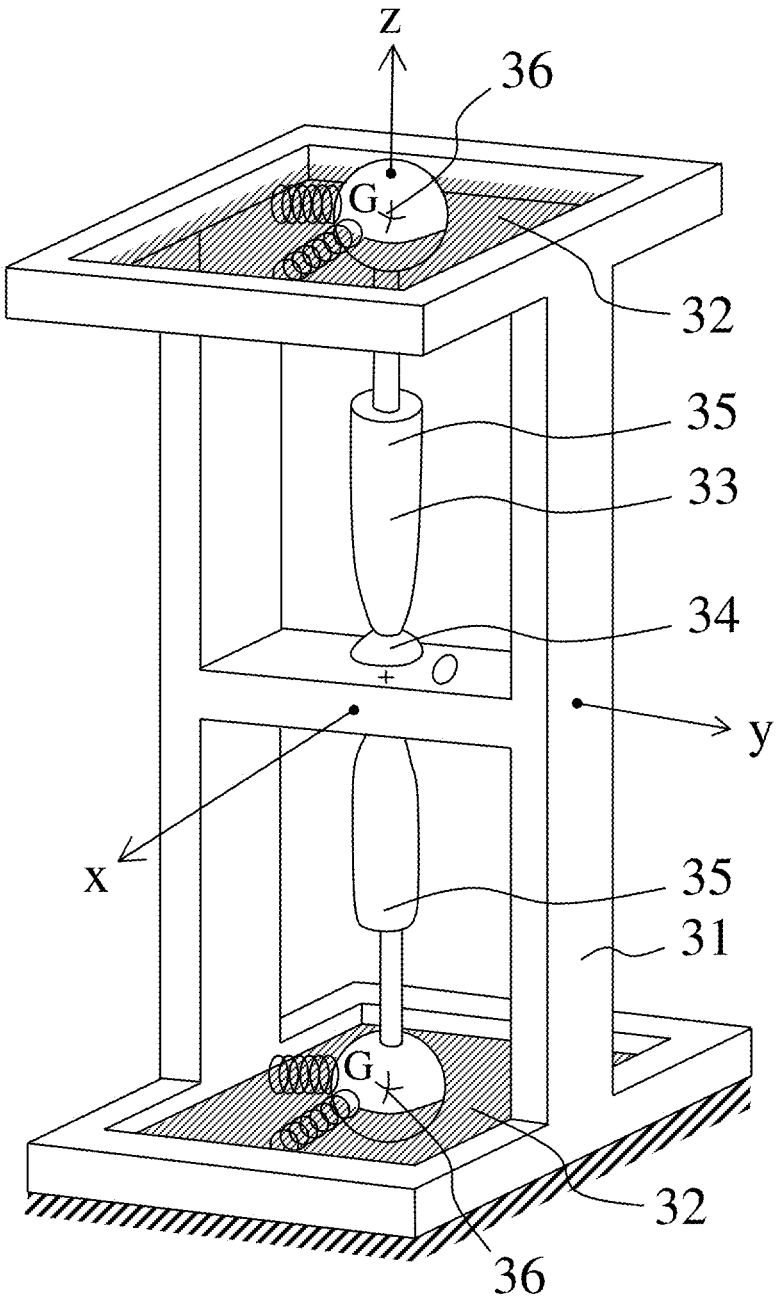
FIG. 20 illustrates gravity compensation in all directions for a planar isotropic spring.

However, this is adequate only for a stationary clock/watch. For a portable timekeeper, compensation is required. This can be achieved by making a copy of the oscillator and connecting both copies through a ball or universal joint as in FIG. 20. In the realization of FIG. 20, the center of gravity of the entire mechanism remains fixed. Specifically, FIG. 20 shows a gravity compensation in all directions for planar isotropic spring. Rigid frame 31 holds time base comprising two linked non-independent planar isotropic oscillators 32 (symbolically represented here). Lever 33 is attached to the frame 31 by a ball joint 34 (or XY universal joint). The two arms of the lever are telescopic thanks to two prismatic joints 35. The opposing ends of the lever 33 are attached to the orbiting masses 36 by ball joints. The mechanism is symmetric with respect to the point 0 at center of joint 34.

5.2 Dynamical Balancing for Linear Acceleration

Linear shocks are a form of linear acceleration, so include gravity as a special case. Thus, the mechanism of FIG. 20 also compensates for linear shocks.

5.3 Dynamical Balancing for Angular Acceleration

Figure 21:
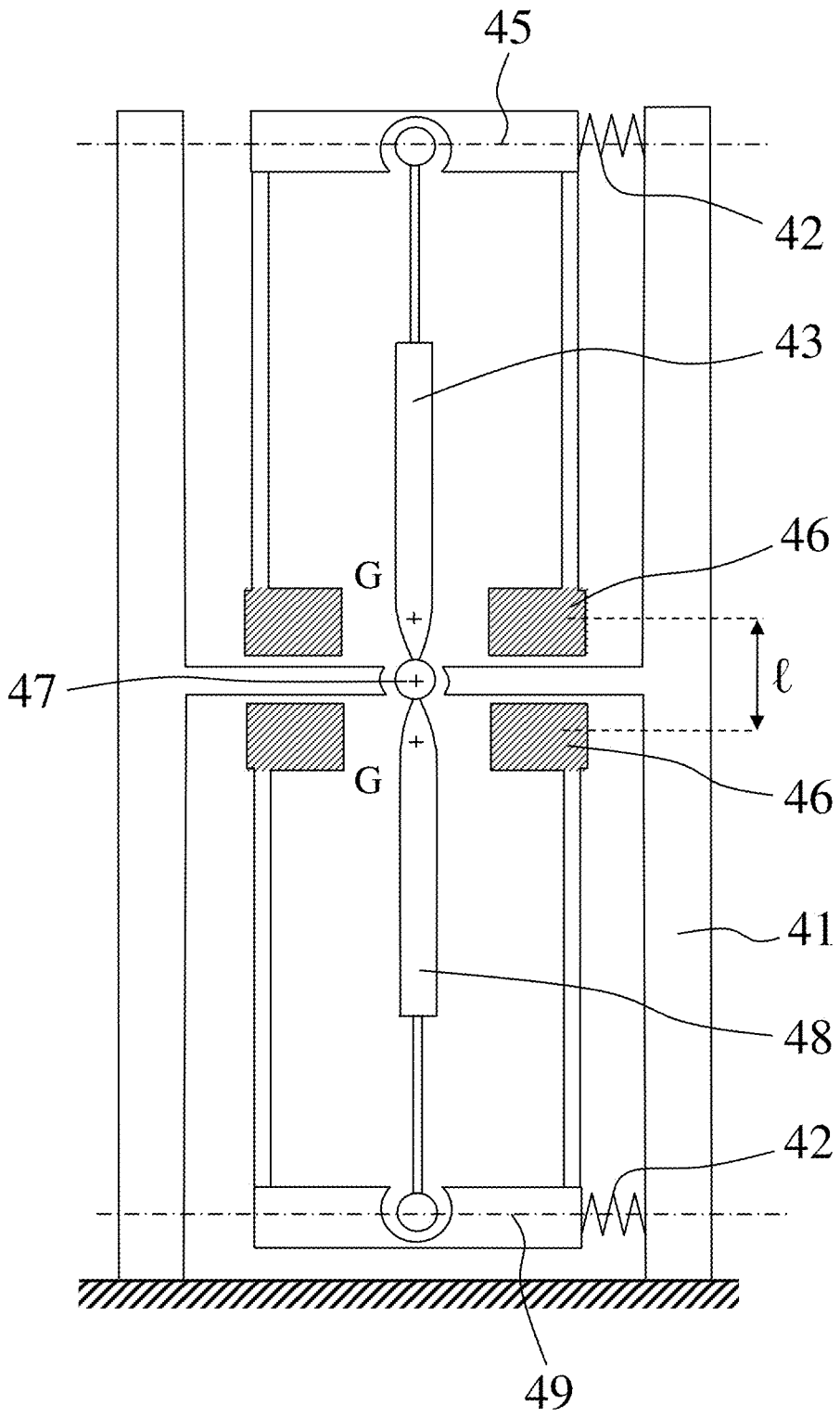
FIG. 21 illustrates gravity compensation in all directions for a planar isotropic spring with added resistance to angular acceleration.

Effects due to angular accelerations can be minimized by reducing the distance between the centers of gravity of the two masses as shown in FIG. 21 by modifying the mechanism of the previous section shown in FIG. 20. Precise adjustment of the distance "I" shown in FIG. 21 separating the two centers of gravity allows for a complete compensation of angular shocks including taking account the moment of inertia of the lever itself. This only takes into account angular accelerations will all possible axes of rotation, except those on the axis of rotation of our oscillators.

Specifically, FIG. 21 illustrates gravity compensation in all directions for planar isotropic spring with added resistance to angular acceleration. This is achieved by minimizing the distance "I" between the center of gravity of the two orbiting masses. Rigid frame 41 holds a time base comprising of two linked non-independent planar isotropic oscillators 42 (symbolically represented here). Lever 43 is attached to the frame 41 by a ball joint 47 (or x-y universal joint). The two arms of the lever 43 are telescopic thanks to two prismatic joints 48. The opposing ends of the lever 43 are attached the orbiting masses 46 by ball joints 49. The mechanism is symmetric with respect to the point O at center of joint 47.

Figure 22:
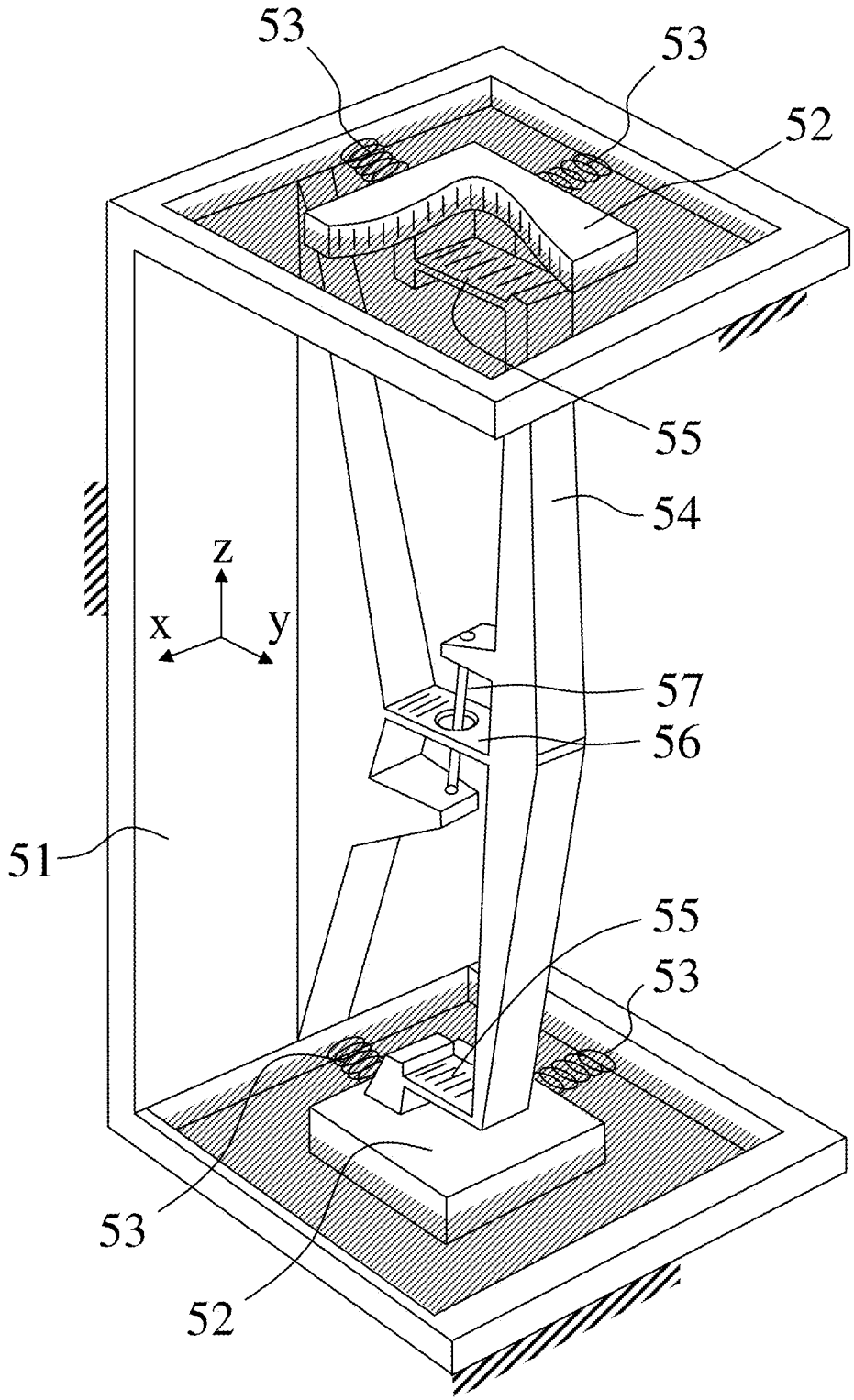
FIG. 22 illustrates a realization of gravity compensation in all directions for a planar isotropic spring using flexures.

FIG. 22 illustrates another embodiment of a Realization of gravity compensation in all directions for a planar isotropic spring using flexures. In this embodiment, a rigid frame 51 holds a time base comprising two linked non-independent planar isotropic oscillators 53 (symbolically represented here). Lever 54 is attached to a frame 52 by x-y a universal joint made of leaf spring 56 and flexible rod 57. The two arms of the lever 54 are telescopic thanks to two leaf springs 55. The opposing ends of the lever 54 are attached the orbiting masses 52 by the two leaf springs 55 which form two x-y universal joints.

Figure 23:
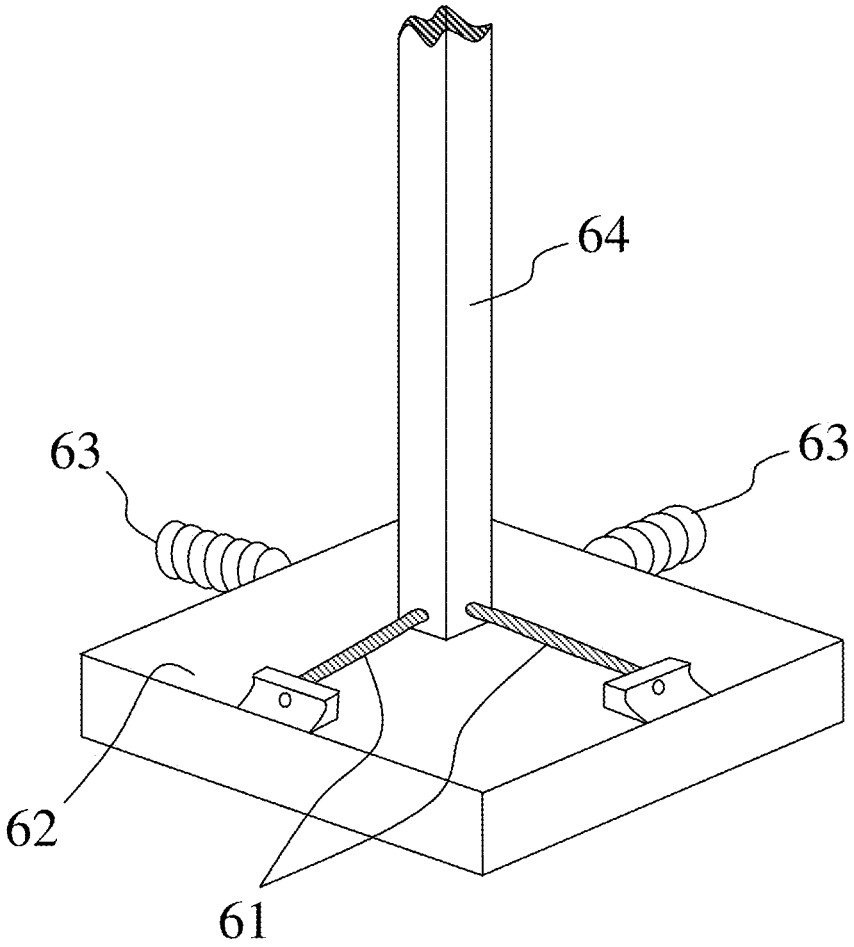
FIG. 23 illustrates an alternate realization of gravity compensation in all directions for a planar isotropic spring using flexures.

FIG. 23 illustrates an alternate realization of gravity compensation in all directions for a planar isotropic spring using flexures. In this variant, both ends of lever 64 are connected to the orbiting masse 62 connected to springs 63 in the oscillator by two perpendicular flexible rods 61.

Figure 24:
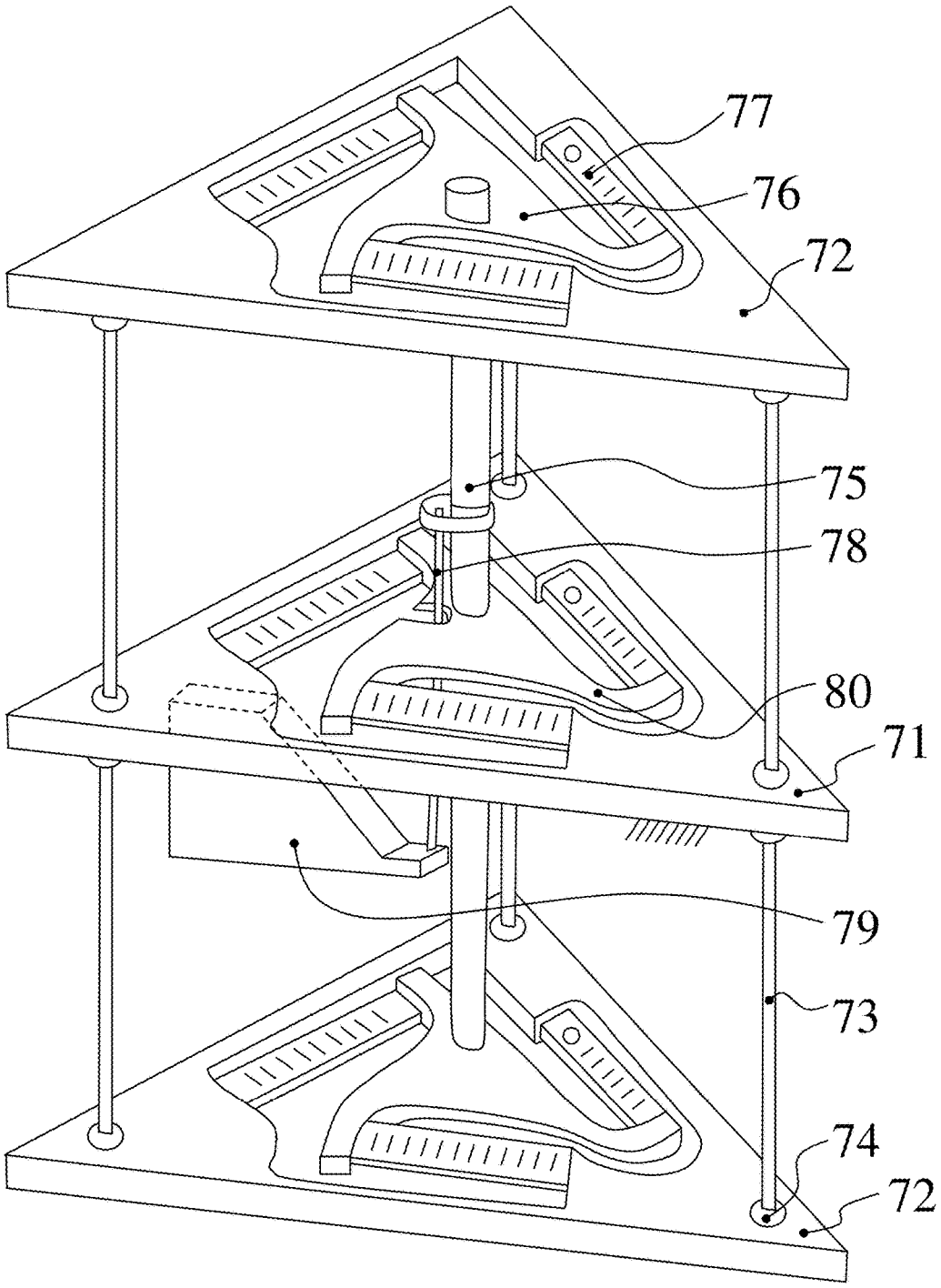
FIG. 24 illustrates a second alternate realization of gravity compensation in all directions for an isotropic spring using flexures.

FIG. 24 illustrates another realization of gravity compensation in all directions for an isotropic spring using flexures. In this embodiment, fixed plate 71 holds time base comprising two linked symmetrically placed non-independent orbiting masses 72. Each orbiting mass 72 is attached to the fixed base by three parallel bars 73, these bars are either flexible rods or rigid bars with a ball joint 74 at each extremity. Lever 75 is attached to the fixed base by a membrane flexure joint (not numbered) and vertical flexible rod 78 thereby forming a universal joint. The extremities of the lever 75 are attached to the orbiting masses 72 via two flexible membranes 77. Part 79 is attached rigidly to part 71. Part 76 and 80 are attached rigidly to the lever 75.

6 Maintaining and Counting

Figure 15:
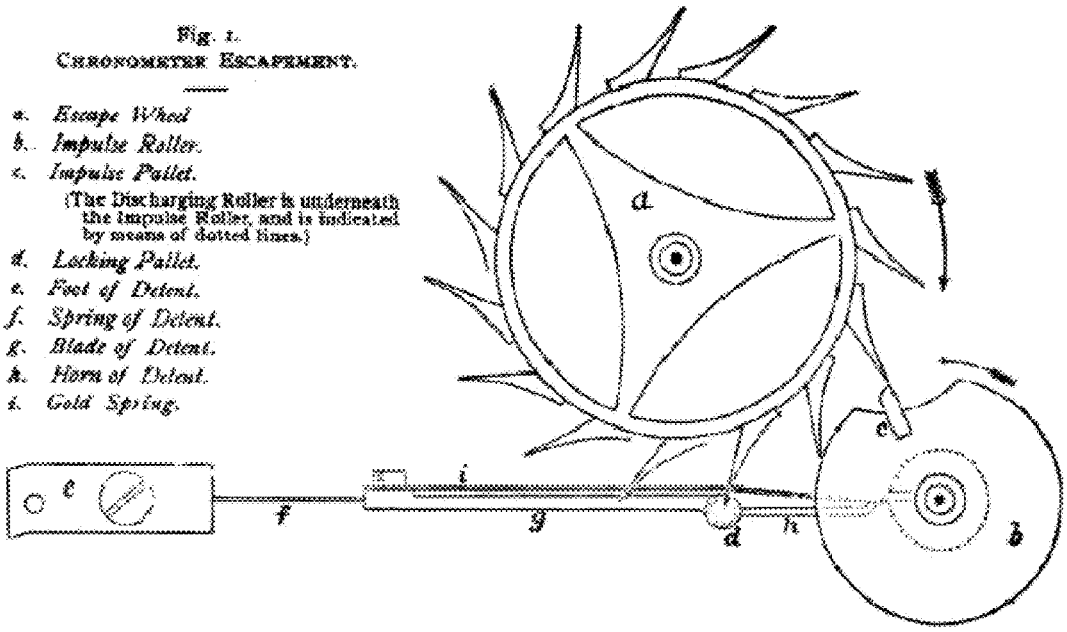
FIG.15 PRIOR ART
FIG. 15 illustrates a classical detent escapement.

Oscillators lose energy due to friction, so there needs a method to maintain oscillator energy. There must also be a method for counting oscillations in order to display the time kept by the oscillator. In mechanical clocks and watches, this has been achieved by the escapement which is the interface between the oscillator and the rest of the timekeeper. The principle of an escapement is illustrated in FIG. 15 and such devices are well known in the watch industry.

In the case of the present invention, two main methods are proposed to achieve this: without an escapement and with a simplified escapement.

6.1 Mechanisms without Escapement

Figure 13:
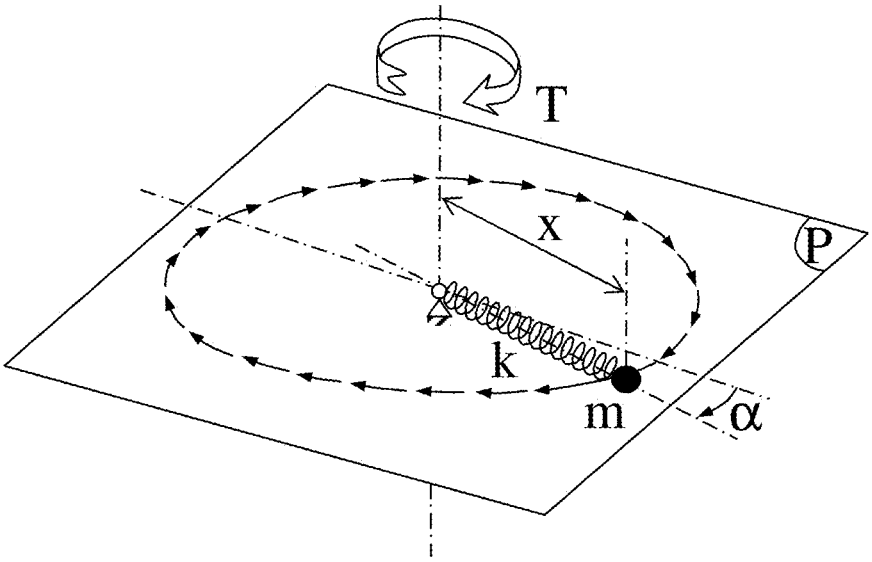
FIG. 13 illustrates the torque applied continuously to maintain oscillator energy.
Figure 14:
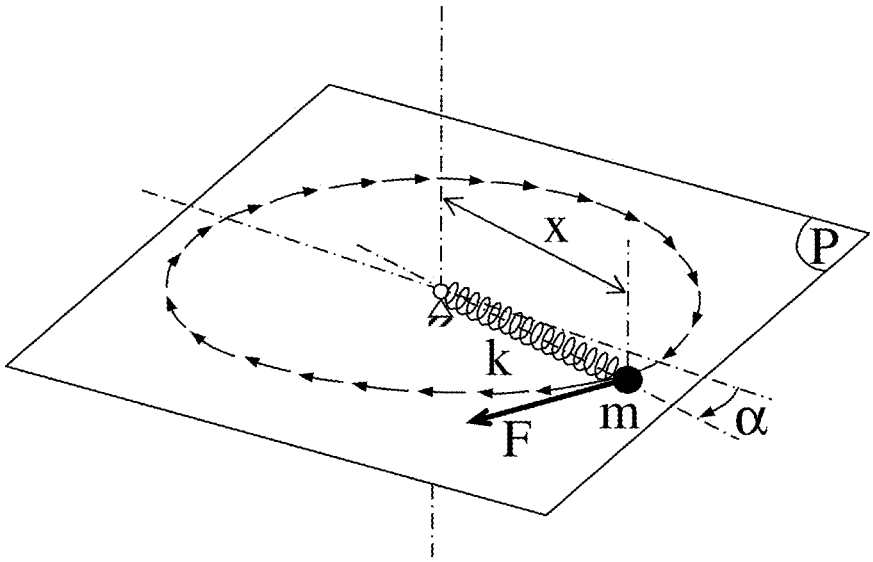
FIG. 14 illustrates a force applied intermittently to maintain oscillator energy.
Figure 37:
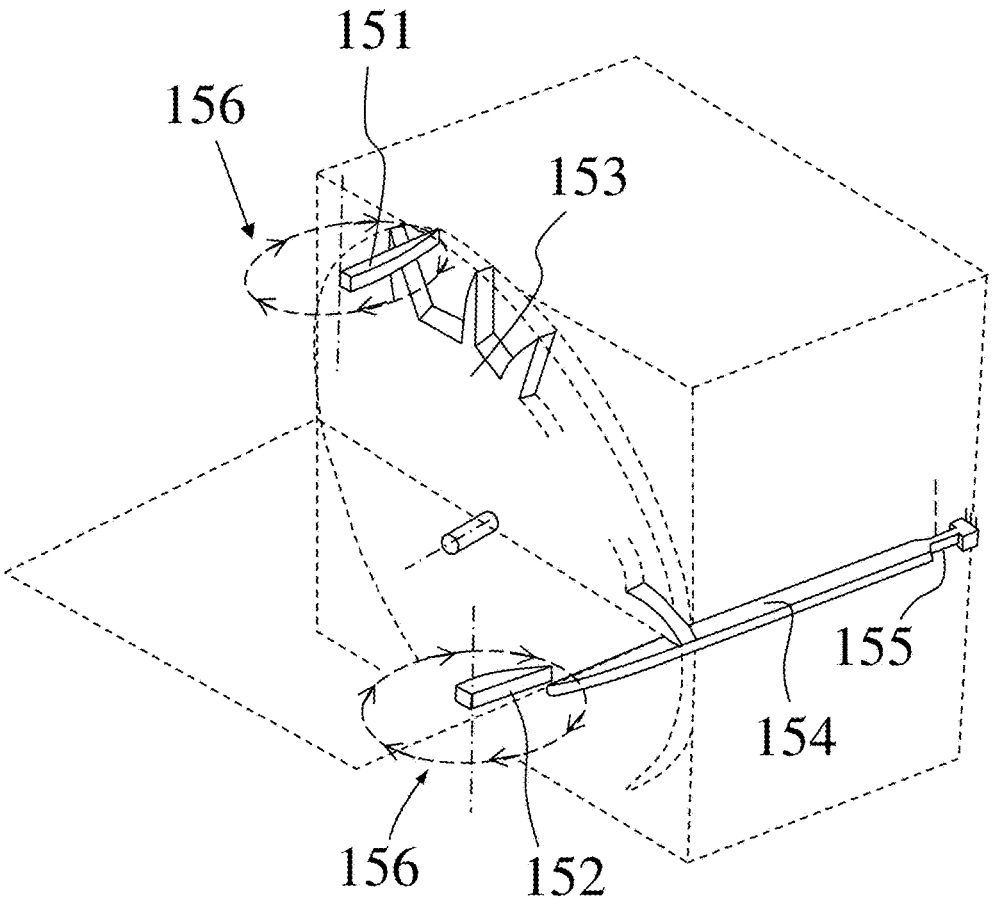
FIG. 37 illustrates an embodiment of a detent escapement for a translational orbiting mass.
Figure 38:
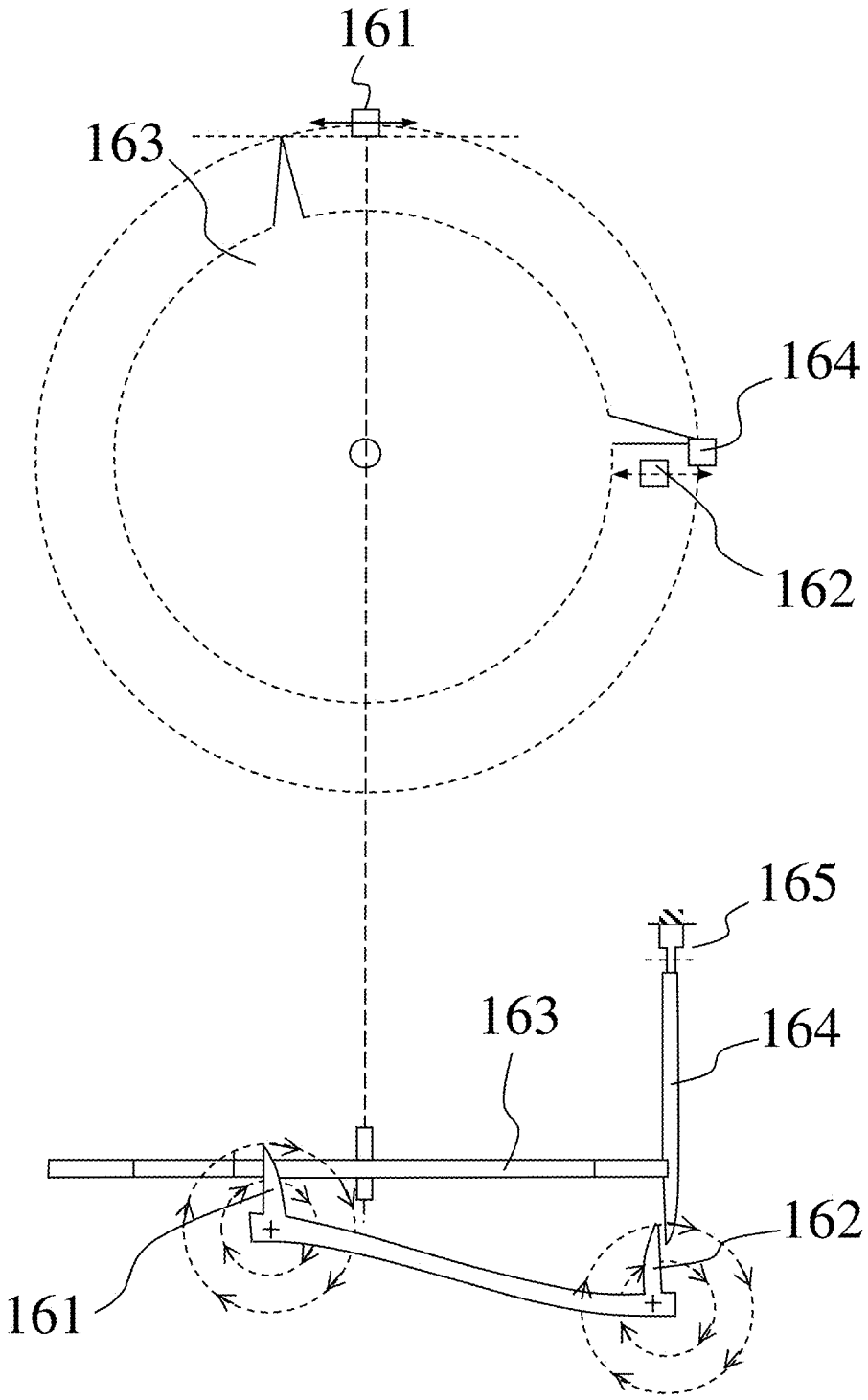
FIG. 38 illustrates another embodiment of a detent escapement for a translational orbiting mass.

In order to maintain energy to the isotropic harmonic oscillator, a torque or a force are applied, see FIG. 13 for the general principle of a torque T applied continuously to maintain the oscillator energy, and FIG. 14 illustrates another principle where a force FT is applied intermittently to maintain the oscillator energy. In practice, in the present case, a mechanism is also required to transfer the suitable torque to the oscillator to maintain the energy, and in FIGS. 25 to 29 various crank embodiments according to the present invention for this purpose are illustrated. FIGS. 37 and 38 illustrate escapement systems for the same purpose. All these restoring energy mechanisms may be used in combination with the various embodiments of oscillators and oscillators systems (stages etc.) described herein, for example in FIGS. 19 to 24, 30 to 35 (as the mechanism 138 illustrated in FIG. 30), and 40 to 48. Typically, in the embodiment of the present invention where the oscillator is used as a time base for a timekeeper, specifically a watch, the torque/force may by applied by the spring of the watch which is used in combination with an escapement as is known in the field of watches. In this embodiment, the known escapement may therefore be replaced by the oscillator of the present invention.

Figure 25:
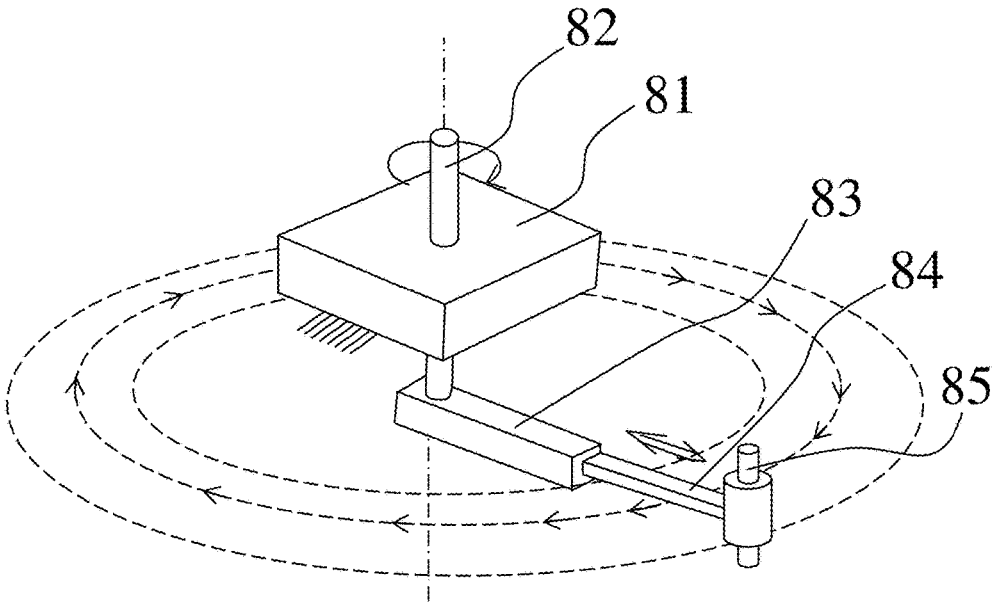
FIG. 25 illustrates a variable radius crank for maintaining oscillator energy.

FIG. 25 illustrates the principle of a variable radius crank for maintaining oscillator energy. Crank 83 rotates about fixed frame 81 through pivot 82. Prismatic joint 84 allows crank extremity to rotate with variable radius. Orbiting mass of time base (not shown) is attached to the crank extremity 84 by pivot 85. Thus the orientation of orbiting mass is left unchanged by crank mechanism and the oscillation energy is maintained by crank 83.

Figure 26:
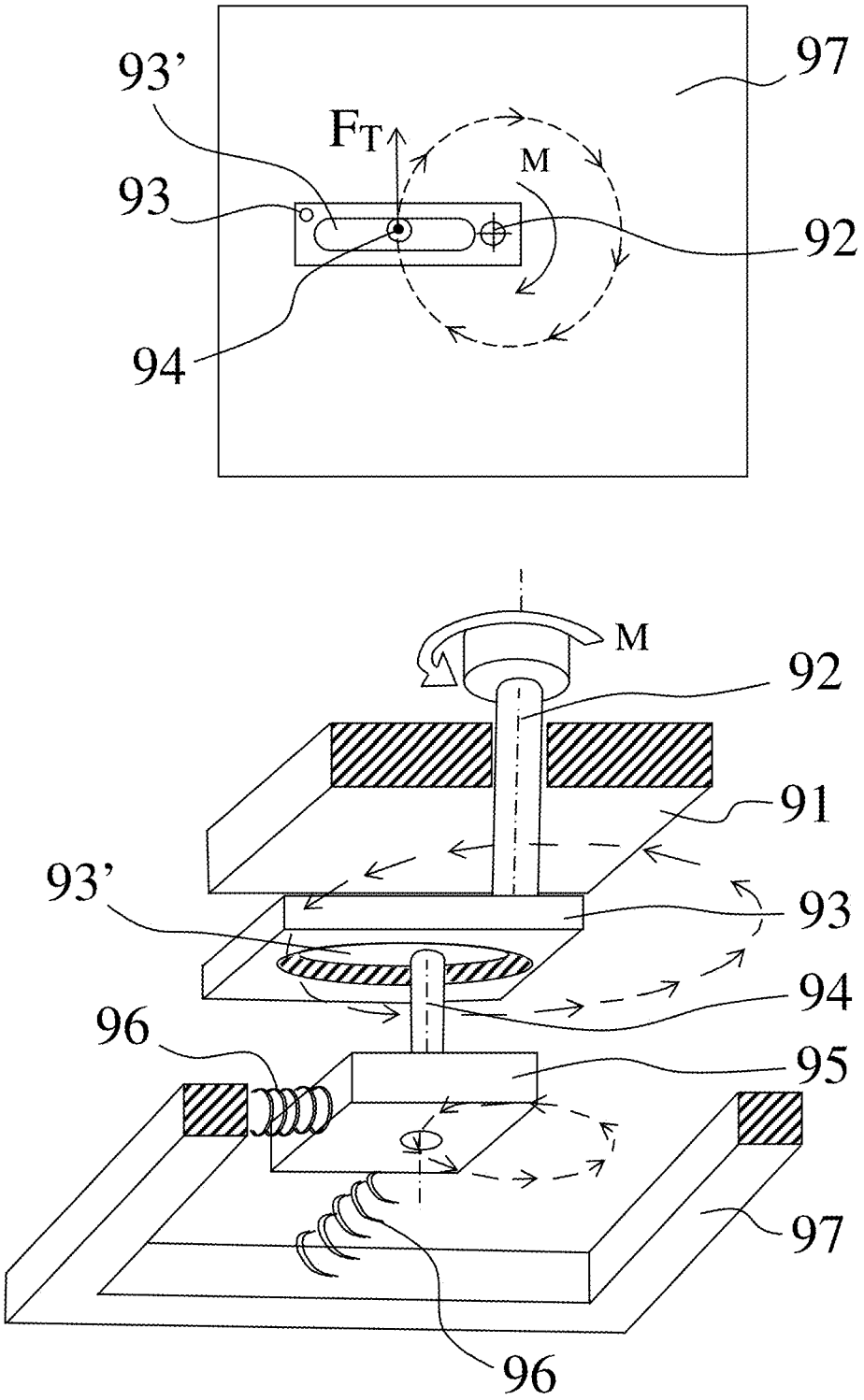
FIG. 26 illustrates a realization of a variable radius crank for maintaining oscillator energy attached to oscillator.

FIG. 26 illustrates a realization of variable radius crank for maintaining oscillator energy attached to the oscillator. A fixed frame 91 holds a crankshaft 92 on which maintaining torque M is applied. Crank 93 is attached to crankshaft 92 and equipped with a prismatic slot 93'. Rigid pin 94 is fixed to the orbiting mass 95 and engages in the slot 93'. The planar isotropic springs are represented by 96. Top view and perspective exploded views are shown in this FIG. 26.

Figure 27:
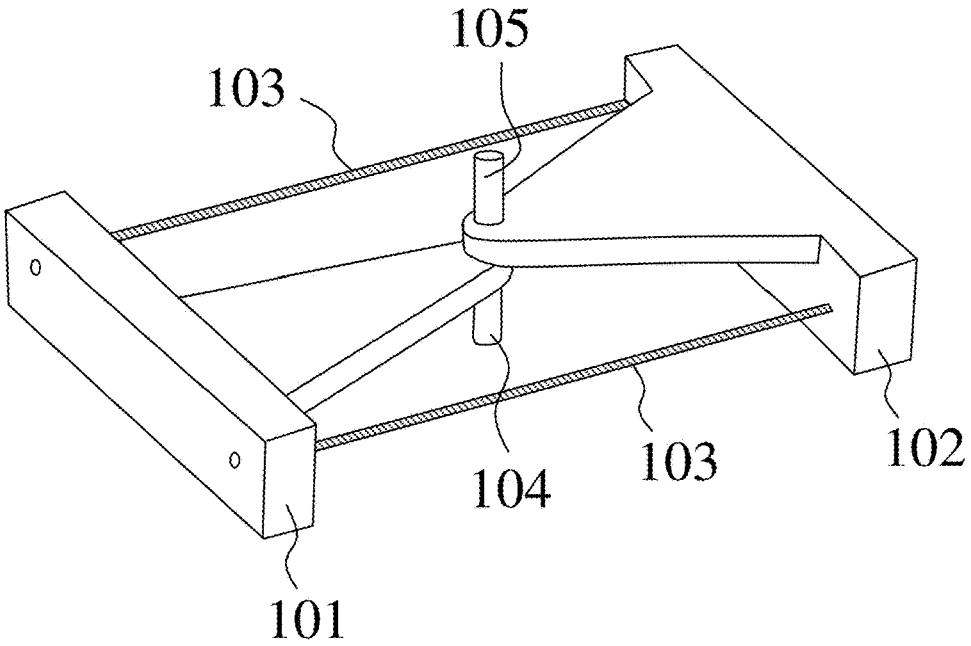
FIG. 27 illustrates a flexure based realization of a variable radius crank for maintaining oscillator energy.

FIG. 27 illustrates a flexure based realization of a variable radius crank for maintaining oscillator energy. Crank 102 rotates about fixed frame (not shown) through shaft 105. Two parallel flexible rods 103 link crank 102 to crank extremity 101. Pivot 104 attaches the mechanism shown in FIG. 27 to an orbiting mass. The mechanism is shown in neutral singular position in this FIG. 27.

Figure 28:
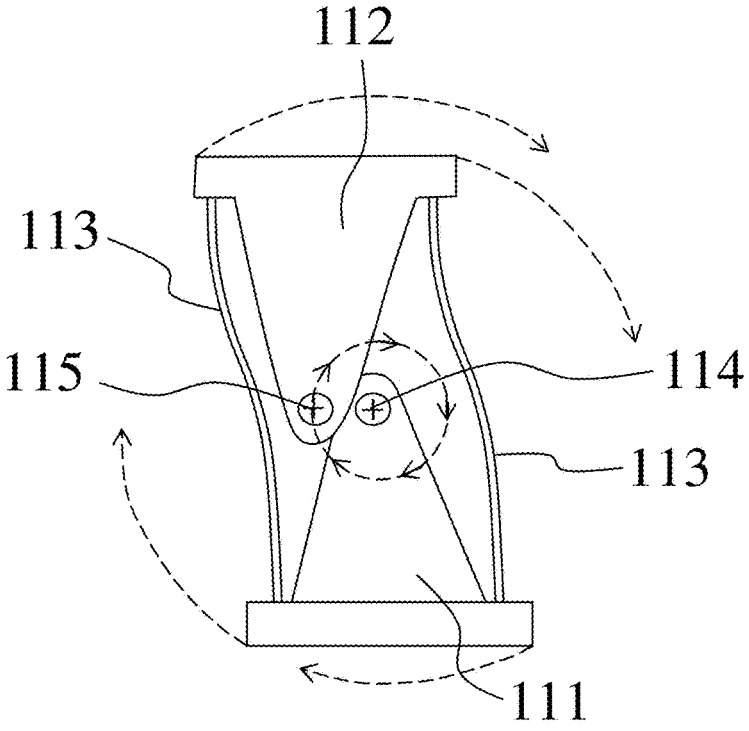
FIG. 28 illustrates a flexure based realization of a variable radius crank for maintaining oscillator energy.

FIG. 28 illustrates another embodiment of a flexure based realization of variable radius crank for maintaining oscillator energy. Crank 112 rotates about fixed frame (not shown) through shaft 115. Two parallel flexible rods 113 link crank 112 to crank extremity 111. Pivot 114 attaches mechanism shown to orbiting mass. Mechanism is shown in flexed position in this FIG. 28.

Figure 29:
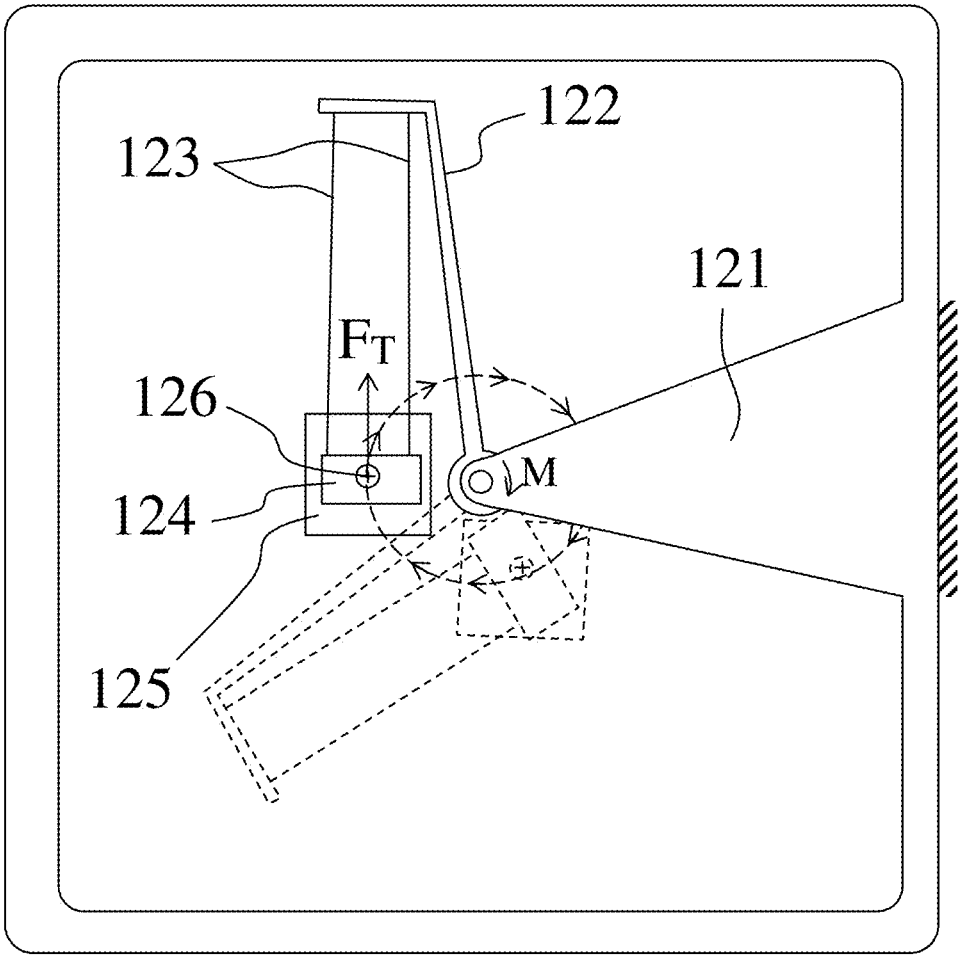
FIG. 29 illustrates an alternate flexure based realization of a variable radius crank for maintaining oscillator energy.

FIG. 29 illustrates an alternate flexure based realization of variable radius crank for maintaining oscillator energy. Crank 122 rotates about fixed frame 121 through shaft. Two parallel flexible rods 123 link crank 122 to crank extremity 124. Pivot 126 attaches mechanism to orbiting mass 125. In this arrangement the flexible rods 123 are minimally flexed for average orbit radius.

Figure 30:
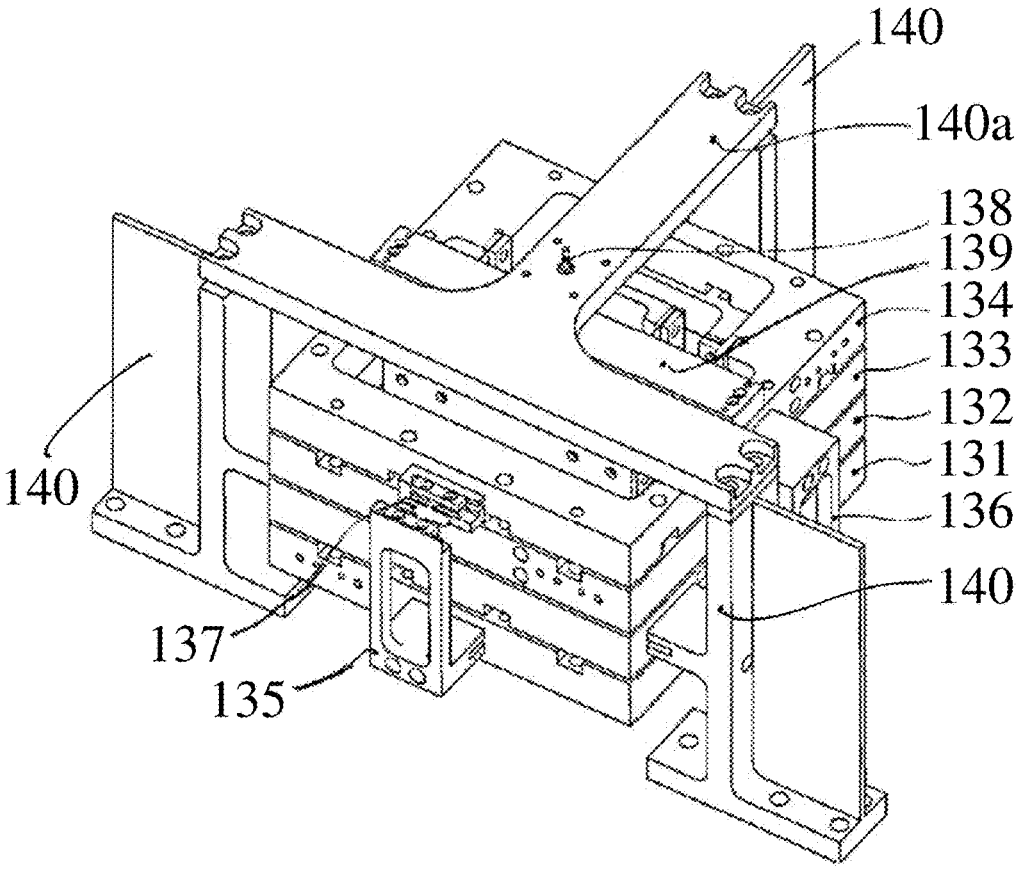
FIG. 30 illustrates an example of a complete assembled isotropic oscillator.

FIG. 30 illustrates an example of a completely assembled isotropic oscillator 131-137 and its energy maintaining mechanism. More specifically, a fixed frame 131 is attached to the ground or to a fixed reference (for example the object on or in which the oscillator is mounted) by three rigid feet 140 and top frame 140*a*. First compound parallel spring stage 131 holds second parallel spring stage 132 moving orthogonally to said spring stage 131. Compound parallel spring 132 is attached rigidly to stage 131. Fourth compound parallel spring stage 134 holds third parallel spring stage 133 moving orthogonally to spring stage 134. Outer frames of stages 133 and 134 are connected kinematically in the x and y directions by L-shaped brackets 135 and 136 as well as by notched leaf springs 137. The two outer frames of stages 133 and 134 constitute the orbiting mass of the oscillator while stages 132-133 are attached together and fixed to feet 140 and the orbiting mass moves therefore relatively to stages 132-133. Alternatively, the moving mass may be formed by stages 132-133 and in that case the stages 131 and 134 are fixed to the feet 140.

Bracket 139 mounted on the orbiting mass holds the rigid pin 138 (illustrated in FIGS. 30 and 31) on which the maintaining force is applied for example a torque or a force, by means identical or equivalent to the ones described above with reference to FIGS. 25-29.

Each stage 131-134 may be for example made as illustrated in FIG. 19 or in FIGS. 42 to 47 discussed later herein in more details. Accordingly, the description of these figures applies to the stages 131-134 illustrated in these FIGS. 30-35. As will be described hereunder, to compensate, the stages 131 and 132 (respectively 133 and 134) are identical but placed with a relative rotation (in particular of 90°) to form the XY planar isotropic springs discussed herein.

Figure 31:
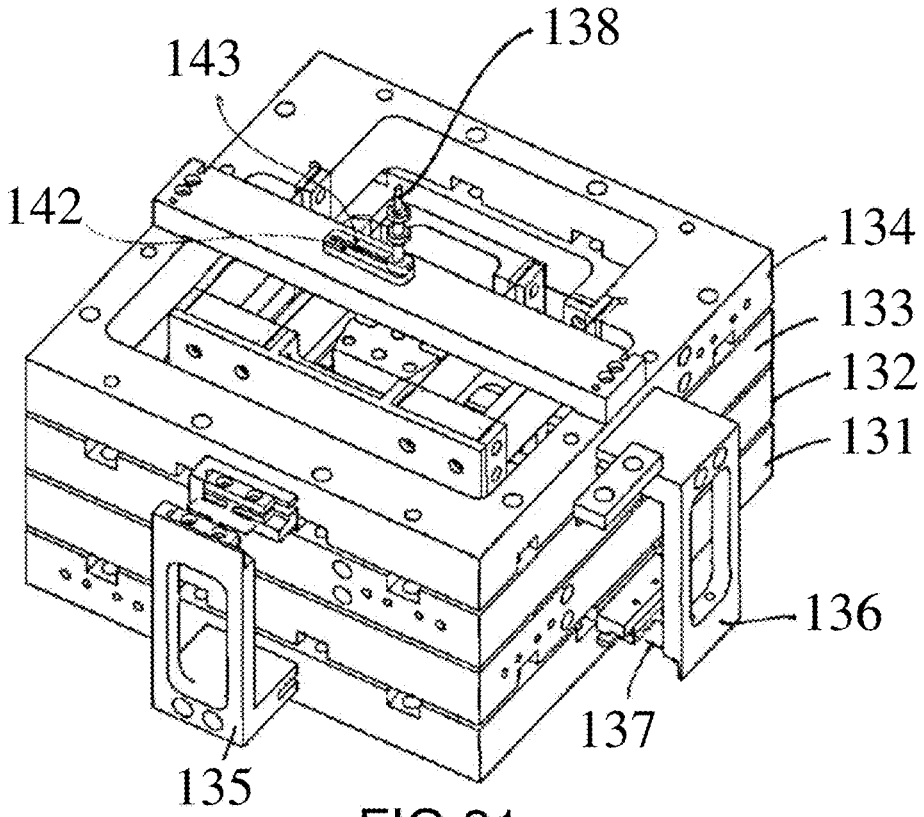
FIG. 31 illustrates a partial view of the oscillator of FIG. 30.

FIG. 31 shows the same embodiment of FIG. 30, and shows the rigid pin 138 mounted rigidly on the orbiting masses (stages 134 and 131, for example as mentioned hereabove) and engages into slot 142 which acts as the driving crank and maintains the oscillation. The other parts are numbered as in FIG. 30 and the description of this figure applies correspondingly. The crank system used may be the one illustrated in FIGS. 25-29 and described hereabove.

Figure 32:
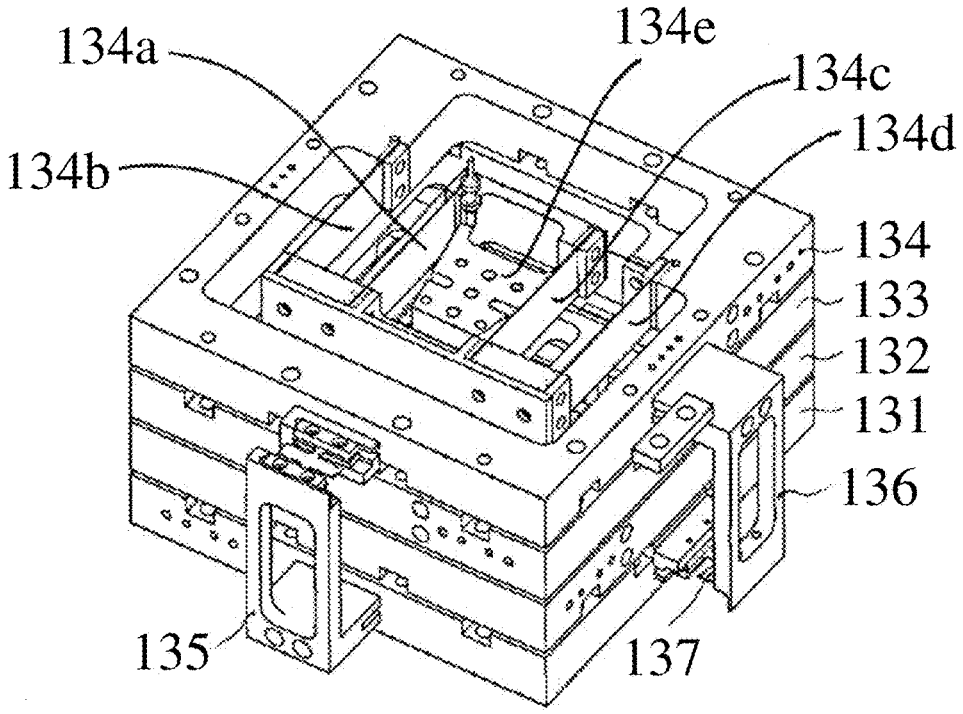
FIG. 32 illustrates another partial view of the oscillator of FIG. 31.

FIG. 32 illustrates the stages 131-134 of the embodiment of FIGS. 30 and 31 without crank system 142-143 and using the reference numbers of FIG. 30.

Figure 33:
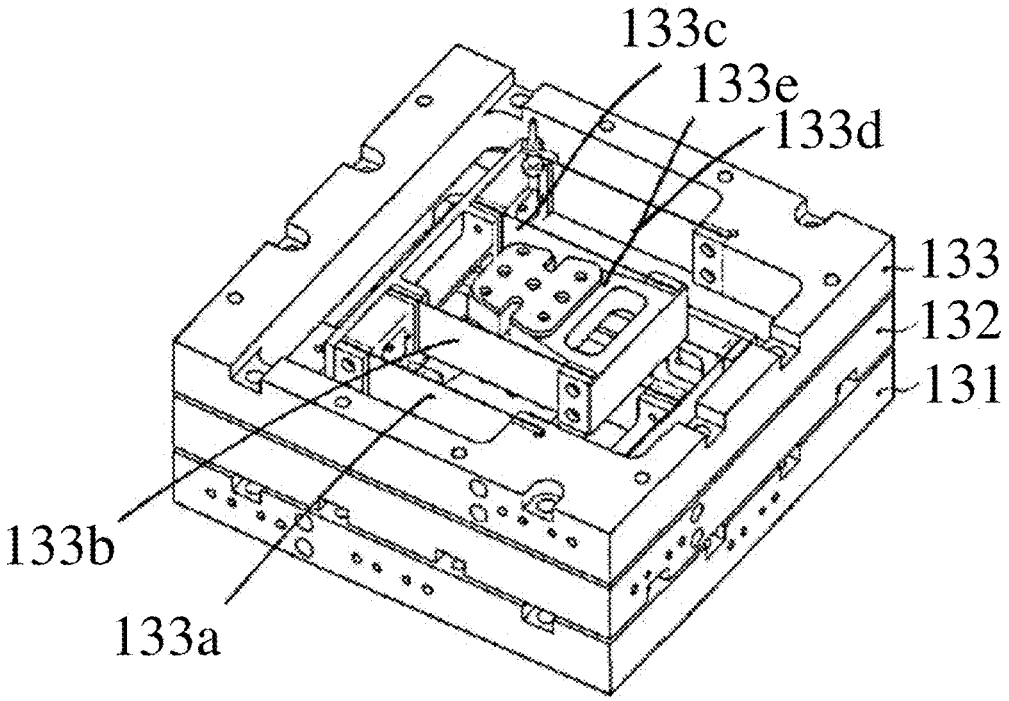
FIG. 33 illustrates a partial view of the mechanism of FIG. 32.

FIG. 33 illustrates the stages 131-133 of the embodiment of FIG. 32 without stage 134 and using the reference numbers of FIG. 30.

Figure 34:
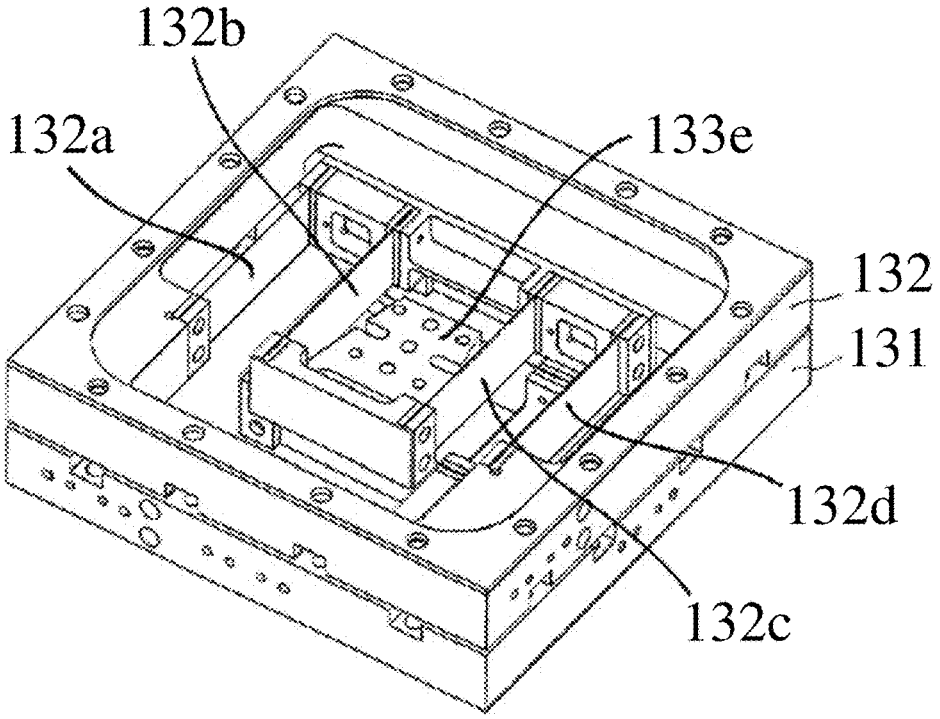
FIG. 34 illustrates a partial view of the mechanism of FIG. 33.

FIG. 34 illustrates the stages 131-132 of the embodiment of FIG. 33 without stage 3 using the reference numbers of FIG. 30.

Figure 35:
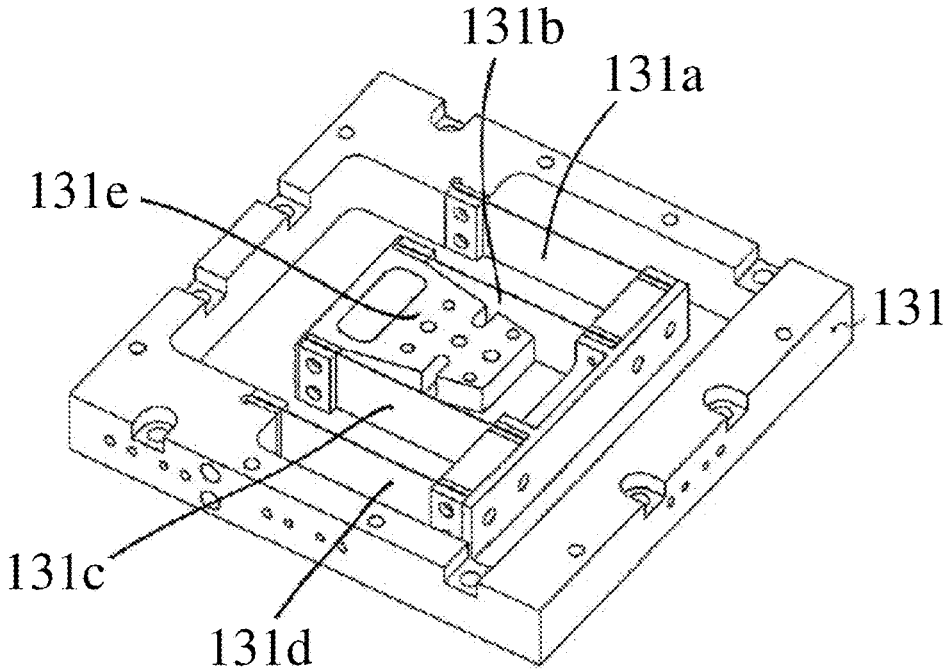
FIG. 35 illustrates a partial view of the mechanism of FIG. 34.

FIG. 35 illustrates the stage 131 of FIG. 34 without stage 132 using the reference numbers of FIG. 30.

Typically, each stage 131-134 may be made in accordance with the embodiments described later in the present specification in reference to FIGS. 41-48. Indeed, stage 131 of FIG. 35 comprises parallel springs 131*a* to 131*d* which hold a mass 131*e* and the springs and masses of said FIGS. 41-48 may correspond to the ones of FIGS. 30-35.

To construct the oscillator of FIG. 30, as mentioned above, stages 131 and 132 are placed with a relative rotation of 90° between them, and their mass 131*e*-132*e* are attached together (see FIG. 34). This provides a construction equivalent to the one of FIG. 43 described later with two parallel springs in each direction XY.

Stages 133 and 134 are attached as stages 131-132 and placed in a mirror configuration over stages 131-132, stage 133 comprising as stages 131 and 132 springs 133*a*-133*d* and a mass 133*e*. The position of stage 133 rotated by 90° with respect to stage 132 as one can see in FIG. 33. The frames of stages 132 and 133 are attached together such that they will not move relatively one to another.

Then, as illustrated in FIG. 32, fourth stage 134 is added with a 90° relative rotation with respect to stage 133. Stage 134 also comprise springs 134*a*-134*d* and mass 134*e*. Mass 134*e* is attached to mass 133*e* and the two stages 134 and 131 a linked together via brackets 135, 136 to form the orbiting mass while stages 132 and 133 which are attached together are fixed to the frame 140, 140*a*.

As illustrated in FIG. 31, the mechanism for applying a maintaining force or torque is placed on top of the stages 131-134 and comprises the pin 138 and the crank system 142, 143 which for example the system described in FIG. 26, the pin 92 of FIG. 26 corresponding to pin 138 of FIG. 31, the crank 93 corresponding to crank 142 and slot 93' to slot 143.

Of course, the stages 131-134 of FIGS. 30-34 may be replaced by other equivalent stages having the XY planar isotropy in accordance with the principle of the invention, for example, one may use the configurations and exemplary embodiments of FIGS. 40 to 48 to realize the oscillator of the present invention.

6.2 Generalized Coordinate Isotropic Harmonic Oscillators

The XY isotropic harmonic oscillators of the previous section can be generalized by replacing X translation and Y translation by other motions, in particular, rotation. When expressed as generalized coordinates in Lagrangian mechanics, the theory is identical and the mechanisms will have the same isotropic harmonic properties as the translational XY mechanisms.

Figure 51:
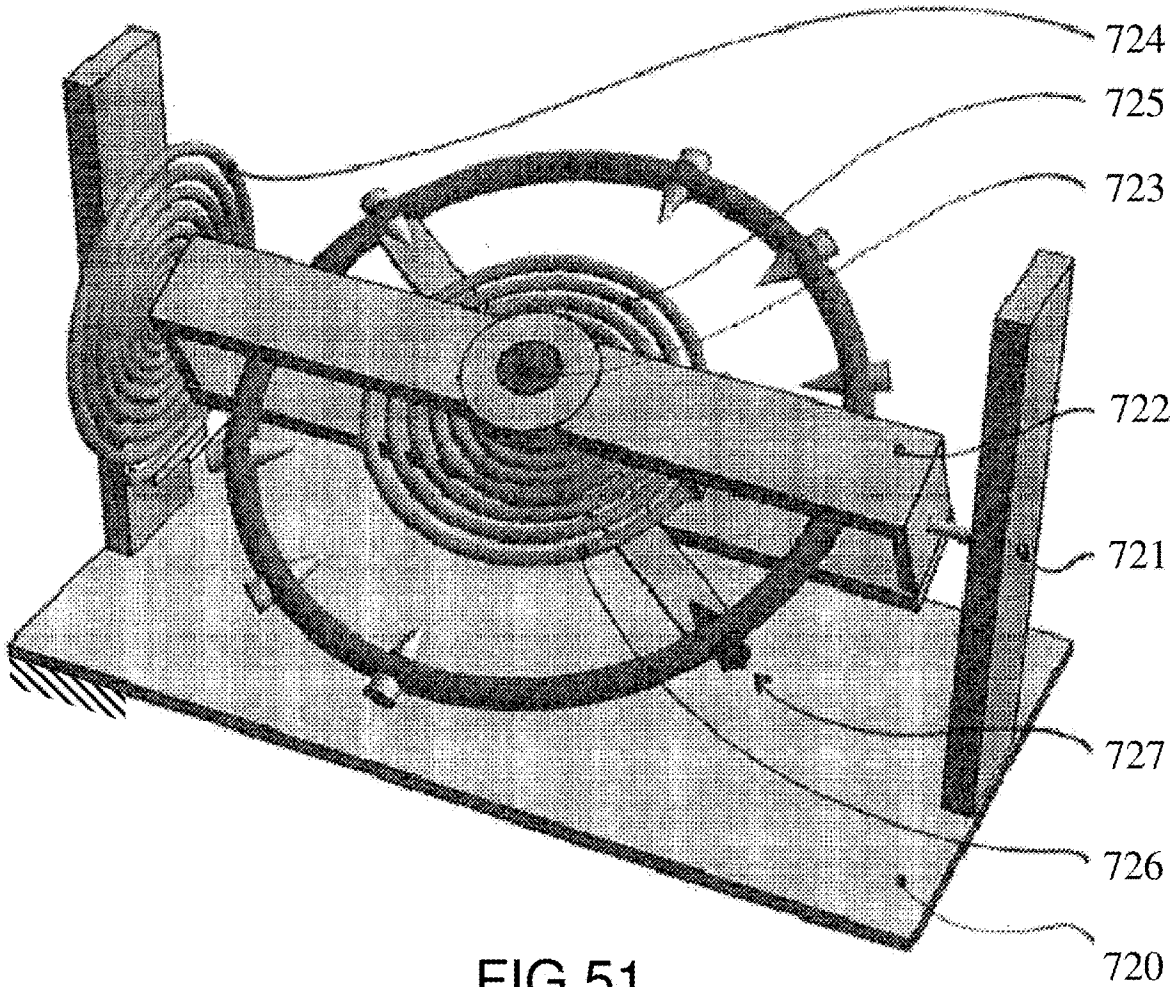
FIG. 51 illustrates an embodiment of an XY isotropic harmonic oscillator with generalized coordinates X a rotation and Y a rotation.
Figure 52:
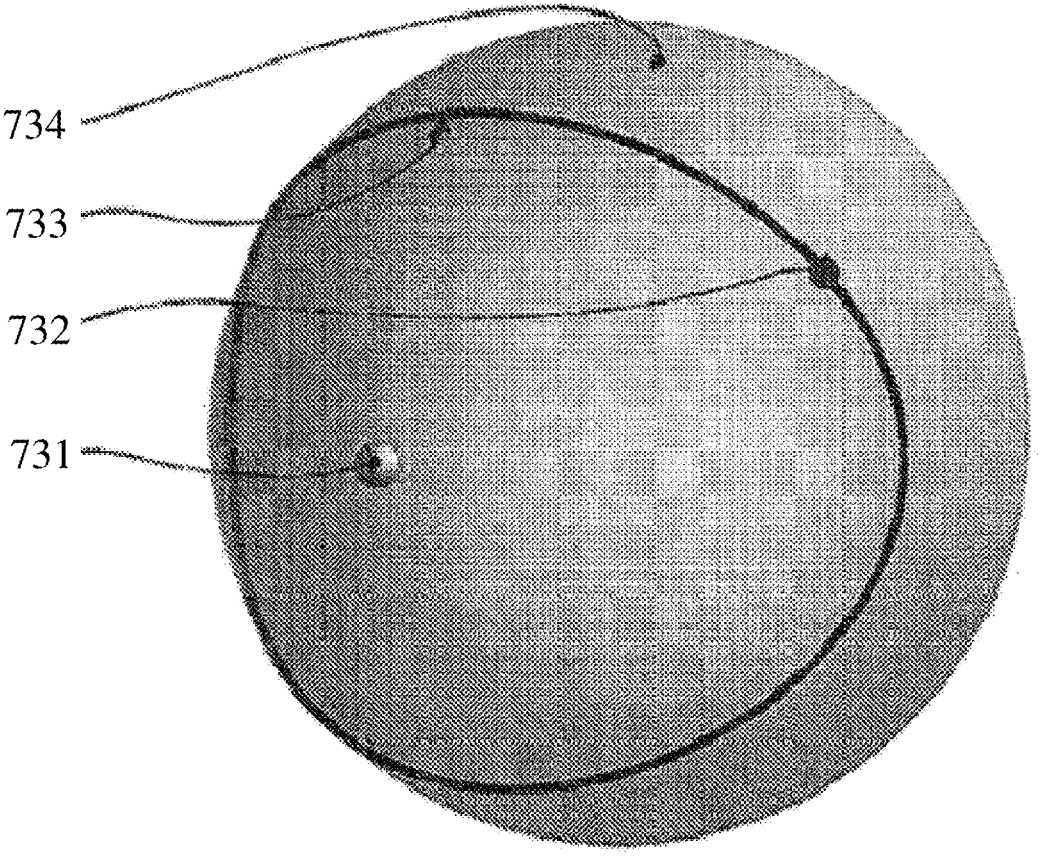
FIG. 52 illustrates the spherical path of the impulse pin of an XY isotropic harmonic oscillator with generalized coordinates X a rotation and Y a rotation.

FIG. 51 shows an XY isotropic harmonic oscillator with generalized coordinates X a rotation and Y a rotation: On the fixed base 720 are attached two immobile beams 721 which support a rotating cage 722 via jewelled bearings at 721 and a spiral spring 724. Inside the cage 722 is a balance wheel allowed to rotate and attached via a balance staff (not shown) which rotates on jewelled bearings 723. To the balance wheel is attached a spiral spring 726 which provides a restoring force to the circular oscillation of the balance wheel around its axis. The spiral spring provides a restoring force to the rotation of the cage 722 around its neutral position where the balance wheel axis is perpendicular to the base 720. The moment of inertia of the balance wheel assembly including the cage is such that the natural frequencies of the balance wheel and spring 725 is the same as that of the cage and balance wheel and spring 724. The oscillations of the balance wheel model the isotropic harmonic oscillator and for small amplitudes of oscillations the mass 727 on the balance wheel moves in a unidirectional orbit approximating an ellipse as shown in FIG. 52. This mechanism has the advantage of being insensitive to linear acceleration and gravity, as opposed to the standard translational XY isotropic oscillator. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | Yes | Yes | No |

FIG. 52 shows that a pin placed on the balance wheel in FIG. 51 has a roughly elliptical orbit on a sphere, allowing this mechanism to be maintained by a rotating crank as with the XY translational isotropic harmonic oscillators. The figure describes the motion of the mass 727 of FIG. 51 as the balance and cage oscillate. The sphere 734 represents the space of all possible positions of the mass 727 for arbitrarily large oscillations of the balance wheel and cage. Shown in the figure is the situation for a small oscillation in which the mass 732 moves along a periodic orbit 733 around its neutral point 731. The angular motion of the mass 732 is always in the same angular direction and does not stop.

Figure 53:
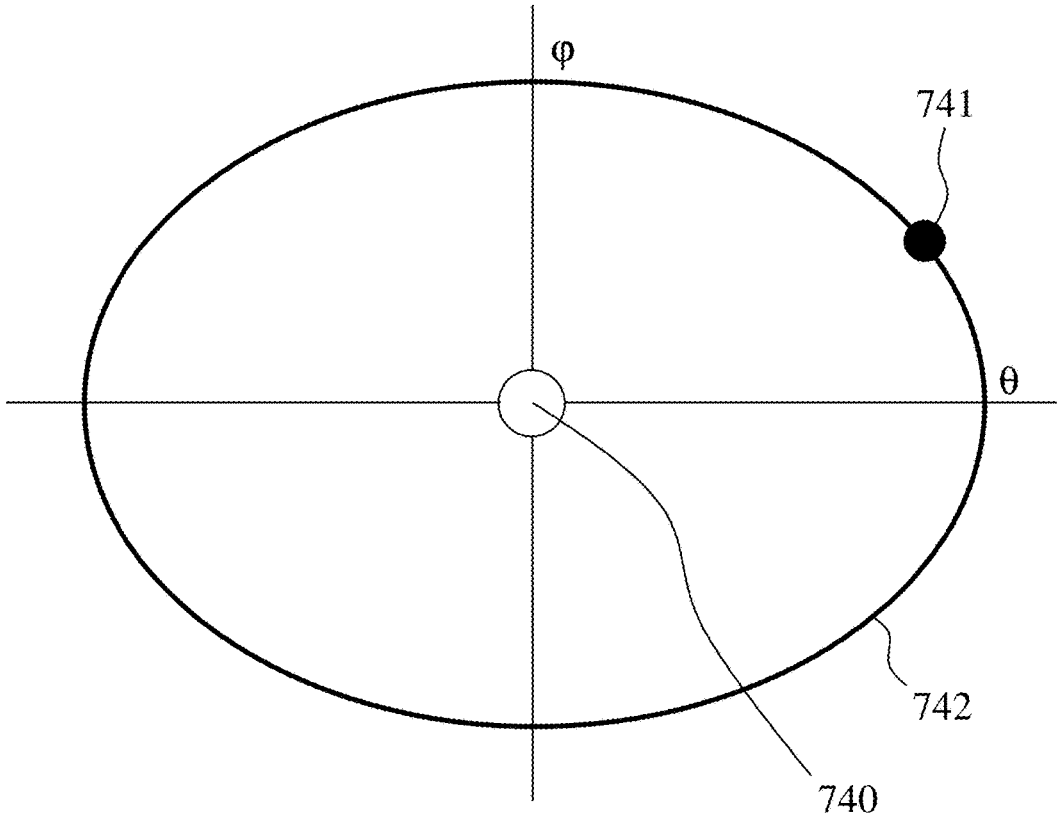
FIG. 53 illustrates the elliptical path of the impulse pin in planar coordinates for the XY isotropic harmonic oscillator with generalized coordinates X a rotation and Y a rotation.

FIG. 53 shows that if the X and Y angles are graphed on a plane, then the same elliptical orbit is recovered as in the X and Y translational case. The figure describes the angular parameters of the mechanism of FIG. 51. The mass 741 represents the mass 727 of FIG. 51. The angle theta represents the angle of rotation of the balance wheel of FIG. 53 around its axis, with respect to its neutral position and the angle phi represents the angle of rotation of the cage 722 of FIG. 53 around its axis, with respect to its neutral position. In the theta-phi coordinate system, the mass 741 moves in the periodic orbit 742 around its neutral point 740. The orbit 742 is a perfect ellipse and following Newton's result, all such orbits will have the same period.

Figure 54:
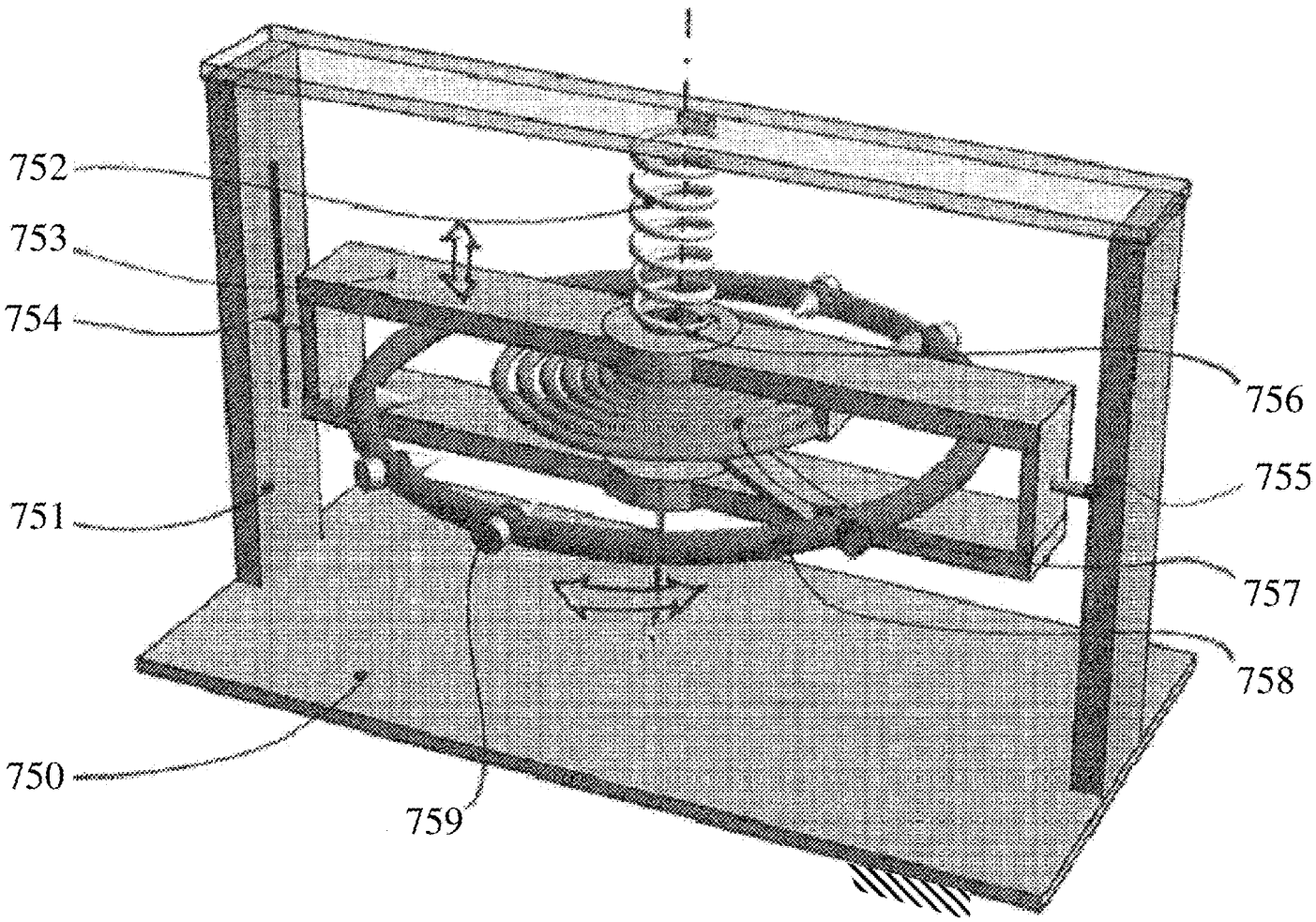
FIG. 54 illustrates an embodiment of an XY isotropic harmonic oscillator with generalized coordinates X a translation and Y a rotation.

FIG. 54 shows and XY isotropic harmonic oscillator with X a translation and Y a rotation. It can be seen that a pin on the balance wheel has a roughly elliptical orbit, so this mechanism can be maintained by a rotating crank as with the XY translational isotropic harmonic oscillators. To the fixed base 750 are attached two vertical immobile beams 751. At the top of the two beams 751 is a horizontal beam (transparent here), to which is attached a collet holding a cylindrical spring 756. The bottom of the cylindrical spring 756 is attached via a collet to the cage 753, allowing the cage to translate vertically via two grooves 754 on each of the vertical posts 751, the grooves hold the cage axes 755. The cylindrical spring 756 provides a linear restoring force to produce translational oscillation of the cage. The cage 754 contains a spiral spring 757 attached to a balance wheel 758. The spiral spring provides a restoring torque to the balance wheel which causes it to have a isotropic oscillation. The frequency of the translational oscillation of the cage 753 is designed to equal the frequency of the angular oscillation of the balance wheel 758, for small amplitudes the balance weights 759 move in a unidirectional rotation approximating an ellipse. If x represent the vertical displacement of the cage with respect to its neutral point and theta the angle of the balance wheel with respect to its neutral angle, then x, theta represent generalised coordinates of the mechanism's state and describe an ellipse in state space, as shown in FIG. 52 with x replacing phi. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | no | No | No |

6.3 Simplified Escapements

The advantage of using an escapement is that the oscillator will not be continuously in contact with the energy source (via the gear train) which can be a source of chronometric error. The escapements will therefore be free escapements in which the oscillator is left to vibrate without disturbance from the escapement for a significant portion of its oscillation.

The escapements are simplified compared to balance wheel escapements since the oscillator is turning in a single direction. Since a balance wheel has a back and forth motion, watch escapements generally require a lever in order to impulse in one of the two directions.

The first watch escapement which directly applies to our oscillator is the chronometer or detent escapement [6, 224-233]. This escapement can be applied in either spring detent or pivoted detent form without any modification other than eliminating passing spring whose function occurs during the opposite rotation of the ordinary watch balance wheel, see [6, FIG. 471c]. For example, in FIG. 4 illustrating the classical detent escapement, the entire mechanism is retained except for Gold Spring i whose function is no longer required.

H. Bouasse describes a detent escapement for the conical pendulum [3, 247-248] with similarities to the one presented here. However, Bouasse considers that it is a mistake to apply intermittent impulse to the conical pendulum. This could be related to his assumption that the conical pendulum should always operate at constant speed, as explained above.

6.4 Improvement of the Detent Escapement for the Isotropic Harmonic Oscillator

Figure 36:
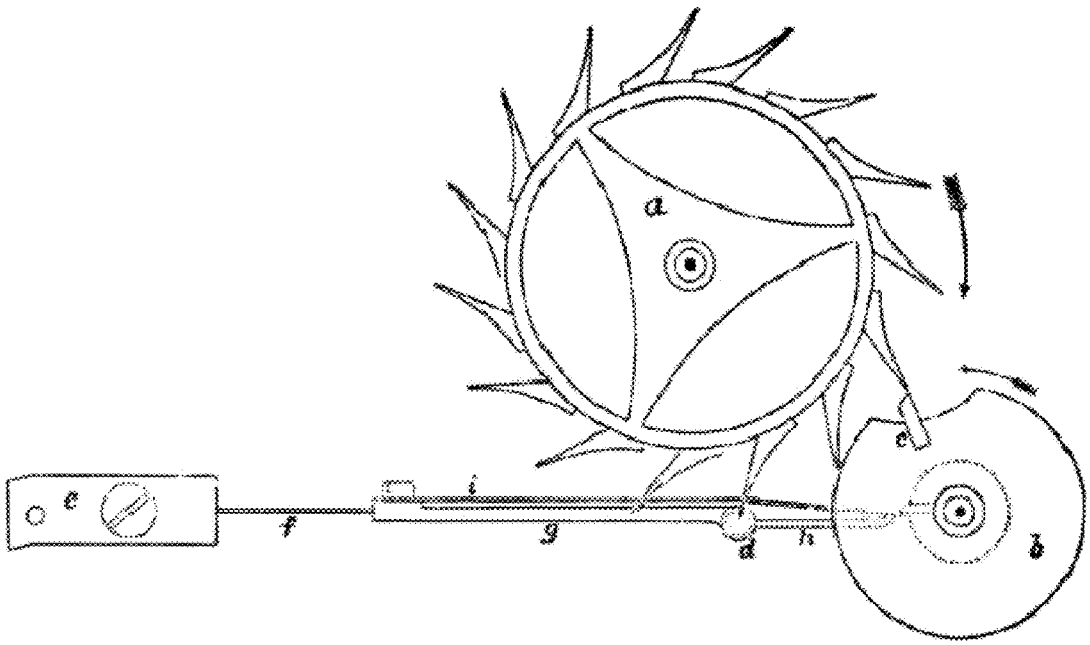
FIG. 36 illustrates a simplified classical detent watch escapement for an isotropic harmonic oscillator.

Embodiments of possible detent escapements for the isotropic harmonic oscillator are shown in FIGS. 36 to 38.

FIG. 36 illustrates a simplified classical detent watch escapement for an isotropic harmonic oscillator. The usual horn detent for reverse motion has been suppressed due to the unidirectional rotation of the oscillator.

FIG. 37 illustrates an embodiment of a detent escapement for translational orbiting mass. Two parallel catches 151 and 152 are fixed to the orbiting mass (not shown but illustrated schematically by the arrows forming a circle, reference 156) so have trajectories that are synchronous translations of each other. Catch 152 displaces detent 154 pivoted at spring 155 which releases escape wheel 153. Escape wheel impulses on catch 151, restoring lost energy to the oscillator.

FIG. 38 illustrates an embodiment of a new detent escapement for translational orbiting mass. Two parallel catches 161 and 162 are fixed to the orbiting mass (not shown) so have trajectories that are synchronous translations of each other. Catch 162 displaces detent 164 pivoted at spring 165 which releases escape wheel 163. Escape wheel impulses on catch 161, restoring lost energy to the oscillator. Mechanism allows for variation of orbit radius. Side and top views shown in this FIG. 38.

Figure 39:
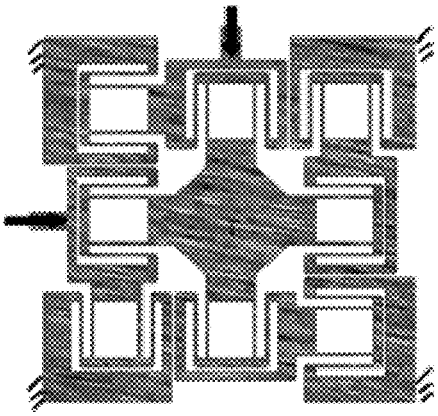
FIG. 39 illustrates example of compliant XY stages.
Figure 39:
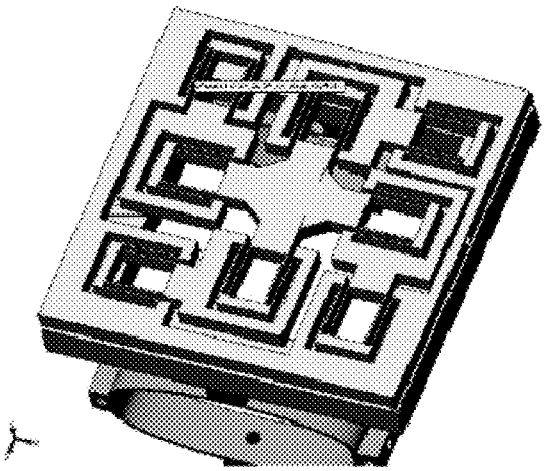
Figure 39:
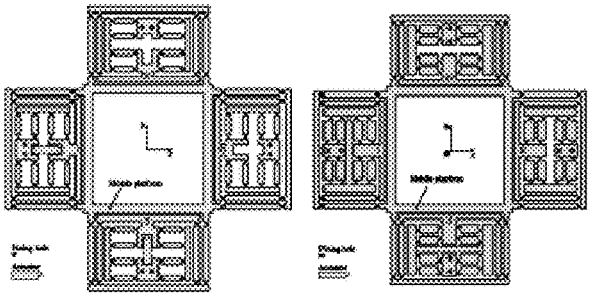
Figure 39:
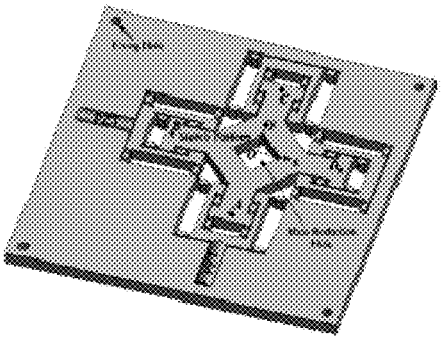

FIG. 39 illustrates examples of compliant XY-stages shown in the prior art references cited herein.

7 Difference with Previous Mechanisms

7.1 Difference with the Conical Pendulum

The conical pendulum is a pendulum rotating around a vertical axis, that is, perpendicular to the force of gravity, see FIG. 4. The theory of the conical pendulum was first described by Christiaan Huygens see references [16] and [7] who showed that, as with the ordinary pendulum, the conical pendulum is not isochronous but that, in theory, by using a flexible string and paraboloid structure, can be made isochronous.

However, as with cycloidal cheeks for the ordinary pendulum, Huygens' modification is based on a flexible pendulum and in practice does not improve timekeeping. The conical pendulum has never been used as a timebase for a precision clock.

Despite its potential for accurate timekeeping, the conical pendulum has been consistently described as a method for obtaining uniform motion in order to measure small time intervals accurately, for example, by Defossez in his description of the conical pendulum see reference [8, p. 534].

Theoretical analysis of the conical pendulum has been given by Haag see reference [11] [12, p. 199-201] with the conclusion that its potential as a timebase is intrinsically worse than the circular pendulum due to its inherent lack of isochronism.

The conical pendulum has been used in precision clocks, but never as a time base. In particular, in the 1860's, William Bond constructed a precision clock having a conical pendulum, but this was part of the escapement, the timebase being a circular pendulum see references [10] and [25, p. 139-143].

Our invention is therefore a superior to the conical pendulum as choice of time base because our oscillator has inherent isochronism. Moreover, our invention can be used in a watch or other portable timekeeper, as it is based on a spring, whereas this is impossible for the conical pendulum which depends on the timekeeper having constant orientation with respect to gravity.

7.2 Difference with Governors

Governors are mechanisms which maintain a constant speed, the simplest example being the Watt governor for the steam engine. In the 19th Century, these governors were used in applications where smooth operation, that is, without the stop and go intermittent motion of a clock mechanism based on an oscillator with escapement, was more important than high precision. In particular, such mechanisms were required for telescopes in order to follow the motion of the celestial sphere and track the motion of stars over relatively short intervals of time. High chronometric precision was not required in these cases due to the short time interval of use.

An example of such a mechanism was built by Antoine Breguet, see reference [4], to regulate the Paris Observatory telescope and the theory was described by Yvon Villarceau, see reference [24], it is based on a Watt governor and is also intended to maintain a relatively constant speed, so despite being called a regulateur isochrone (isochronous governor), it cannot be a true isochronous oscillator as described above. According to Breguet, the precision was between 30 seconds/day and 60 seconds/day, see reference [4].

Due to the intrinsic properties of harmonic oscillators following from the wave equation, see Section 8, constant speed mechanisms are not true oscillators and all such mechanisms have intrinsically limited chronometric precision.

Governors have been used in precision clocks, but never as the time base. In particular, in 1869 William Thomson, Lord Kelvin, designed and built an astronomical clock whose escapement mechanism was based on a governor, though the time base was a pendulum, see references [23] [21, p. 133-136] [25, p. 144-149]. Indeed, the title of his communication regarding the clock states that it features "uniform motion", see reference [23], so is clearly distinct in its purpose from the present invention.

7.3 Difference with Other Continuous Motion Timekeepers

There have been at least two continuous motion wristwatches in which the mechanism does not have intermittent stop & go motion so does not suffer from needless repeated accelerations. The two examples are the so-called Salto watch by Asulab, see reference [2], and Spring Drive by Seiko, see reference [22]. While both these mechanism attain a high level of chronometric precision, they are completely different from the present invention as they do not use an isotropic oscillator as a time base and instead rely on the oscillations of a quartz tuning fork. Moreover, this tuning fork requires piezoelectricity to maintain and count oscillations and an integrated circuit to control maintenance and counting. The continuous motion of the movement is only possible due to electromagnetic braking which is once again controlled by the integrated circuit which also requires a buffer of up to ±12 seconds in its memory in order to correct chronometric errors due to shock.

Our invention uses a mechanical oscillator as time base and does not require electricity or electronics in order to operate correctly. The continuous motion of the movement is regulated by the isotropic oscillator itself and not by an integrated circuit.

8 Realization of an Isotropic Harmonic Oscillator

In some embodiments some already discussed above and detailed hereunder, the present invention was conceived as a realization of the isotropic harmonic oscillator for use as a time base. Indeed, in order to realize the isotropic harmonic oscillator as a time base, there requires a physical construction of the central restoring force. One first notes that the theory of a mass moving with respect to a central restoring force is such that the resulting motion lies in a plane. It follows that for practical reasons, that the physical construction should realize planar isotropy. Therefore, the constructions described here will mostly be of planar isotropy, but not limited to this, and there will also be an example of 3-dimensional isotropy. Planar isotropy can be realized in two ways: isotropic springs and translational isotropic springs.

Isotropic springs have one degree of freedom and rotate with the support holding both the spring and the mass. This architecture leads naturally to isotropy. While the mass follows the orbit, it rotates about itself at the same angular velocity as the support. This leads to a spurious moment of inertia so that the mass no longer acts as a point mass and the departure from the ideal model described in Section 1.1 and therefore to a theoretical isochronism defect.

Translational isotropic springs have two translational degrees of freedom in which the mass does not rotate but translates along an elliptical orbit around the neutral point. This does away with spurious moment of inertia and removes the theoretical obstacle to isochronism.

9 Isotropic Spring Invention

A.1. As already discussed above, a rotating turntable 1 on which is fixed a spring 2 of rigidity k with the spring's neutral point at the center of rotation of the turntable is illustrated in FIG. 8. Assuming a massless turntable and spring, a linear central restoring force is realized by this mechanism. However, given the physical reality of the turntable and spring, this realization has the disadvantages of having significant spurious mass and moment of inertia.

A.2. A rotating cantilever spring 3 supported in a cage 4 turning axially is illustrated in FIG. 9, discussed above. This again realizes the central linear restoring force but reduces spurious moment of inertia by having a cylindrical mass and an axial spring. Numerical simulation shows that divergence from isochronism is still significant. A physical model has been constructed, see FIG. 10, where vertical motion of the mass has been minimized by attaching the mass to a double leaf spring producing approximately linear displacement instead of the approximately circular displacement of the single spring of FIG. 9. The data from this physical model is consistent with the analytic model.

We now list which of the theoretical properties of Section 3 hold for these realizations. In particular, for the rotating cantilever spring.

| Isotropic k | Radial k | Zero J | Isotropic m | Radial m | Gravity | Linear shock | Angular shock |
|---|---|---|---|---|---|---|---|
| Yes | Yes | No | Yes | Yes | One direction | No | No |

Note that gravity does not affect the spring when it is in the axial direction. However, these inventions have the disadvantage of having the spring and its support both rotating around their own axes, which introduces spurious moment of inertia terms which reduce the theoretical isochronism of the model. Indeed, considering the point mass of mass m and then including an isotropic support of moment of inertia I and constant total angular momentum L, then if friction is ignored, the equations of motion reduce to $$\ddot{r}+\left(\omega_0^2-\frac{L^2}{(I+mr^2)^2}\right)r=0.$$

This equation can be solved explicitly in terms of Jacobi elliptic functions and the period expressed in terms of elliptic integrals of the first kind, see [17] for definitions and similar applications to mechanics. A numerical analysis of these solutions shows that the divergence from isochronism is significant unless the moment of inertia I is minimized.

10 Translational Isotropic Springs: Background

In this section we will describe the background leading to our principal invention of isotropic springs. From now on and unless otherwise specified, "isotropic spring" will denote "planar translational isotropic spring."

10.1 Isotropic Springs: Technological Background

The invention is based on compliant XY-stages, see references [26, 27, 29, 30] and FIG. 39 illustrating examples of architecture from the references cited herein. Compliant XY-stages are mechanism with two degrees of freedom both of which are translations. As these mechanisms comprise compliant joints, see reference [28], they exhibit planar restoring forces so can be considered as planar springs.

In the literature Simon Henein, see reference [14, p. 166, 168], has proposed two XY-stages which exhibit planar isotropy. The first one, illustrated in FIG. 11 comprises two serial compliant four-bar 5 mechanisms, also called parallel arms linkage, which allows, for small displacements translations in the X and Y directions. The second one, illustrated in FIG. 12 comprises four parallel arms 6 linked with eight spherical joints 7 and a bellow 8 connecting the mobile platform 9 to the ground. The same result can be obtained with three parallel arms linked and with eight spherical joints and a bellow connecting the mobile platform to the ground.

10.2 Isotropic Springs: Simplest Invention and Description of Concept

Isotropic springs are one object of the present invention and they appear most suitable to preserve the theoretical characteristics of the harmonic oscillator are the ones in which the central force is realized by an isotropic spring, where the term isotropic is again used to mean "same in all directions."

The basic concept used in all the embodiment of the invention is to combine two orthogonal springs in a plane which ideally should be independent of each other. This will produce a planar isotropic spring, as is shown in this section.

As described above, the simplest version is given in FIG. 16. In this figure, two springs 11, 12 $S_x$ and Sy of rigidity k are placed that spring 12 $S_x$ acts in the horizontal x-axis and spring 11 $S_y$ acts in the vertical y-axis.

There is a mass 10 attached to both these springs and having mass m. The geometry is chosen such that at the point (0, 0) both springs are in their neutral positions.

One can now show that this mechanism exhibits isotropy to first order, see FIG. 17. Assuming now a small displacement d r=(dx, dy), then up to first order, there is a restoring force $F_x$ in the x direction of −k dx and a restoring force $F_y$ in y direction of −k dy. This gives a total restoring force $$F(dr)=(-kdx,-kdy)=-kdr$$

and the central linear restoring force of Section 2 is verified. It follows that this mechanism is, up to first order, a realization of a central linear restoring force, as claimed.

In these realizations, gravity affects the spring in all directions as it changes the effective spring constant. However, the spring does not rotate around its own axis, minimizing spurious moments of inertia, and the central force is directly realized by the spring itself. We now list which of the theoretical properties of Section 3 hold for these embodiments (up to first order).

| Isotropic k | Radial k | Zero J | Isotropic m | Radial m | Gravity | Linear shock | Angular shock |
|---|---|---|---|---|---|---|---|
| Yes | Yes | Yes | Yes | Yes | No | No | No |

Since a timekeeper needs to be very precise, at least 1/10000 for 10 second/day accuracy, an isotropic spring realization must itself be quite precise. This is the subject of embodiments of the present invention.

Since the invention closely models an isotropic spring and minimizes the isotropy defect, the orbits of a mass supported by the invention will closely model isochronous elliptical orbits with neutral point as center of the ellipse. FIG. 18A is basic illustration of the principle of the present invention (see above for its detailed description).

The principle exposed hereunder by reference to FIGS. 40 to 47 may be applied to the stages 131-134 illustrated in FIGS. 30 to 35 and described above as possible embodiments of said stages as has been detailed above.

10.3 in Plane Orthogonal Non-Compensated Parallel Spring Stages.

Figure 40:
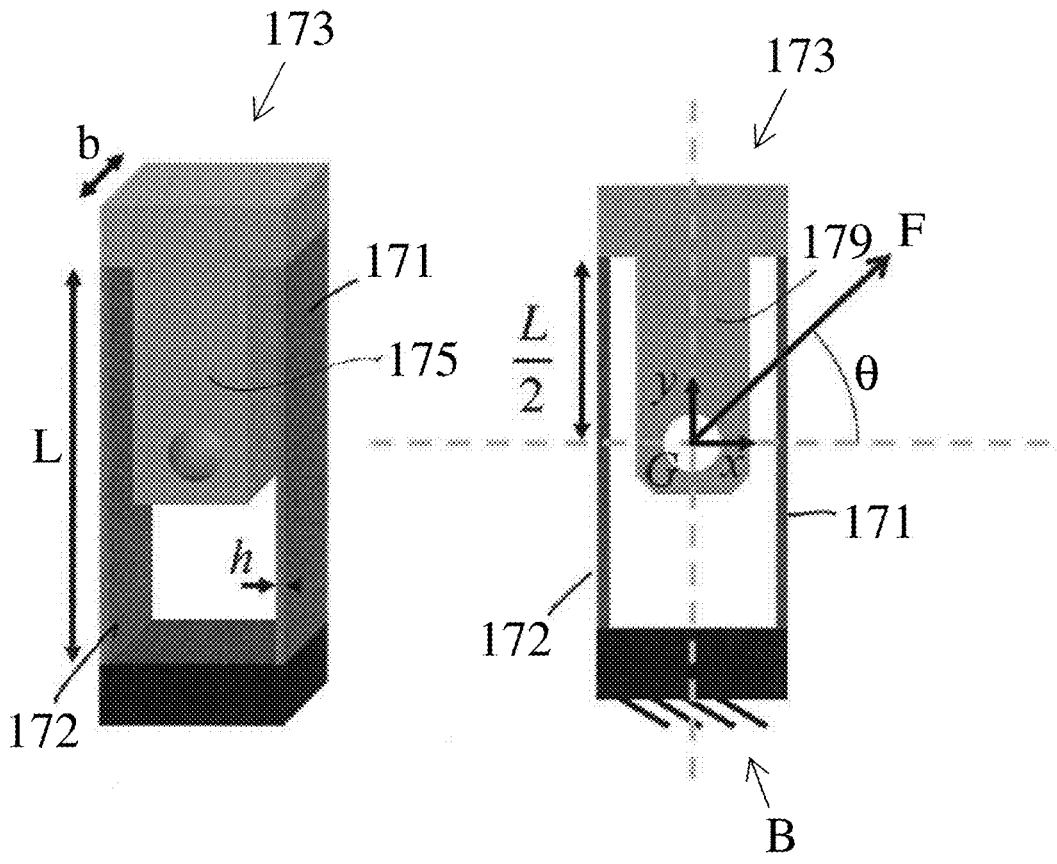
FIG. 40 illustrates an embodiment of a compliant joint.
Figure 41:
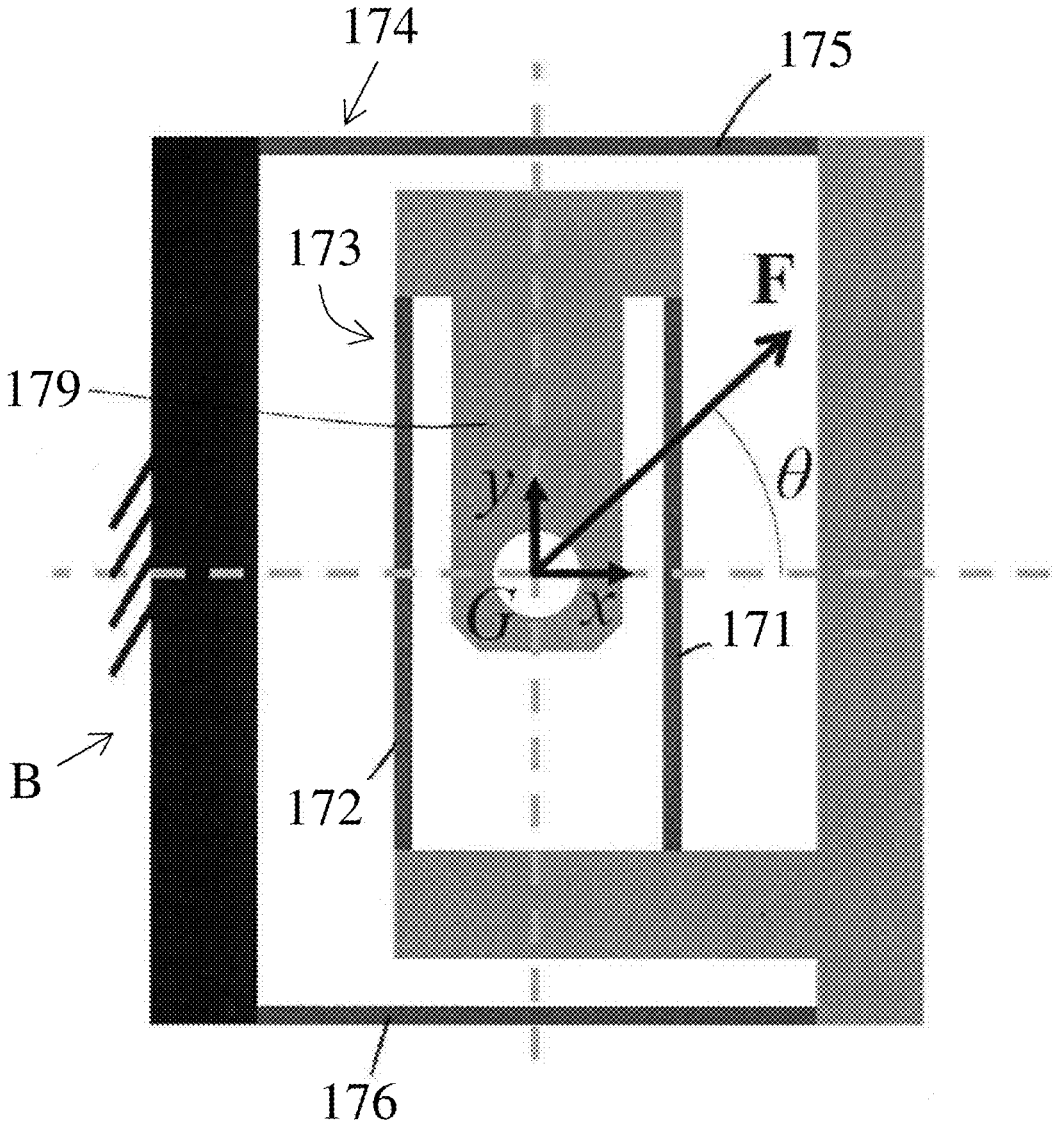
FIG. 41 illustrates an embodiment of a two degrees of freedom isotropic spring with two compliant joints.

The idea of combining two springs is refined by replacing linear springs with parallel springs 171, 172 as shown in FIG. 40 forming a spring stage 173 holding orbiting mass 179. In order to get a two degrees of freedom planar isotropic spring, two parallel spring stages 173, 174 (as shown in FIG. 40, each with parallel springs 171, 172, 175 and 176) are placed orthogonally, see FIGS. 19 and 41.

We now list which of the theoretical properties of Section 3 hold for these embodiments.

| Isotropic k | Radial k | Zero J | Isotropic m | Radial m | Gravity | Linear shock | Angular shock |
|---|---|---|---|---|---|---|---|
| No | Yes | Yes | No | Yes | One direction | No | No |

This model has two degrees of freedom as opposed to the model of Section 11.2 which has six degrees of freedom. Therefore, this model is truly planar, as is required for the theoretical model of Section 2. Finally, this model is insensitive to gravity when its plane is orthogonal to gravity.

We have explicitly estimated the isotropy defect of this mechanism and we will use this estimate to compare with the compensated mechanism isotropy defect.

11 Embodiment Minimizing m but not k Isotropy Defect

The presence of intermediate blocks leads to reduced masses which are different in different directions. The ideal mathematical model of Section 2 is therefore no longer valid and there is a theoretical isochronism defect. The invention of this section shown in FIG. 42 minimizes this difference. The invention minimizes reduced mass isotropy by stacking two identical in plane orthogonal parallel spring stages of FIG. 41 which are rotated by 90 degrees with respect to each other (angles of rotation about the z-axis).

Figure 42:
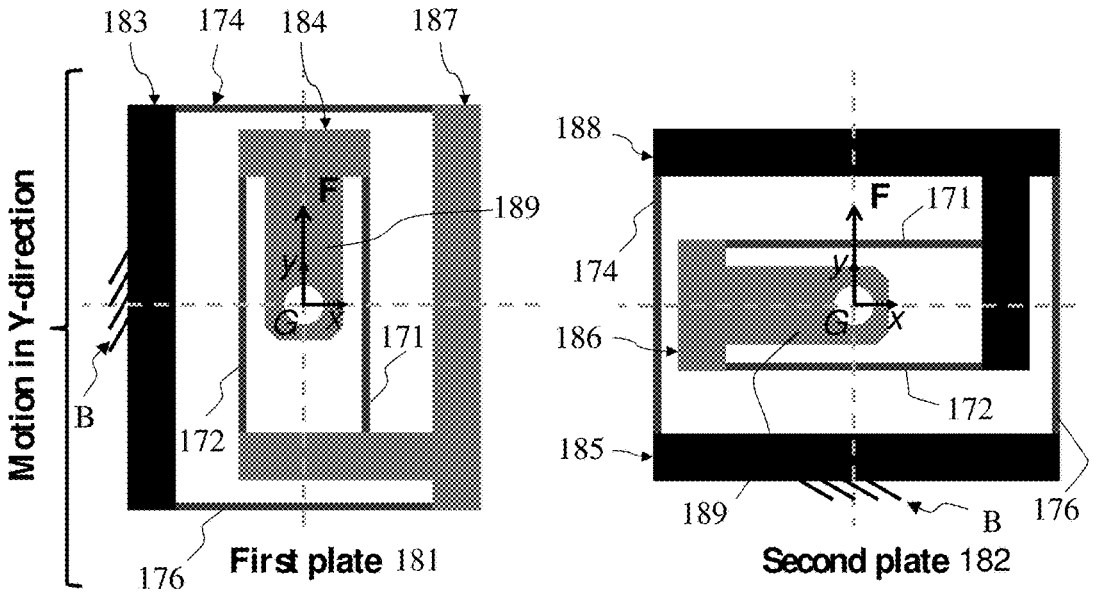
FIG. 42 illustrates an embodiment of the invention minimizing the reduced mass isotropy defect.
Figure 42:
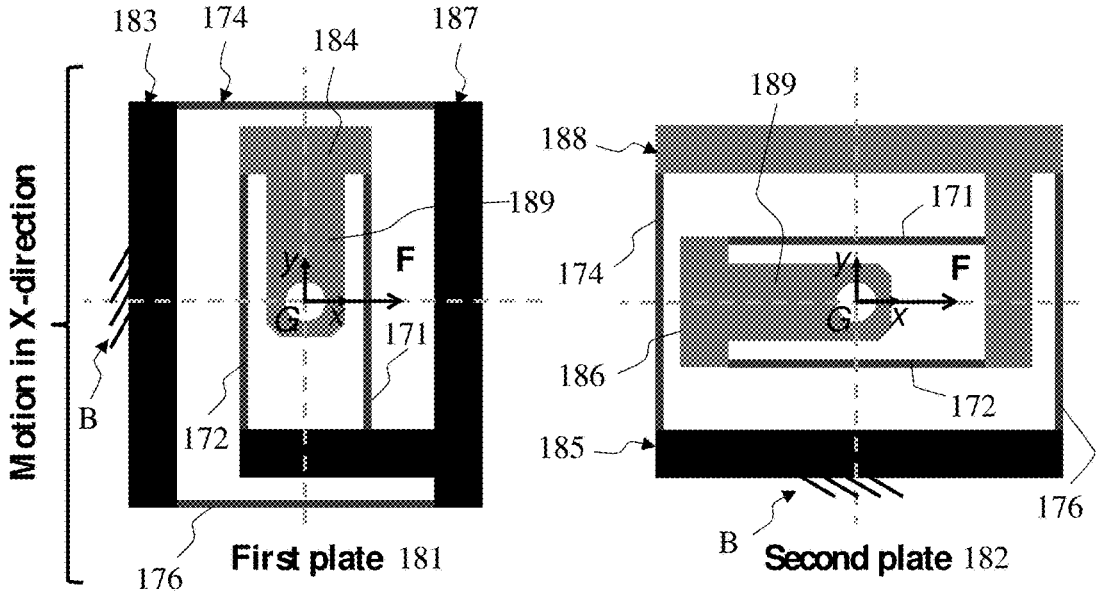

In FIG. 42 a first plate 181 is mounted on top of a second plate 182. Blocks 183 and 184 of first plate 181 are fixed onto blocks 185 and 186 respectively of second plate 182. In the upper two figures the grey shaded blocks 184, 187 of first plate and 186 of second plate 182 have a y-displacement corresponding to the y-component displacement of the orbiting mass 189, while the black shaded blocks 183 of the first plate 181 and 185, 188 of the second plate 182 remain immobile. In the lower figure, the grey shaded blocks 184, 187 of first 181 and 186 of second plate 182 have an x-displacement corresponding to the x-component displacement of the orbiting mass 189 while the black shaded blocks 183, 185, 188 of the first 181 and second 182 plates remain immobile. Since the first and second plates 181, 182 are identical, the sum of the masses of 184, 187 and 186 is equal to the sum of the masses of 184, 188 and 186. Therefore, the total mobile mass (grey blocks 184, 186, 187) is the same for displacements in x and in y directions, as well as in any direction of the plane.

As a result of the construction, the reduced mass in the x and y directions are identical and therefore the same in every planar direction, thus in theory minimizing reduced mass isotropy defect.

We now list which of the theoretical properties of Section 3 hold for these embodiments.

| Isotropic k | Radial k | Zero J | Isotropic m | Radial m | Gravity | Linear shock | Angular shock |
|---|---|---|---|---|---|---|---|
| No | Yes | Yes | Yes | Yes | One direction | No | No |

12 Embodiment Minimizing k but not m Isotropy Defect

The goal of this mechanism is to provide an isotropic spring stiffness. Isotropy defect, that is, the variation from perfect spring stiffness isotropy, will be the factor minimized in our invention. Our inventions will be presented in order of increasing complexity corresponding to compensation of factors leading to isotropy defects.

In plane orthogonal compensated parallel spring stages.

Out of plane orthogonal compensated parallel spring stages.

12.1 in Plane Orthogonal Compensated Parallel Spring Stages Embodiment

Figure 43:
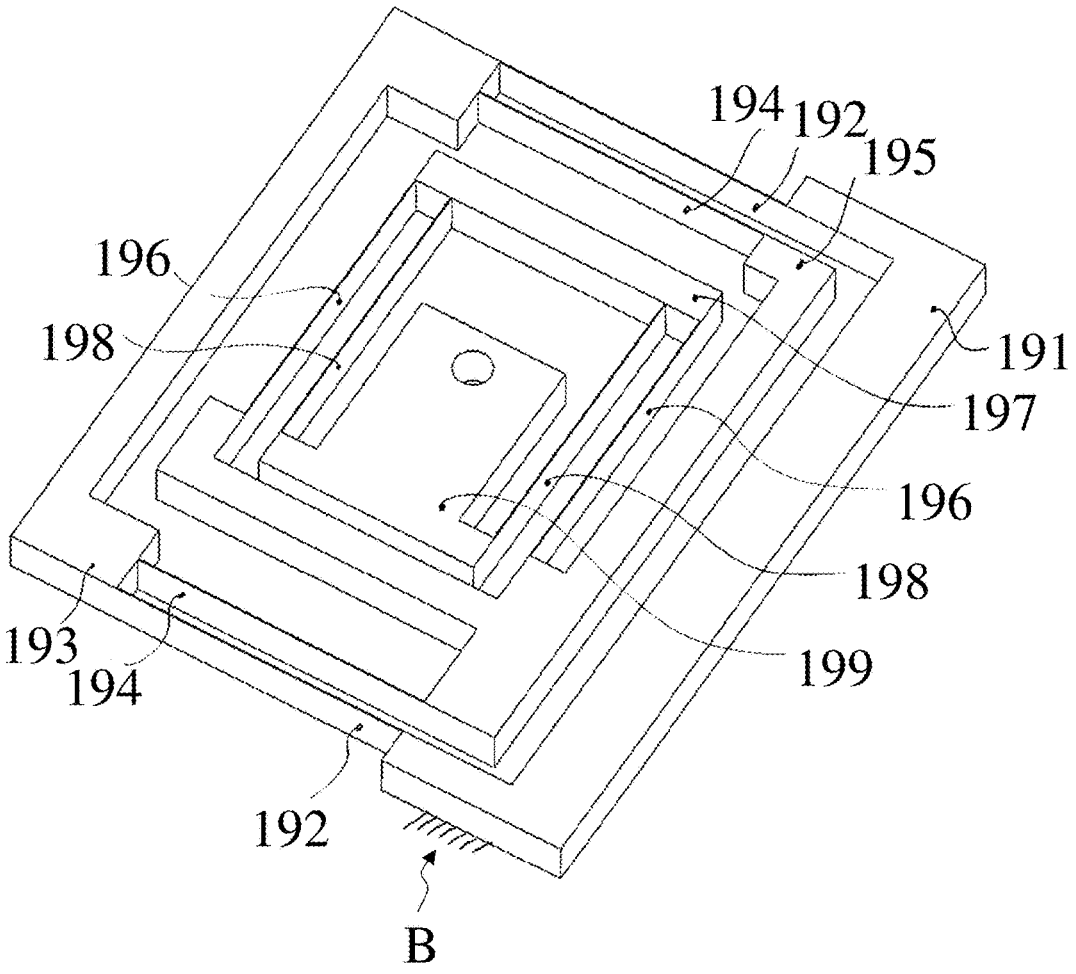
FIGS. 43, 44 and 45 illustrate embodiments of an in plane orthogonal compensated parallel spring stages.
Figure 44:
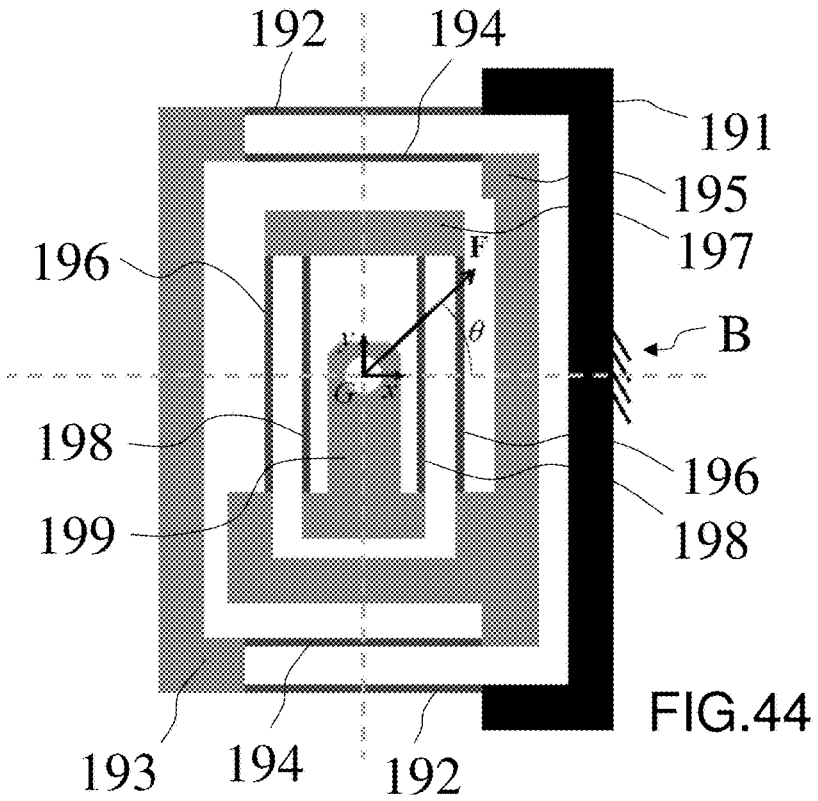

This embodiment is shown in FIG. 43 with a top view given in FIG. 44. Using compound parallel spring stages instead of simple parallel spring stages results in rectilinear movement at each stage. The principal cross-coupling effects leading to isotropy defects are therefore suppressed.

In particular, FIGS. 43 and 44 illustrate an embodiment of an in plane orthogonal compensated parallel spring stages according to the invention. Fixed base 191 holds first pair of parallel leaf springs 192 connected to intermediate block 193. Second pair of leaf springs 194 (parallel to 192) connect to second intermediate block 195. Intermediate block 195 holds third pair of parallel leaf springs 196 (orthogonal to springs 192 and 194) connected to third intermediate block 197. Intermediate block 197 holds parallel leaf springs 198 (parallel to springs 196) which are connected to orbiting mass 199 or alternatively to a frame holding the orbiting mass 199.

We now list which of the theoretical properties of Section 3 hold for these embodiments.

| Isotropic k | Radial k | Zero J | Isotropic m | Radial m | Gravity | Linear shock | Angular shock |
|---|---|---|---|---|---|---|---|
| Yes | Yes | Yes | No | Yes | One direction | No | No |

Figure 45:
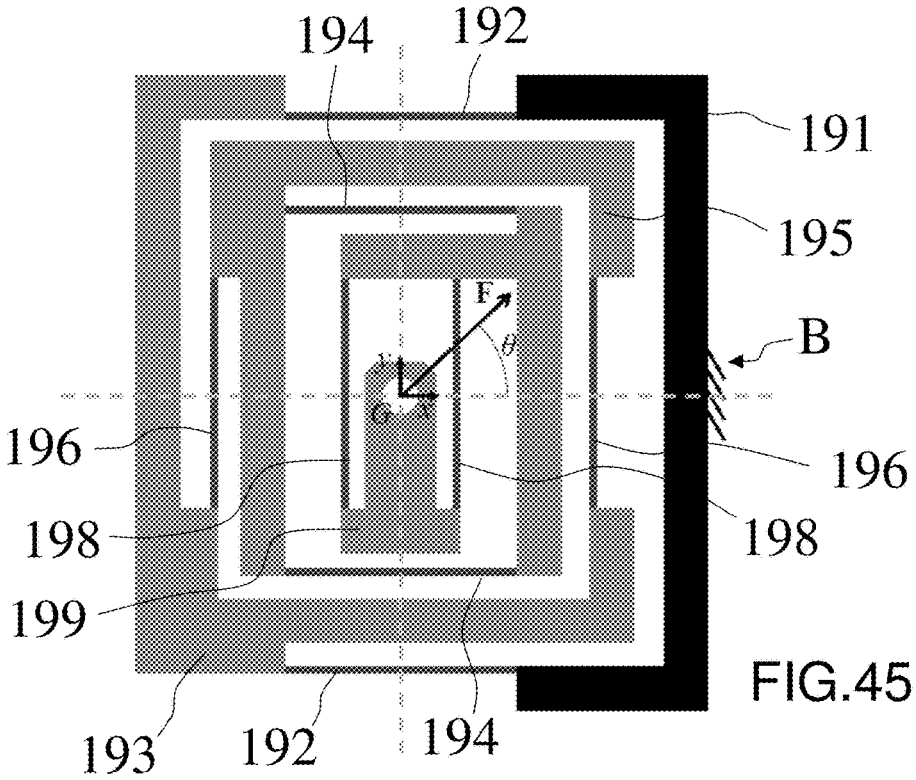

12.2 Alternative in Plane Orthogonal Compensated Parallel Spring Stages Embodiment An alternative embodiment to the in plane orthogonal compensated parallel spring stages is given in FIG. 45.

Instead of having the sequence of parallel leaf springs 192, 194, 196, 198 as in FIG. 43, the sequence is 192, 196, 194, 198.

We now list which of the theoretical properties of Section 3 hold for these embodiments.

| Isotropic k | Radial k | Zero J | Isotropic m | Radial m | Gravity | Linear shock | Angular shock |
|---|---|---|---|---|---|---|---|
| Yes | Yes | Yes | No | Yes | One direction | No | No |

12.3 Compensated Isotropic Planar Spring: Isotropy Defect Comparison

In a specific example computed, the in-plane orthogonal non-compensated parallel spring stages mechanism has a worst case isotropy defect of 6.301%. On the other hand, for the compensated mechanism, worst case isotropy is 0.027%. The compensated mechanism therefore reduces the worst case isotropy stiffness defect by a factor of 200.

A general estimate depends on the exact construction, but the above example estimate indicates that the improvement is of two orders of magnitude.

13 Embodiment Minimizing k and m Isotropy Defect

The presence of intermediate blocks leads to reduced masses which are different for different angles. The ideal mathematical model of Section 2 is therefore no longer valid and there is a theoretical isochronism defect. The invention of this section shown in FIG. 46 minimizes this difference. The invention minimizes reduced mass isotropy by stacking two identical in plane orthogonal compensated parallel spring stages which are rotated 90 degrees with respect to each other (angles of rotation about the z-axis).

Figure 46:
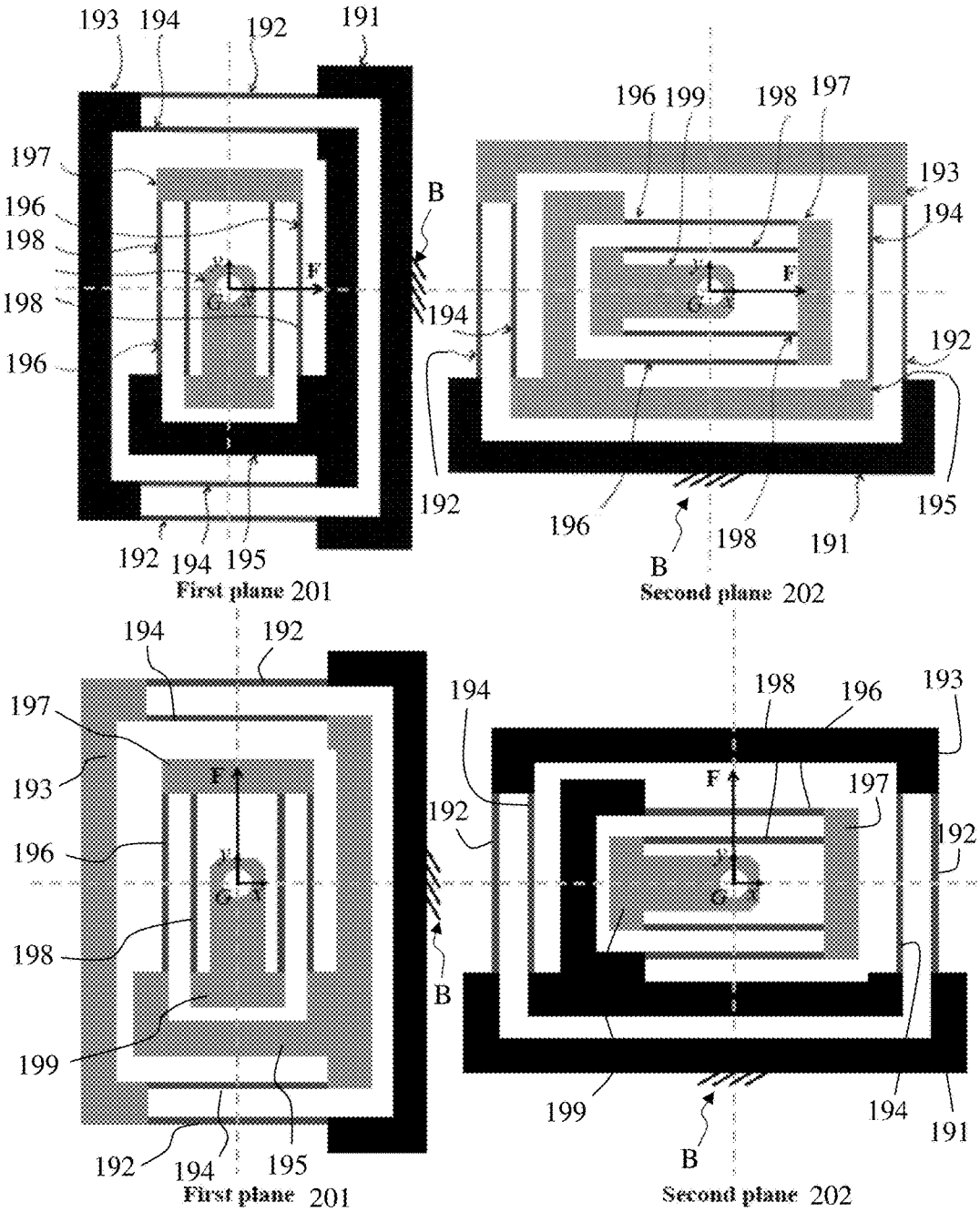
FIG. 46 illustrates an embodiment minimizing the reduced mass isotropy defect.

Accordingly, FIG. 46 discloses an embodiment minimizing the reduced mass isotropy defect.

A first plate 201 is mounted on top of a second plate 202 and the numbering has the same significance as in FIG. 43. Blocks 191 and 199 of first plate 201 are fixed onto blocks 191 and 199 respectively of second plate 202. In the upper figure the grey shaded blocks 197, 199 of first plate 201 and 193, 195, 197, 199 of second plate 202 have an x-displacement corresponding to the x-component displacement of the orbiting mass while the black shaded blocks 191, 193, 195 of the first plate 201 and 191 of the second plate 202 remain immobile. In the lower figure, the grey shaded blocks 193, 195, 197, 199 of first plate 201 and 199 of second plate 202 have a y-displacement corresponding to the y-component displacement of the orbiting mass while the black shaded block 191 of the first plate 201 and 191, 193, 195 of the second plate 202 remain immobile.

As a result of this embodiment, the reduced mass in the x and y directions are identical and therefore identical in every direction, thus in theory minimizing reduced mass isotropy defect.

We now list which of the theoretical properties of Section 3 hold for this embodiment.

| Isotropic k | Radial k | Zero J | Isotropic m | Radial m | Gravity | Linear shock | Angular shock |
|---|---|---|---|---|---|---|---|
| Yes | Yes | Yes | Yes | Yes | One direction | No | No |

13.1 Out of Plane Orthogonal Compensated Isotropic Spring Embodiment

Figure 47:
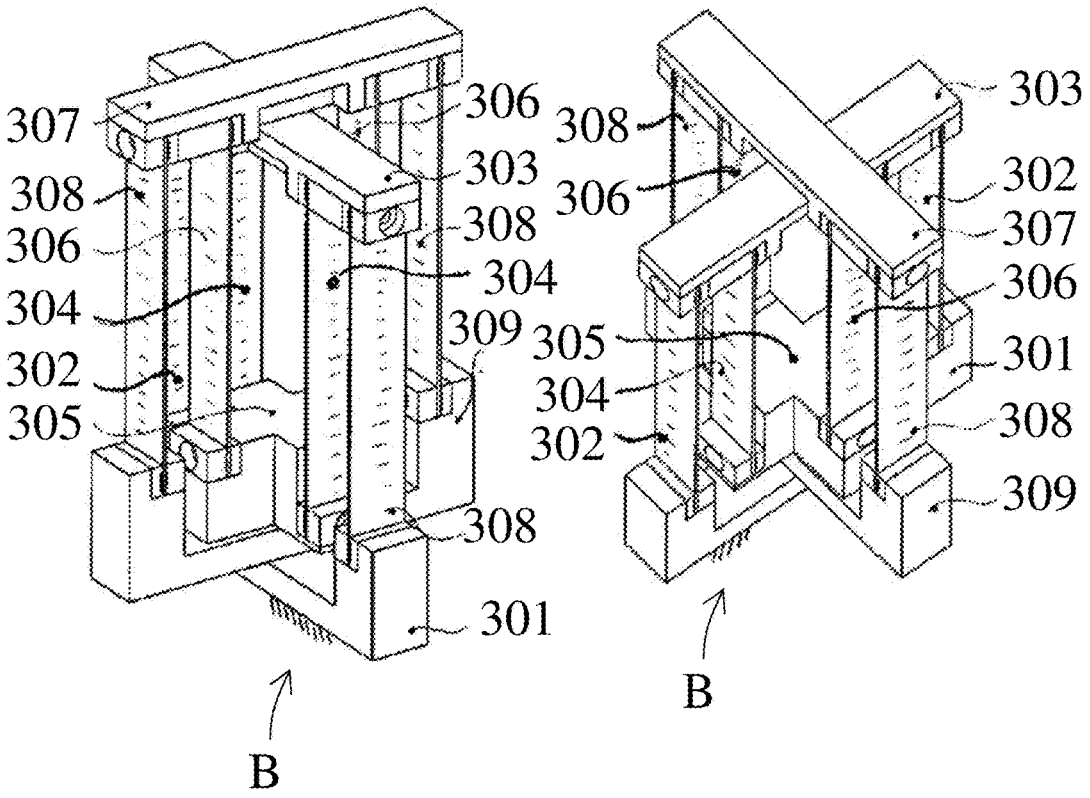
FIG. 47 illustrates an embodiment of an out of the plane orthogonal compensated isotropic spring according to the invention.

Another out of plane orthogonal compensated isotropic spring embodiment is illustrated in FIG. 47.

A fixed base 301 holds first pair of parallel leaf springs 302 connected to intermediate block 303. Second pair of leaf springs 304 (parallel to 302) connect to second intermediate block 305. Intermediate block 305 holds third pair of parallel leaf springs 306 (orthogonal to springs 302 and 304) connected to third intermediate block 307. Intermediate block 307 holds parallel leaf springs 308 (parallel to 306) which are connected to orbiting mass 309 (or alternatively frame holding the orbiting mass 309).

We now list which of the theoretical properties of Section 3 hold for this embodiment.

| Isotropic k | Radial k | Zero J | Isotropic m | Radial m | Gravity | Linear shock | Angular shock |
|---|---|---|---|---|---|---|---|
| Yes | Yes | Yes | Yes | Yes | One direction | No | No |

13.2 Reduced Isotropy Defect by Copying and Stacking in Parallel or in Series

We can reduce the isotropy defect by making a copy of the isotropic spring and stacking the copy on top of the original, with a precise angle offset.

Figure 55:
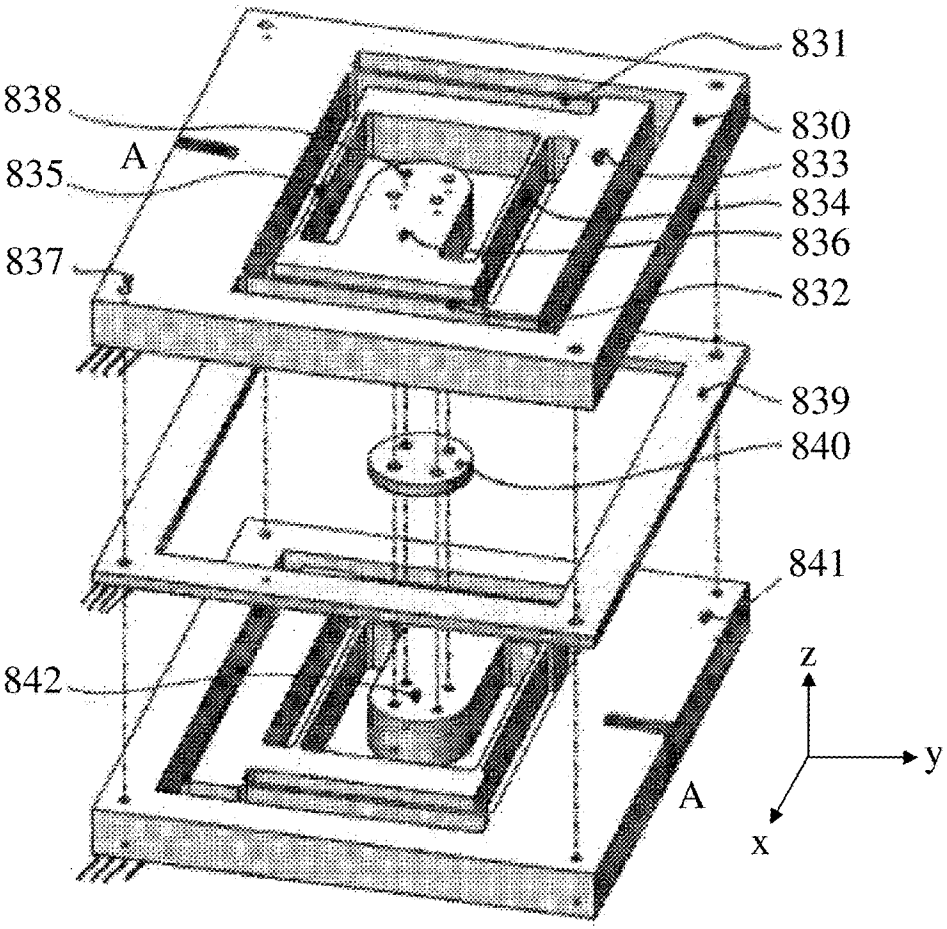
FIG. 55 illustrates a parallel assembly of two identical XY parallel spring oscillators for improved stiffness isotropy.

FIG. 55 illustrates a parallel assembly of two identical XY parallel spring oscillators for amelioration of the stiffness isotropy. The first XY parallel spring stage oscillator (upper stage on FIG. 55) comprises a fixed outer frame 830, a first pair of parallel leaf springs 831 and 832, an intermediate block 833, a second pair of parallel leaf springs 834 and 835, and a mobile block 838 on which the orbiting mass (not shown on the figure) is to be rigidly mounted. The second XY parallel spring stage (lower stage on FIG. 55) is identical to the first. Both stages are mounted together by rigidly attaching 830 to 841 and 836 to 842. The second XY parallel spring stage is rotated 180 degrees around the Z axis with respect to the first one (the figure shows that indexing-notch A on 830 is opposite to indexing-notch A in 841). Since the isotropy defect of a single stage is periodic, stacking two stages in parallel with the correct angular offset (in this case 180 degrees) leads to anti-phase cancellation of the defect. Shims 840 and 839 are used to separate slightly the two stages and avoid any friction between their mobile parts. The stiffness isotropy defect of the complete assembly is significantly smaller (typically a factor 2 to 20) than that of a single XY parallel spring stage. The stiffness isotropy can be further improved by stacking more than two stages rotated by angles smaller than 180 degrees. It is possible to invert the mechanism, i.e. to attach 838, 840 and 842 to the fixed base and mount the orbiting mass onto the outer frames 830, 839 and 841 with no changes in the overall behavior. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | no | No | No |

Figure 56:
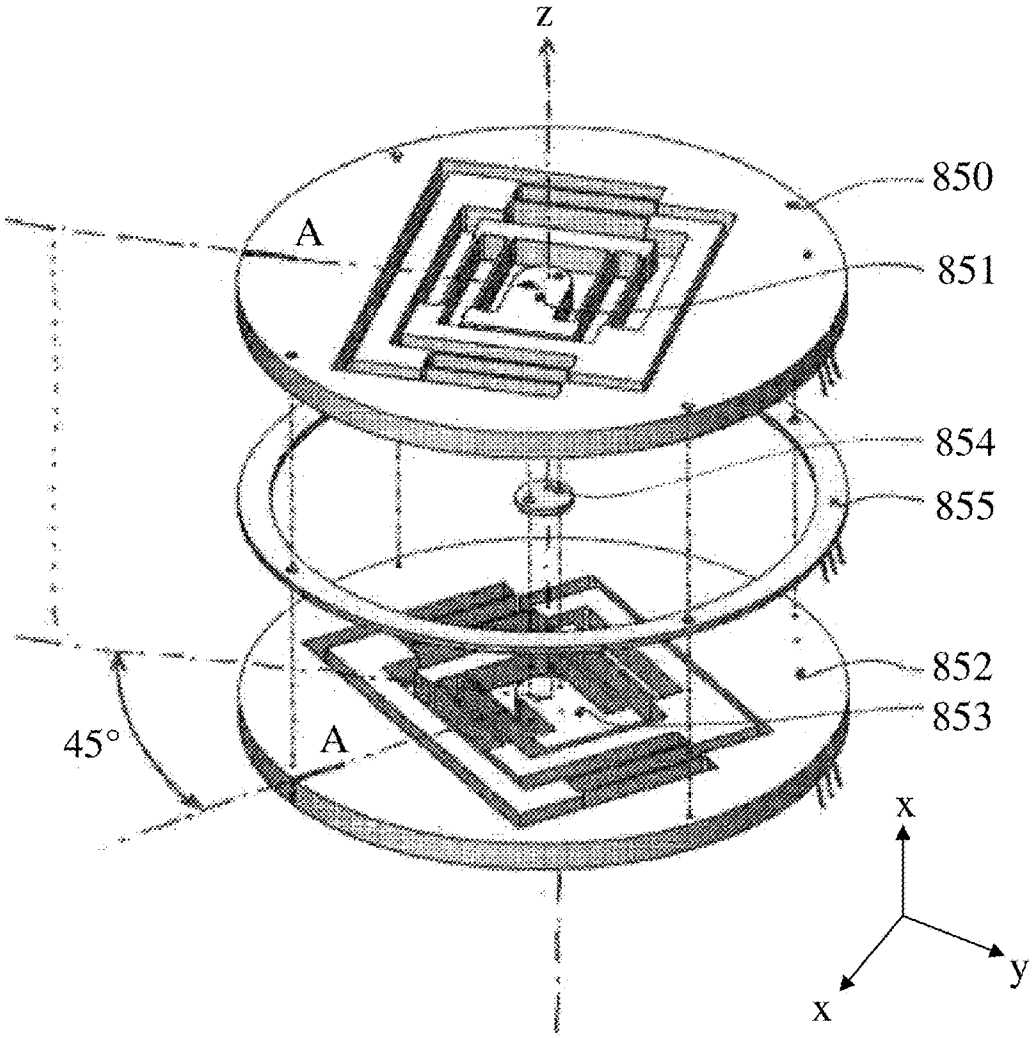
FIG. 56 illustrates a parallel assembly of two identical XY compound parallel spring oscillators for improved stiffness isotropy.

FIG. 56 illustrates a parallel assembly of two identical XY compound parallel spring oscillators for amelioration of the stiffness isotropy. The first XY compound parallel spring stage (upper part on FIG. 84) comprises a fixed outer frame 850 connected to a mobile block 851 via two perpendicular compound parallel spring stages mounted in series. The orbiting mass (not shown on the figure) is to be rigidly mounted onto the mobile block 851. The second XY compound parallel spring stage (lower part on FIG. 84) is identical to the first. It comprises a fixed outer frame 852 connected to a mobile rigid block 853 via two perpendicular compound parallel spring stages mounted in series. Both stages are mounted together by rigidly attaching 850 onto 852 and 851 onto 853. The second XY parallel spring stage is rotated 45 degrees around Z with respect to the first one (the figure shows that the indexing-notch A on 852 is rotated 45 degrees with respect to indexing-notch A in 850). Since the isotropy defect of a single stage is periodic, stacking two stages in parallel with the correct angular offset (in this case 45 degrees) leads to anti-phase cancellation of the defect. Shims 854 and 855 are used to separate slightly the two stages and avoid any friction between the mobile parts. The stiffness isotropy defect of the complete assembly is significantly smaller (typically a factor 100 to 500) than that of a single XY compound parallel spring stage. Note 1: The stiffness isotropy can be further improved by stacking more than two stages rotated by angles smaller than 45 degrees. Note 2: It is possible to invert the mechanism, i.e. to attach 851, 853 and 854 to the fixed base and mount the orbiting mass onto the outer frames 850, 852 and 855 with no changes in the overall behavior. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | no | No | No |

Typically, the embodiments illustrated in FIGS. 55 and 56 are applicable to the constructions and embodiments described hereinabove and illustrated in FIGS. 30 to 35 and 40 to 46 which comprise similar stages. Also, in relation to these embodiments, stacks comprising several stages (two or more) may be formed by stacking them on top of each other, each stage having an angular offset for example 45°, 90°, 180° or other values or even a combination thereof with respect to its neighboring stage, according to the principle described hereabove. Such combination of stages oriented with different angles allow reduction or even cancellation of the isotropy defect of the oscillator.

Figure 62:
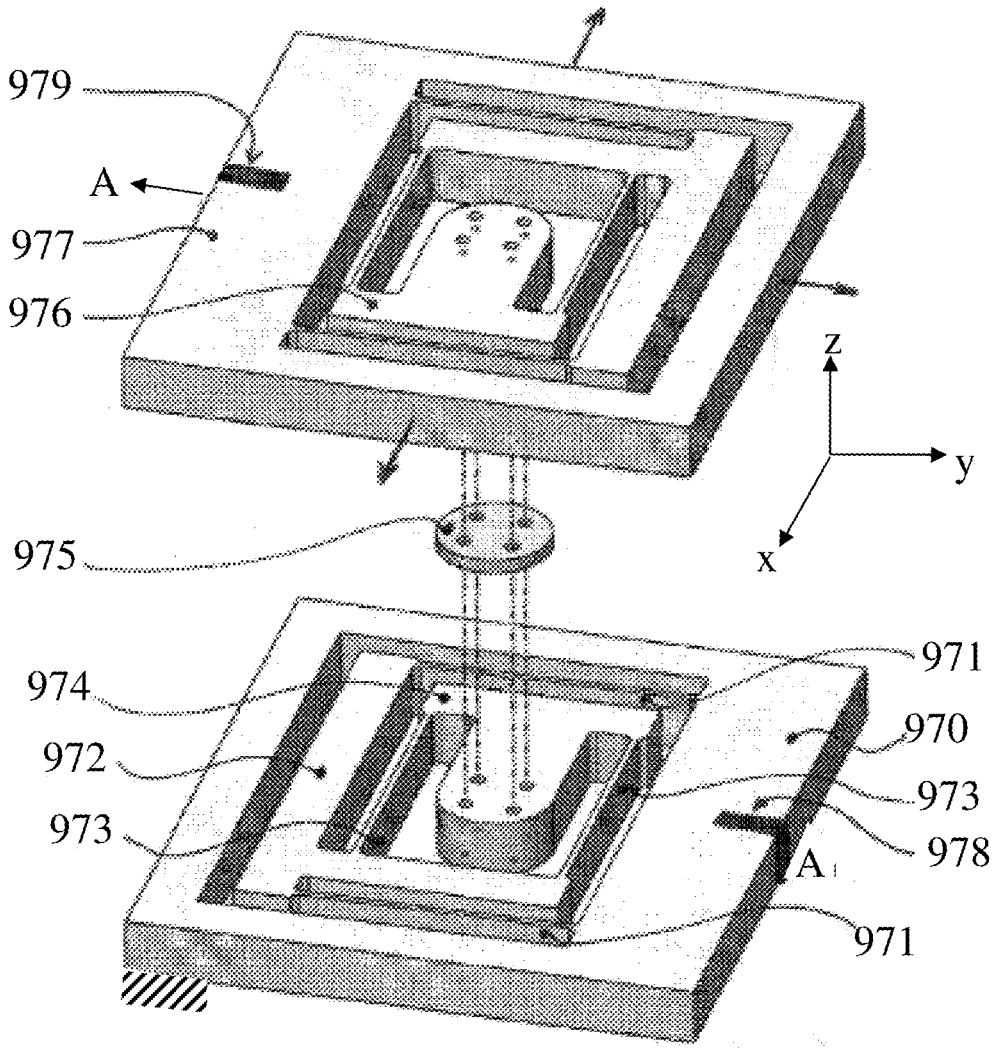
FIG. 62 illustrates a serial assembly of two identical XY parallel spring oscillators for improved stiffness isotropy.

FIG. 62 illustrates a serial assembly of two identical XY parallel spring oscillators for amelioration of the stiffness isotropy. The first XY parallel spring stage oscillator (lower stage on FIG. 62) comprises a fixed outer frame 970, a first pair of parallel leaf springs 971, an intermediate block 972, a second pair of parallel leaf springs 973, and a mobile block 974 on which the second XY parallel spring stage (upper stage on FIG. 62) is rigidly mounted. This second stage is identical to the first one. Both stages are mounted together by rigidly attaching 976 to 974 via a shim 975 creating a gap between the two stages. The second stage is rotated 180 degrees around the Z axis with respect to the first one (the figure shows that indexing-notch A on 970 is opposite to indexing-notch A in 979). The mobile mass of the oscillator is the block 977 (this block is made out of dense material whereas all the other mobiles blocks are made of low density material). Since the isotropy defect of a single stage is periodic, stacking two stages serially with the correct angular offset (in this case 180 degrees) leads to anti-phase cancellation of the defect. The stiffness isotropy defect of the complete assembly is significantly smaller (typically a factor 2 to 20) than that of a single XY parallel spring stage. The stiffness isotropy can be further improved by stacking more than two stages rotated by angles smaller than 180 degrees. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | no | No | No |

Figure 63:
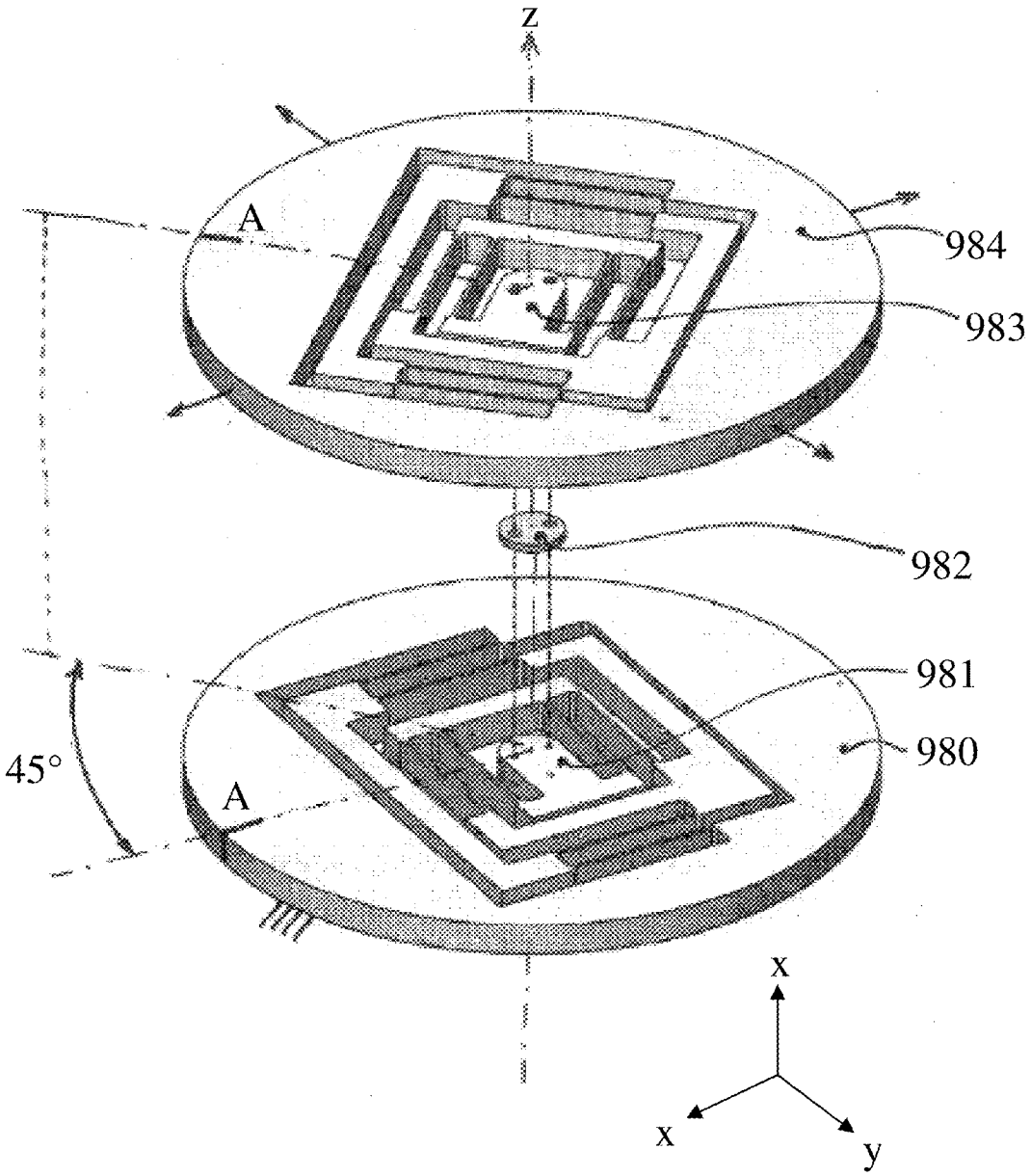
FIG. 63 illustrates a serial assembly of two identical XY compound parallel spring oscillators for improved stiffness isotropy and increased stroke.

FIG. 63 illustrates a serial assembly of two identical XY compound parallel spring oscillators for amelioration of the stiffness isotropy. The first XY parallel spring stage oscillator (lower stage on FIG. 63) comprises a fixed outer frame 980, and a mobile block 981 on which the second XY compound parallel spring stage (upper stage on FIG. 63) is rigidly mounted. This second stage is identical to the first one. Both stages are mounted together by rigidly attaching 981 to 983 via a shim 982 creating a gap between the two stages. The second stage is rotated 45 degrees around the Z axis with respect to the first one (the figure shows that indexing-notch A on 984 is shifted with respect to indexing-notch A in 980). The mobile mass of the oscillator is the block 984 (this block is made out of dense material whereas all the other mobiles blocks are made of low density material). Since the isotropy defect of a single stage is periodic, stacking two stages serially with the correct angular offset (in this case 45 degrees) leads to anti-phase cancellation of the defect.

The stiffness isotropy defect of the complete assembly is significantly smaller (typically a factor 100 to 500) than that of a single XY parallel spring stage. The stiffness isotropy can be further improved by stacking more than two stages rotated by angles smaller than 45 degrees. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | no | No | No |

14 Gravity and Shock Compensation

In order to place the new oscillator in a portable timekeeper, it is necessary to address forces that could influence the correct functioning of the oscillator. These include gravity and shocks.

14.1 Compensation for Gravity

The first method to address the force of gravity is to make a planar isotropic spring which when in horizontal position with respect to gravity does not feel its effect as described above.

However, this is adequate only for a stationary clock. For a portable timekeeper, compensation is required. This can be achieved by making a copy of the oscillator and connecting both copies through a ball or universal joint as described above in reference to FIGS. 20 to 24. In the realization of FIG. 20, the center of gravity of the entire mechanism remains fixed. One uses the oscillator of Section 14.

We now list which of the theoretical properties of Section 3 hold for this embodiment

| Isotropic k | Radial k | Zero J | Isotropic m | Radial m | Gravity | Linear shock | Angular shock |
|---|---|---|---|---|---|---|---|
| Yes | Yes | Yes | Yes | Yes | Yes | Yes | No |

14.2 Dynamical Balancing for Linear Acceleration

Linear shocks are a form of linear acceleration, so include gravity as a special case. Thus, the mechanism of FIG. 20 also compensates for linear shocks, see description above.

14.3 Dynamical Balancing for Angular Acceleration

Figure 49B:
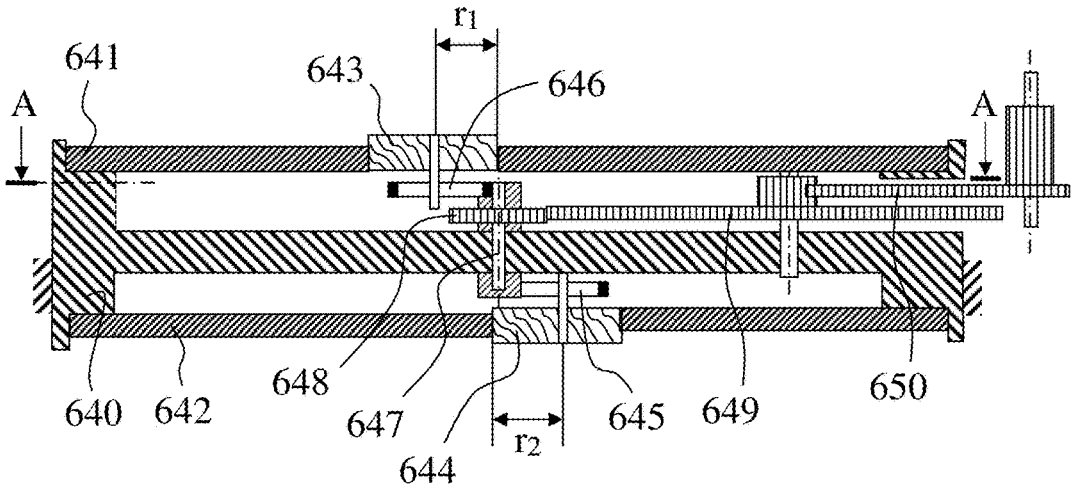
FIGS. 49A and 49B illustrate an embodiment of a dynamically balanced isotropic spring with differing orbital positions.
Figure 49A:
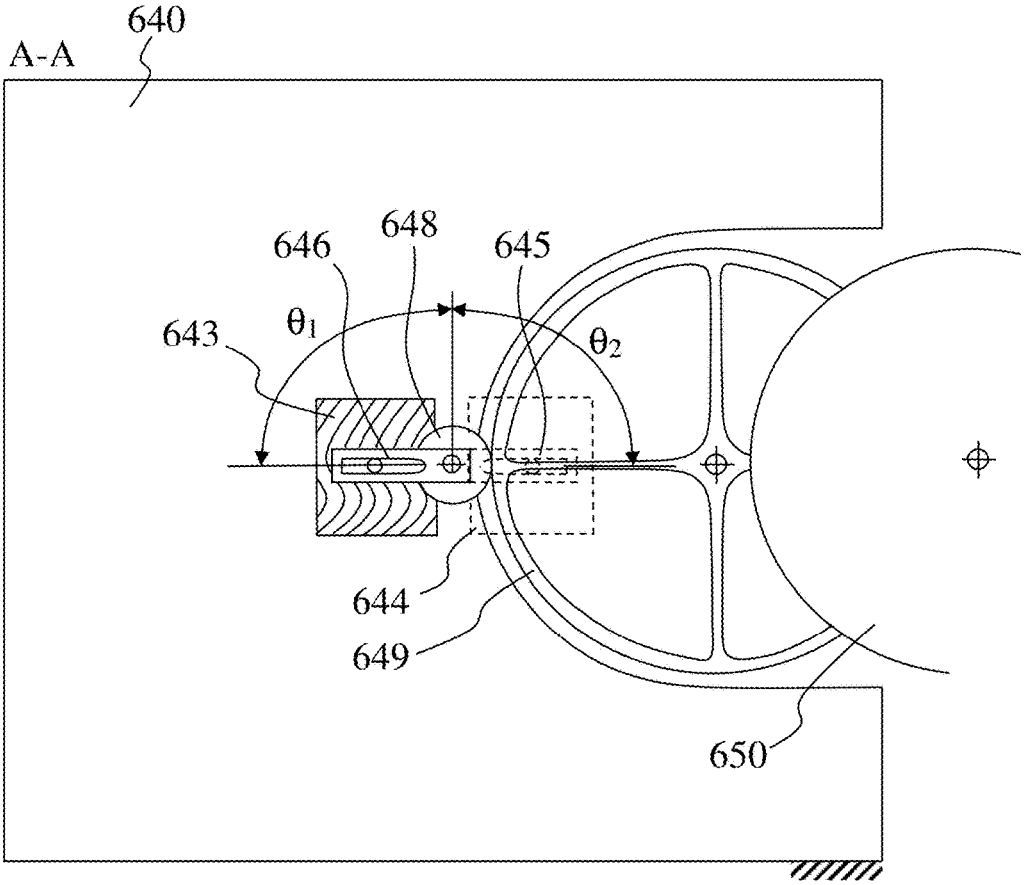

Effects due to angular accelerations can be minimized by reducing the distance between the centers of gravity of the two masses as shown in FIG. 21 by modifying the mechanism of the previous section shown in FIG. 20. Precise adjustment of the distance I shown in FIG. 21 separating the two centers of gravity allows for a complete compensation of angular shocks including taking account the moment of inertia of the lever itself. Another embodiment is shown in FIGS. 49A and 49B, where two XY oscillators are coupled via a crankshaft similar to a bicycle crankset and bottom bracket, with the cranks impulsing each XY oscillator at possibly different radii. More precisely, FIGS. 49A and 49B illustrate a dynamically balanced angularly coupled double oscillator. The orbiting masses 643 and 644 of two planar oscillators are coupled by a double crank (similar to a bicycle crankset) comprising an upper crank 646, a lower crank 645 and their shaft 647 (similar to a bicycle bottom bracket). Crank arm 646 contains a slot allowing a pin rigidly connected to mass 643 to slide in this slot. Similarly, mass 644 is rigidly connected to a pin sliding in a slot on crank 645. Shaft 647 is driven by a gear 648 which is itself driven by a gear 649, which in turn is driven by a gear 650. This arrangement forces both masse 643 and 644 to orbit at 180 degrees from each other (angular coupling). The radial positions of the two masses are independent (no radial coupling). The full system thus behaves as a three degrees of freedom oscillator. The fixed frame 641 and 642 of the upper and lower oscillators are attached to a common fixed frame 640. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | Partially | Partially | No |

Figures 50A, 50B:
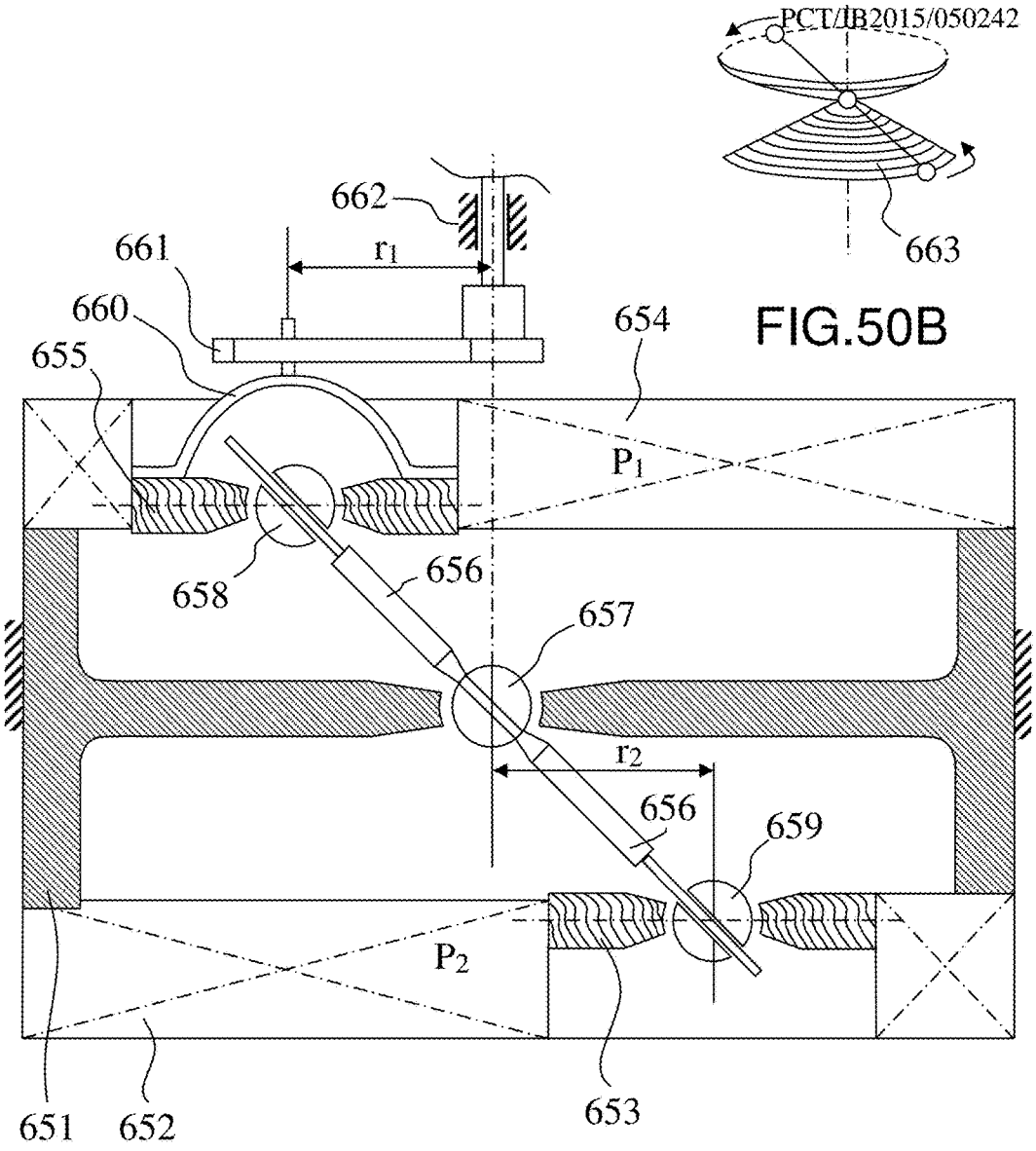
FIGS. 50A and 50B illustrate an embodiment of a dynamically balanced isotropic spring with identical orbital positions.

Another embodiment is given in FIGS. 50A and 50B, where two XY oscillators are coupled via a ball joint so that the radii and amplitudes are the same for each XY oscillator. More precisely, FIGS. 50A and 50B illustrate a dynamically balanced angularly and radially coupled double oscillator based on two planar oscillators. Orbiting masses 653 and 655 of two planar oscillators 654 and 652 are coupled by a coupling bar 656 connected to the fixed frame 651 by a ball joint 657. The two extremities of 656 slide axially into two spheres 658 and 659 forming ball joint articulations with respect to 655 and 653 respectively. This kinematic arrangement results in an angular and radial coupling of both oscillators. The full system thus behaves a two degree of freedom oscillator. The fixed frames 654 and 652 of the upper and lower oscillators are attached to a common fixed frame 651. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | Yes | Yes | Yes |

Figure 57:
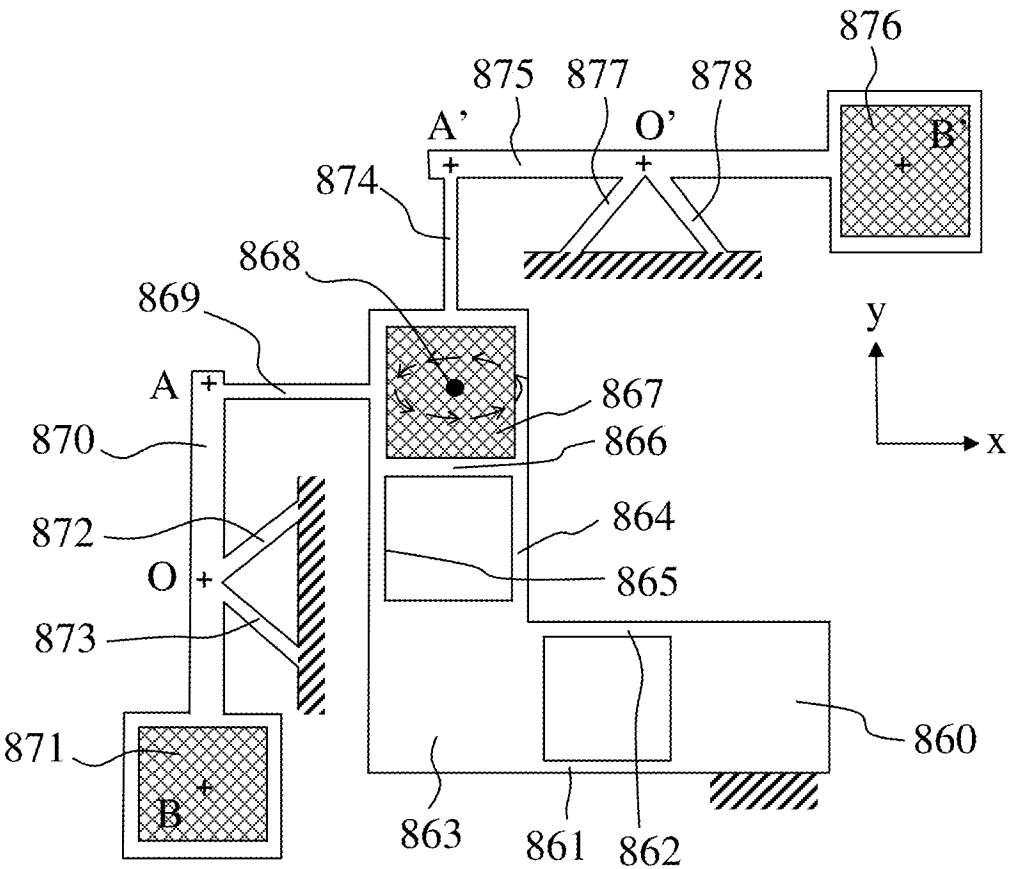
FIG. 57 illustrates an embodiment of a dynamically balanced isotropic spring.

Another embodiment is given in FIG. 57 where the dynamic balancing is achieved via levers having flexure pivots, with lever lengths chosen with ratios eliminating undesirable force. More precisely, FIG. 57 illustrates a dynamically balanced isotropic harmonic oscillator: The orbiting mass 867 (M) in mounted onto a frame 866. The frame 866 is attached to the fixed base 860 via two parallel spring stages mounted in series at 90 degrees: 861 and 862 provide a degree-of-freedom in the Y direction, and 864 and 865 provide a degree-of-freedom in the X direction. 863 is an intermediate mobile block. Additionally, 866 is connected to an X compensating mass 871 (*m*) moving in opposite direction for all movements in the X direction of 867, and to a Y direction compensating mass 876 moving in opposite direction for all movements in the Y direction. The inversion mechanism is based on a leaf spring 869 connecting the main mass 867 to a rigid lever 870. The lever pivots with respect to the fixed base thanks to a flexure-pivot comprising two leaf springs 872 and 873. The X direction compensating mass 871 is mounted onto the opposite end of the lever. The lever lengths are chosen to have the particular ratio OA/OB=m/M, so that linear acceleration in the XY plane produce no torque on the pivot O. An identical mechanism 874 to 878 is used to balance the main mass 867 dynamically for acceleration in the Y direction. The overall mechanism is thus highly insensitive to linear accelerations in the range of small deformations. A rigid pin 868 is attached to 867 and engages into the driving crank (not shown in the figure) maintaining the orbiting motion. Note: all parts except the masses 867, 871 and 876 are made out of a low-density material, for example aluminum alloy or silicon.

We now list which of the theoretical properties of Section 3 hold for this embodiment

| Isotropic k | Radial k | Zero J | Isotropic m | Radial m | Gravity | Linear shock | Angular shock |
|---|---|---|---|---|---|---|---|
| Yes | Yes | Yes | Yes | Yes | Yes | Yes | No |

16 Three Dimensional Translational Isotropic Spring Invention

Figure 48:
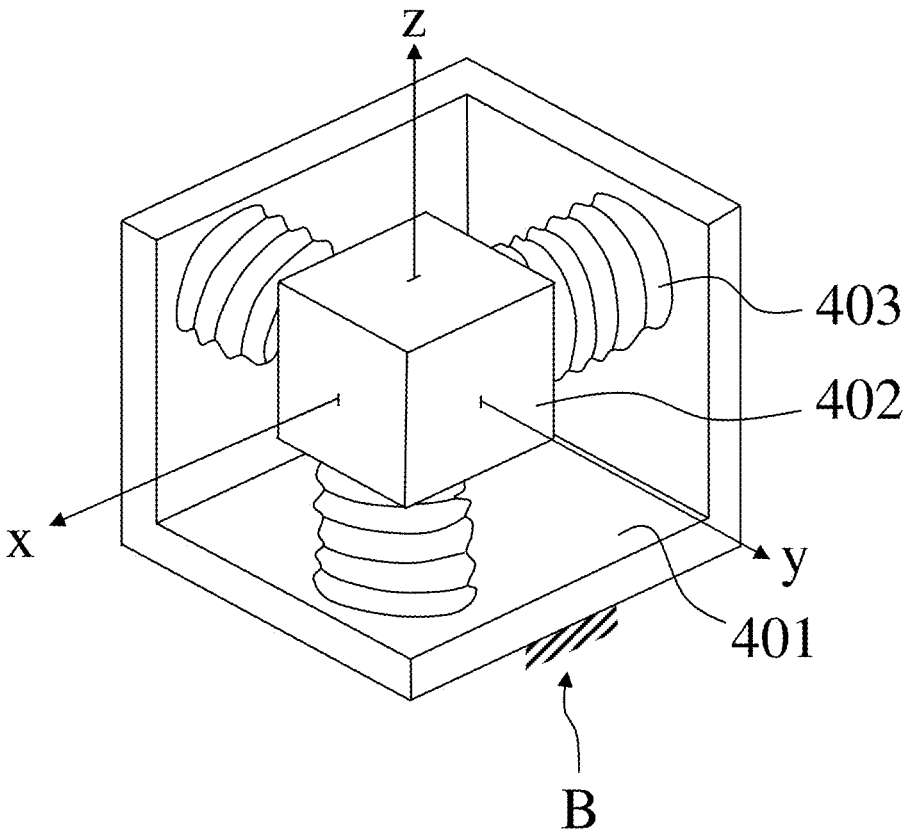
FIG. 48 illustrates an embodiment of a three dimensional isotropic spring.

The three dimensional translational isotropic spring invention is illustrated in FIG. 48. Three perpendicular bellows 403 connect to translational orbiting mass 402 to fixed base 401. Using the argument of section 10.2, see FIG. 17 above, this mechanism exhibits three dimensional isotropy up to first order. Unlike the two-dimensional constructions illustrated in FIGS. 16-18, the bellows 403 provide a 3 degree-of-freedom translational suspension making this a realistic working mechanism insensitive to external torque. Its properties are

| Isotropic k | Radial k | Zero J | Isotropic m | Radial m | Gravity | Linear shock | Angular shock |
|---|---|---|---|---|---|---|---|
| Yes | Yes | Yes | Yes | Yes | No | No | No |

17 Application to Accelerometers, Chronographs and Governors

By adding a radial display to isotropic spring embodiments described herein, the invention can constitute an entirely mechanical two degree-of-freedom accelerometer, for example, suitable for measuring lateral g forces in a passenger automobile.

In an another application, the oscillators and systems described in the present application may be used as a time base for a chronograph measuring fractions of seconds requiring only an extended speed multiplicative gear train, for example to obtain 100 Hz frequency so as to measure $1/100^{th}$ of a second. Of course, other time interval measurement is possible and the gear train final ratio may be adapted in consequence.

In a further application, the oscillator described herein may be used as a speed governor where only constant average speed over small intervals is required, for example, to regulate striking or musical clocks and watches, as well as music boxes. The use of a harmonic oscillator, as opposed to a frictional governor, means that friction is minimized and quality factor optimized thus minimizing unwanted noise, decreasing energy consumption and therefore energy storage, and in a striking or musical watch application, thereby improving musical or striking rhythm stability.

The embodiments given herein are for illustrative purposes and should not be construed in a limiting manner. Many variants are possible within the scope of the present invention, for example by using equivalent means. Also, different embodiments described herein may be combined as desired, according to circumstances.

Further, other applications for the oscillator may be envisaged within the scope and spirit of the present invention and it is not limited to the several ones described herein.

Main Features and Advantages of Some Embodiments of the Present Invention

A.1. A mechanical realization of the isotropic harmonic oscillator.

A.2. Utilization of isotropic springs which are the physical realization of a planar central linear restoring force (Hooke's Law).

A.3. A precise timekeeper due to a harmonic oscillator as timebase.

A.4. A timekeeper without escapement with resulting higher efficiency reduced mechanical complexity.

A.5. A continuous motion mechanical timekeeper with resulting efficiency gain due to elimination of intermittent stop & go motion of the running train and associated wasteful shocks and damping effects as well as repeated accelerations of the running train and escapement mechanisms.

A.6. Compensation for gravity.

A.7. Dynamic balancing of linear shocks.

A.8. Dynamic balancing of angular shocks.

A.9. Improving chronometric precision by using a free escapement, that is, which liberates the oscillator from all mechanical disturbance for a portion of its oscillation.

A.10. A new family of escapements which are simplified compared to balance wheel escapements since oscillator rotation does not change direction.

A.11. Improvement on the classical detent escapement for isotropic oscillator.

Innovation of Some Embodiments

B.1. The first application of the isotropic harmonic oscillator as timebase in a timekeeper.

B.2. Elimination of the escapement from a timekeeper with harmonic oscillator timebase.

B.3. New mechanism compensating for gravity.

B.4. New mechanisms for dynamic balancing for linear and angular shocks.

B.5. New simplified escapements.

Summary, Isotropic Harmonic Oscillators According to the Present Invention (Isotropic Spring)

Exemplary Features

1. Isotropic harmonic oscillator minimizing spring stiffness isotropy defect.
2. Isotropic harmonic oscillator minimizing reduced mass isotropy defect.
3. Isotropic harmonic oscillator minimizing spring stiffness and reduced mass isotropy defect.
4. Isotropic oscillator minimizing spring stiffness, reduced mass isotropy defect and insensitive to linear acceleration in all directions, in particular, insensitive to the force of gravity for all orientations of the mechanism.
5. Isotropic harmonic oscillator insensitive to angular accelerations.
6. Isotropic harmonic oscillator combining all the above properties: Minimizes spring stiffness and reduced mass isotropy and insensitive to linear and angular accelerations.

Applications of Invention

A.1. The invention is the physical realization of a central linear restoring force (Hooke's Law).

A.2. Invention provides a physical realization of the isotropic harmonic oscillator as a timebase for a timekeeper.

A.3. Invention minimizes deviation from planar isotropy.

A.4. Invention free oscillations are a close approximation to closed elliptical orbits with spring's neutral point as center of ellipse.

A.5. Invention free oscillations have a high degree of isochronism: period of oscillation is highly independent of total energy (amplitude).

A.5. Invention is easily mated to a mechanism transmitting external energy used to maintain oscillation total energy relatively constant over long periods of time.

A.6. Mechanism can be modified to provide 3-dimensional isotropy.

Features

N.1. Isotropic harmonic oscillator with high degree of spring stiffness and reduced mass isotropy and insensitive to linear and angular accelerations.

N.2. Deviation from perfect isotropy is at least one order of magnitude smaller, and usually two degrees of magnitude smaller, than previous mechanisms.

N.3. Deviation from perfect isotropy is for the first time sufficiently small that the invention can be used as part of a timebase for an accurate timekeeper.

N.4. Invention is the first realization of a harmonic oscillator not requiring an escapement with intermittent motion for supplying energy to maintain oscillations at same energy level.

REFERENCES (ALL INCORPORATED BY REFERENCE IN THE PRESENT APPLICATION)

[1] Joseph Bertrand, *Theoreme relatif au mouvement d'un point attire vers un centre fixe*, C. R. Acad. Sci. 77 (1873), 849-853.

[2] Jean-Jacques Born, Rudolf Dinger, Pierre-André Farine, *Salto—Un mouvement mécanique a remontage automatique ayant la précision d'un mouvement a quartz*, Societe Suisse de Chronométrie, Actes de la Journée d'Etude 1997.

[3] H. Bouasse, *Pendule Spiral Diapason II*, Librairie Delagrave, Paris 1920.

[4] Antoine Breguet, *Régulateur isochrone de M. Yvon Villarceau*, La Nature 1876 (premier semestre), 187-190.

[5] Louis-Clément Breguet, Brevet d'Invention 73414, 8 juin 1867, Ministère de l'agriculture, du Commerce et des Travaux publics (France).

[6] George Daniels, *Watchmaking, Updated* 2011 *Edition*, Philip Wilson, London 2011.

[7] Leopold Defossez, *Les savants du XVIIeme siecle et la mesure du temps*, Edition du Journal Suisse d'Horlogerie, Lausanne 1946.

[8] Leopold Defossez, *Theorie Generale de l'Horlogerie, Tome Premier*, La Chambre suisse d'horlogerie, La Chaux-de-Fonds 1950.

[9] Rupert T. Gould, *The Marine Chronometer, Second Edition*, The Antique Collector's Club, Woodbrige, England, 2013.

[10] R. J. Griffiths, *William Bond astronomical regulator No.* 395, Antiquarian Horology 17 (1987), 137-144.

[11] Jules Haag, *Sur le pendule conique*, Comptes Rendus de l'Académie des Sciences, 1947, 1234-1236.

[12] Jules Haag, *Les mouvements vibratoires, Tome second*, Presses Universitaires de France, 1955.

[13] K. Josic and R. W. Hall, *Planetary Motion and the Duality of Force Laws*, SIAM Review 42 (2000), 114-125.

[14] Simon Henein, *Conception des guidages flexibles*, Presses Polytechniques et Universitaires Romandes, Lausanne 2004.

[16] Christiaan Huygens, *Horologium Oscillatorium*, Latin with English translation by Ian Bruce, www.17centurymaths.com/contents/huygenscontents.html

[17] Derek F. Lawden, *Elliptic Functions and Applications*, Springer-Verlag, New York 2010. [18] J. C. Maxwell, *On Governors*, Bulletin of the Royal Society 100 (1868), 270-83. en.wikipedia.org/wiki/File:On_Governors.pdf

[19] Isaac Newton, *The Mathematical Principles of Natural Philosophy, Volume* 1, Translated by Andrew Motte 1729, Google eBook, retrieved Jan. 10, 2014.

[20] Niaudet-Breguet, "Application du diapason a l'horlogerie". Séance de lundi 10 décembre 1866. Comptes Rendus de l'Académie des Sciences 63, 991-992.

[21] Derek Roberts, *Precision Pendulum Clocks*, Schiffer Publishing Ltd., Atglen, Pa., 2003.

[22] Seiko Spring Drive official website, www.seikospring-drive.com, retrieved Jan. 10, 2014.

[23] William Thomson, *On a new astronomical clock, and a pendulum governor for uniform motion*, Proceedings of the Royal Society 17 (1869), 468-470.

[24] Yvon Villarceau, *Sur les régulateurs isochrones, dérivés du système de Watt*, Comptes Rendus de l'Académie des Sciences, 1872, 1437-1445.

[25] Philip Woodward, *My Own Right Time*, Oxford University Press 1995.

[26] Awtar, S., *Synthesis and analysis of parallel kinematic XY flexure mechanisms*. Ph.D. Thesis, Massachusetts Institute of Technology, Cambridge, 2006.

[27] M. Dinesh, G. K. Ananthasuresh, *Micro-mechanical stages with enhanced range*, International Journal of Advances in Engineering Sciences and Applied Mathematics, 2010.

[28] L. L. Howell, *Compliant Mechanisms*, Wiley, 2001.

[29] Yangmin Li, and Qingsong Xu, *Design of a New Decoupled XY Flexure Parallel Kinematic Manipulator with Actuator Isolation*, IEEE 2008

[30] Yangmin Li, Jiming Huang, and Hui Tang, *A Compliant Parallel XY Micromotion Stage With Complete Kinematic Decoupling*, IEEE, 2012

The invention claimed is:

1. A mechanical isotropic harmonic oscillator comprising:
a fixed base;
an intermediate block;
a mass configured to oscillate;
a first parallel spring stage connected between the mass and the intermediate block; and
a second parallel spring stage connected between the intermediate block and the fixed base,
wherein a direction of flexure of the first parallel stage is substantially perpendicular to a direction of flexure of the second parallel spring stage.

2. The oscillator as claimed in claim 1, wherein the first and the second parallel spring stage lie in a same plane.

3. A mechanical isotropic harmonic oscillator comprising:
a fixed base;
an intermediate block;
a mass configured to oscillate;
a first flexure means connected between the mass and the intermediate block; and
a second flexure means connected between the intermediate block and the fixed base,
wherein a direction of flexure of the first flexure means is substantially perpendicular to a direction of flexure of the second flexure means.

4. The oscillator as claimed in claim 3, wherein the first and the second flexure means lie in a same plane.

5. The oscillator as claimed in claim 1, wherein the first parallel spring stage includes a planar spring stage having two parallelly-arranged leaf springs.

6. The oscillator as claimed in claim 1, wherein the second parallel spring stage includes a planar spring stage having two parallelly-arranged leaf springs.

7. The oscillator as claimed in claim 1, wherein the first and the second parallel spring stage and the oscillating mass together form a two translational degree of freedom isotropic harmonic oscillator.

8. The oscillator as claimed in claim 1, wherein each one of the first and the second parallel spring stage form a one translational degree of freedom isotropic harmonic oscillator.

9. The oscillator as claimed in claim 1, further comprising:
a rigid pin attached to the oscillating mass, configured to engage with a slot acting as a driving crank to maintain oscillation of the oscillating mass.

10. The oscillator as claimed in claim 1, further comprising:
a second intermediate block;
a second mass configured to oscillate;
a third parallel spring stage connected between the second mass and the second intermediate block; and
a fourth parallel spring stage connected between the second intermediate block and the fixed base,
wherein a direction of flexure of the third parallel spring stage is substantially perpendicular to a direction of flexure of the fourth parallel spring stage, and
wherein the direction of flexure of the third parallel spring stage is substantially perpendicular to the direction of flexure of the first parallel spring stage.

11. The oscillator as claimed in claim 10, wherein the first mass and the second mass are connected together.

12. A wristwatch including the oscillator as defined in claim 1.

13. The oscillator as claimed in claim 3, wherein the first flexure means includes two parallelly-arranged leaf springs.

14. The oscillator as claimed in claim 3, wherein the second flexure means includes two parallelly-arranged leaf springs.

15. The oscillator as claimed in claim 3, wherein the first and the second flexure means and the mass together form a two translational degree of freedom isotropic harmonic oscillator.

16. The oscillator as claimed in claim 3, wherein each one of the first and the second flexure means form a one translational degree of freedom isotropic harmonic oscillator.

17. The oscillator as claimed in claim 3, further comprising:
a rigid pin attached to the mass, configured to engage with a slot acting as a driving crank to maintain oscillation of the mass.

18. The oscillator as claimed in claim 3, further comprising:
a second intermediate block;
a second mass configured to oscillate;
a third flexure means connected between the second mass and the second intermediate block; and
a fourth flexure means connected between the second intermediate block and the fixed base,
wherein a direction of flexure of the third flexure means is substantially perpendicular to a direction of flexure of the fourth flexure means, and
wherein the direction of flexure of the third flexure means is substantially perpendicular to the direction of flexure of the first flexure means.

19. The oscillator as claimed in claim 18, wherein the first mass and the second mass are connected together.

20. A wristwatch including the oscillator as defined in claim 3.

* * * * *